US006519424B2

(12) United States Patent
Matsuura et al.

(10) Patent No.: US 6,519,424 B2
(45) Date of Patent: Feb. 11, 2003

(54) IMAGE FORMING APPARATUS

(75) Inventors: Masahiko Matsuura, Suita (JP); Keyaki Yogome, Kyoto (JP); Hidetoshi Miyamoto, Takatsuki (JP); Hiroshi Mizuno, Ikoma (JP); Takaji Kurita, Osakasayama (JP)

(73) Assignee: Minolta Co., Ltd., Osaka (JP)

( * ) Notice: Subject to any disclaimer, the term of this patent is extended or adjusted under 35 U.S.C. 154(b) by 0 days.

(21) Appl. No.: 09/875,288

(22) Filed: Jun. 7, 2001

(65) Prior Publication Data

US 2002/0071687 A1 Jun. 13, 2002

(30) Foreign Application Priority Data

Jun. 9, 2000 (JP) ..... 2000-174338

(51) Int. Cl.[7] ..... G03G 15/00
(52) U.S. Cl. ..... 399/45
(58) Field of Search ..... 399/38, 42, 45; 347/171, 221

(56) References Cited

U.S. PATENT DOCUMENTS 4,126,854 A 11/1978 Sheridon ..... 340/373
4,143,103 A 3/1979 Sheridon ..... 264/4
5,517,228 A * 5/1996 Obu et al. ..... 347/171
5,946,019 A * 8/1999 Suzuki et al. ..... 347/171

FOREIGN PATENT DOCUMENTS

JP 05-297677 11/1993
JP 2000233524 * 8/2000

* cited by examiner

*Primary Examiner*—Hoan Tran
(74) *Attorney, Agent, or Firm*—McDermott, Will & Emery

(57) ABSTRACT

An image forming apparatus including a first image forming portion for forming an image on a normal image display medium; a second image forming portion for forming an image on a reversible image display medium; and a medium type detecting device for detecting the type of the image display medium to be subjected to the image formation, wherein the image forming portion corresponding to the image display medium of the type detected by the medium type detecting device is allowed to perform the image formation when the medium type detecting device detects the image display medium of the same type as that selected by an operator, and inhibition of the image formation on the medium of the detected type, image formation on the image display medium of another type or discharge of the medium of the detected type without image formation is performed when the detected type is different from the selected type.

20 Claims, 28 Drawing Sheets

IMAGE FORMING APPARATUS

The invention is based on the patent application No. 2000-174338 Pat. filed in Japan, the contents of which are hereby incorporated by reference.

BACKGROUND OF THE INVENTION

1. Field of the Invention

The present invention relates to an image forming apparatus, which can form images on a normal image display medium such as a normal paper sheet as well as a rewritable and reversible image display medium.

2. Description of the Background Art

At present, texts, graphics or the like prepared by a computer, a word processor or the like are displayed, for example, on a CRT display or the like, or are displayed by outputting them on a medium such as a paper sheet via a printer or the like.

However, the image display on the display such as a CRT display cannot achieve high resolutions as compared with images displayed, e.g., by printers on paper sheets, and can not display images with sufficiently high clearness and accuracy. Due to relatively low resolution and light emitted from the CRT or the like, an operation viewing images displayed on the CRT or the like for a long time causes fatigue in operator's eyes.

In contrast to the above, the display of texts and graphics on the image display mediums such as paper sheets can be performed with high clearness and high resolution, and therefore can be easy-on-the-eyes image display.

For the above reasons, texts, graphics and others prepared by the computer, word processor or the like are output onto mediums such as paper sheets by a printer or the like in almost every case even when it is necessary to read only temporarily the text or the like, or the texts are a draft which may be further revised.

The mediums such as paper sheets bearing images are abandoned or burnt when they are no longer required. This results in consumption of a large mount of resources. The printer or the like also consumes a large amount of consumable products or materials such toner, ink or thermal transfer sheets. For obtaining the new display mediums such as paper sheets or the like as well as toner, ink or the like, manufacturing energies and resources are required.

This is contrary to the current demand for reduction in environmental loads.

SUMMARY OF THE INVENTION

Accordingly, an object of the invention is to provide an image forming apparatus which can form images on normal image display mediums such as normal paper sheets as well as reversible (i.e., image-writable, image-erasable and image-rewritable) image display mediums, can satisfy current demands for reduction in environmental loads relating to required resources, energies and others owing to image formation on the reversible image display mediums allowing rewriting and therefore repetitive use, and does not cause a substantial problem compared with the conventional image forming apparatus owing to conventional image formation on the normal image display mediums.

Also, an object of the invention is to provide an image forming apparatus which can prevent such a useless and erroneous operation that an image is formed on the image display medium of the type different from the type selected by an operator of the image forming apparatus.

Further, an object of the invention is to provide an image forming apparatus which can prevent such a useless and erroneous operation that the image formation for the reversible image display medium is effected on the reversible image display medium, which is arranged upside down.

Further, an object of the invention is to provide an image forming apparatus which can prevent such errors that the image formation for the reversible image display medium is effected on the normal image display medium, and that the image formation for the normal image display medium is effected on the reversible image display medium.

Further, an object of the invention is to provide an image forming apparatus, which can form images on either of the normal image display medium and the reversible image display medium, and further allows easy use.

The invention provides the following image forming apparatuses.

(1) First Image Forming Apparatus

An image forming apparatus including:

a first image forming portion for forming an image on a normal image display medium;

a second image forming portion for forming an image on a reversible image display medium; and a medium type detecting device for detecting whether an image display medium to be subjected to the image formation is the normal image display medium or the reversible image display medium, wherein the first or second image forming portion corresponding to the image display medium of the type detected by the medium type detecting device is allowed to perform the image formation when the medium type detecting device detects the image display medium of the same type as that selected by an operator, and the image formation on the image display medium of the type detected by the medium type detecting device is inhibited when the detected type is different from the selected type.

(2) An Image Forming Apparatus Including:

a first image forming portion for forming an image on a normal image display medium;

a second image forming portion for forming an image on a reversible image display medium; and a medium type detecting device for detecting whether an image display medium to be subjected to the image formation is the normal image display medium or the reversible image display medium, wherein the first or second image forming portion corresponding to the image display medium of the type detected by the medium type detecting device is allowed to perform the image formation when the medium type detecting device detects the image display medium of the same type as that selected by an operator, and the first or second image forming portion corresponding to the image display medium of the type different from that detected by the medium type detecting device is allowed to perform the image formation when the detected type is different from the selected type.

(3) An Image Forming Apparatus Including:

a first image forming portion for forming an image on a normal image display medium;

a second image forming portion for forming an image on a reversible image display medium; and a medium type detecting device for detecting whether an image display medium to be subjected to the image formation is the normal image display medium or the reversible image display medium, wherein the first or second image forming portion corresponding to the image display medium of the type detected by the medium type detecting device is allowed to perform the image formation when the medium type detecting device detects the image display medium of the same type as that selected by an operator, and the image display medium of the type detected by the medium type detecting device is discharged without image formation when the detected type is different from the selected type.

(4) An Image Forming Apparatus Including:

a first image forming portion for forming an image on a normal image display medium;

a second image forming portion for forming an image on a reversible image display medium;

a medium type detecting device for detecting whether an image display medium to be subjected to the image formation is the normal image display medium or the reversible image display medium; and a medium surface direction detecting device for detecting whether the front and rear surfaces of the reversible image display medium are faced in predetermined directions, respectively, wherein the image formation by the second image forming portion is allowed when the image display medium detected by the medium type detecting device is the reversible image display medium and the medium surface direction detecting device detects the predetermined directions of the front and rear surfaces of the reversible image display medium, and the image formation by the second image forming portion is inhibited when the front and rear surfaces of the reversible image display medium are not faced in the predetermined directions.

(5) An Image Forming Apparatus Including:

a first image forming portion for forming an image on a normal image display medium;

a second image forming portion for forming an image on a reversible image display medium;

a medium type detecting device for detecting whether an image display medium to be subjected to the image formation is the normal image display medium or the reversible image display medium; and a medium surface direction detecting device for detecting whether the front and rear surfaces of the reversible image display medium are faced in predetermined directions, respectively, wherein the image formation by the second image forming portion is allowed when the image display medium detected by the medium type detecting device is the reversible image display medium and the medium surface direction detecting device detects the predetermined directions of the front and rear surfaces of the reversible image display medium, and the reversible image display medium is discharged without image formation when the front and rear surfaces of the reversible image display medium are not faced in the predetermined directions.

The fourth and fifth image forming apparatuses may be configured such that the image formation by the first image forming portion is allowed independently of the directions of the front and rear surfaces of the medium, if the medium type detecting device detects the normal image display medium.

The normal image display medium is a normal paper sheet, a sheet for overhead projector or the like.

The reversible image display medium is a rewritable (i.e., image-writable, image-erasable and image-rewritable) medium such as a reversible image display medium of an electric field drive type or a magnetic drive type. The reversible image display medium will be described later.

The foregoing and other objects, features, aspects and advantages of the present invention will become more apparent from the following detailed description of the present invention when taken in conjunction with the accompanying drawings.

BRIEF DESCRIPTION OF THE DRAWINGS

FIG. 1(A) is a cross section showing an example before image display, and FIG. 1(B) is a cross section showing an example during image display;

FIG. 23(B) shows an ion-flow stop state;

FIGS. 24(A) and 24(B) are plans showing an example of a medium TP allowing detection of the medium type, and FIG. 24(C) shows a state of detection of the medium type;

FIGS. 25(A) and 25(C) are plans showing another examples of the medium TP allowing detection of the medium type, and FIGS. 25(B) and 25(D) show states of detection of the medium type;

FIG. 26(A) shows a state of detection of the medium type TP based on a cassette dedicated to the medium TP, and FIG. 26(B) shows a state of detection of the medium type PP based on a cassette dedicated to the medium PP;

FIG. 27(A) shows a state of detection of the medium type TP based on a cassette dedicated to the medium TP, and FIG. 27(B) shows a state of detection of the medium type PP based on a cassette dedicated to the medium PP;

DESCRIPTION OF THE PREFERRED EMBODIMENTS

Figure 1A:
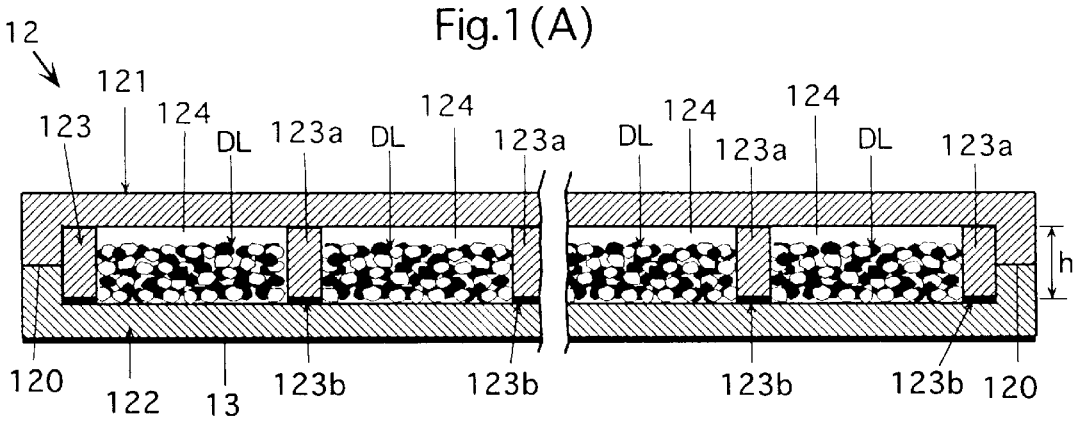
FIGS. 1(A) and 1(B) show an example of an image display medium of a dry chargeable particle containing type.

Each of the following image forming apparatuses of preferred embodiments of the invention includes:

- a first image forming portion for forming an image on a normal image display medium;
- a second image forming portion for forming an image on a reversible image display medium; and
- a medium type detecting device for detecting whether an image display medium to be subjected to the image formation is the normal image display medium or the reversible image display medium.

(1) First Type of Image Forming Apparatus

In a first type of image forming apparatus of one of preferred embodiments of the invention, the first or second image forming portion corresponding to the image display medium of the type detected by the medium type detecting device is allowed to perform the image formation when the medium type detecting device detects the image display medium of the same type as that selected by an operator, and the image formation on the image display medium of the type detected by the medium type detecting device is inhibited when the detected type is different from the selected type.

(2) Second Type of Image Forming Apparatus

In a second type of image forming apparatus of one of preferred embodiments of the invention,

- the first or second image forming portion corresponding to the image display medium of the type detected by the medium type detecting device is allowed to perform the image formation when the medium type detecting device detects the image display medium of the same type as that selected by an operator, and the first or second image forming portion corresponding to the image display medium of the type different from that detected by the medium type detecting device is allowed to perform the image formation when the detected type is different from the selected type.

(3) Third Type of Image Forming Apparatus

In a third type of image forming apparatus of one of preferred embodiments of the invention,

- the first or second image forming portion corresponding to the image display medium of the type detected by the medium type detecting device is allowed to perform the image formation when the medium type detecting device detects the image display medium of the same type as that selected by an operator, and the image display medium of the type detected by the medium type detecting device is discharged without image formation when the detected type is different from the selected type.

(4) Fourth Type of Image Forming Apparatus

A fourth type of image forming apparatus of one of preferred embodiments of the invention further includes:

- a medium surface direction detecting device for detecting whether the front and rear surfaces of the reversible image display medium are faced in predetermined directions, respectively.

The image formation by the second image forming portion is allowed when the image display medium detected by the medium type detecting device is the reversible image display medium and the medium surface direction detecting device detects the predetermined directions of the front and rear surfaces of the reversible image display medium, and the image formation by the second image forming portion is inhibited when the front and rear surfaces of the reversible image display medium are not faced in the predetermined directions.

(5) Fifth Type of Image Forming Apparatus

A fifth type of image forming apparatus of one of preferred embodiments of the invention also further includes:

- a medium surface direction detecting device for detecting whether the front and rear surfaces of the reversible image display medium are faced in predetermined directions, respectively.

The image formation by the second image forming portion is allowed when the image display medium detected by the medium type detecting device is the reversible image display medium and the medium surface direction detecting device detects the predetermined directions of the front and rear surfaces of the reversible image display medium, and the reversible image display medium is discharged without image formation when the front and rear surfaces of the reversible image display medium are not faced in the predetermined directions.

The fourth and fifth image forming apparatuses may be configured such that the image formation by the first image forming portion is allowed independently of the directions of the front and rear surfaces of the medium, if said medium type detecting device detects the normal image display medium.

In each of the image forming apparatuses of the foregoing embodiments, the medium type detecting device may be as follows:

(a) A device for detecting whether the image display medium to be used for image formation is the normal image display medium or the reversible image display medium, based on a medium type display portion provided at the image display medium accommodated in a cassette attached to a cassette attaching portion provided in the image forming apparatus.

(b) A device for detecting whether the image display medium to be used for image formation is the normal image display medium or the reversible image display medium, based on a medium type display portion provided at a image display medium accommodating cassette attached to a cassette attaching portion provided in the image forming apparatus.

The cassette attaching portion(s), if employed, may be one in number, or may be two or more in number. If the two or more portions are employed, the medium type detecting device of the foregoing (a) or (b) may be employed for each cassette attaching portion.

In any one of the image forming apparatuses of the foregoing embodiments, the image can be formed on either of the normal and reversible image display medium. Accordingly, images to be displayed only for temporary reading as well as draft images or the like to be further revised, if necessary, can be output and displayed on the reversible image display medium, and can also be output and displayed on the conventional normal image display medium, if necessary. The completed image or the like can be output and displayed on the normal image display medium for long-term preservation, presentations and others, as is done in the prior art. In some cases, the completed images or the like can be output and displayed on the reversible image display medium.

As described above, the images can be output and displayed on the reversible image display medium, which is rewritable and therefore can be reusable, so that it is possible to satisfy current demands for reduction in environmental loads relating to required resources, energies and others. Since images can be displayed on the conventional normal image display medium, no substantial disadvantage occurs similarly to the conventional image forming apparatus.

In the first, second and third types of image forming apparatuses described above, and particularly, in the apparatus provided with a plurality of cassette attaching portions, the selection of the type of the image display medium by the operator can be performed, e.g., by a medium type designating portion, by which the operator can select and designate the normal image display medium or the reversible image display medium to be subjected to the image formation in the image forming apparatus.

In the image forming apparatus provided with only one cassette attaching portion, for which the medium type detecting device is arranged, the medium type may be selected and designated as a result of the attachment of the medium accommodating-cassette dedicated to the image display medium selected by the operator.

In the first type of image forming apparatus, when the medium type detecting device detects the type of the image display medium different from that selected by the operator, the image formation on the image display medium of the detected type is inhibited. Accordingly, such a useless and erroneous operation can be suppressed that the image is formed on the image display medium of the type different from that selected by the operator. This achieves easy use, suppresses the useless and erroneous operations, and therefore can achieve the operation efficiency.

In the second type of image forming apparatus, when the medium type detecting device detects the type of the image display medium different from that selected by the operator, the image formation by the image forming portion for forming the image on the image display medium of the detected type is allowed.

Thereby, such errors can be suppressed that the image forming operation for the reversible image display medium is effected on the normal image display medium, and that the image forming operation for the normal image display medium is effected on the reversible image display medium.

Since the image formation by the image forming portion for forming the image on the image display medium of the detected type is allowed, operations by the operator are not required, resulting in easy use.

The medium type detecting device detects the type of the image display medium different from that selected by the operator in such cases that:

the medium type detecting device detects the type of the medium different from that arbitrarily selected and designated by the operator via the medium type designating portion, which is employed in the image forming apparatus provided with the two or more medium accommodating cassette attaching portions for selecting and designating the normal or reversible image display medium to be subjected to the image formation by the operator, the cassette accommodating the medium of the type not selected by the operator is erroneously attached to the cassette attaching portion, which is employed in the image forming apparatus and is only one in number, and the cassette accommodating the medium of the type selected by the operator additionally accommodates the medium of the different type in a mixed fashion.

In the third type of image forming apparatus, when the medium type detecting device detects the type of the image display medium different from that selected by the operator, the image display medium of the detected type is discharged without image formation. The apparatus may be configured such that, even after the medium is discharged in this manner, the image forming portion for forming the image on the image display medium of the type selected by the operator is allowed to perform the image formation when the medium type detecting device detects the image display medium of the type selected by the operator.

Accordingly, such a useless and erroneous operation can be suppressed that the image is formed on the image display medium of the type different from that selected by the operator. This results in easy use and high operation efficiency.

In the fourth type of image forming apparatus, the image formation by the second image forming portion is inhibited when the image display medium detected by the medium type detecting device is the reversible image display medium and the medium surface direction detecting device detects the directions different from the predetermined directions of the front and rear surfaces of the reversible image display medium.

Accordingly, such a useless and erroneous operation can be suppressed that the image formation is effect on the reversible image display medium having the front and rear surfaces faced in the directions different from the predetermined directions (e.g., when the front surface to be faced to the image forming side is not faced to such a side). This results in easy use and high operation efficiency.

In the fifth type of image forming apparatus, the reversible image display medium is discharged without image formation when the image display medium detected by the medium type detecting device is the reversible image display medium and the medium surface direction detecting device detects the directions different from the predetermined directions of the front and rear surfaces of the reversible image display medium. The apparatus may be configured such that, even after the medium is discharged in this manner, the second image forming portion for forming the image on the reversible image display medium is allowed to perform the image formation when the medium type detecting device and the medium surface direction detecting device detects the reversible image display medium having the front and rear surfaces faced in the predetermined directions.

Accordingly, such useless and erroneous operations can be suppressed that the image is formed on the reversible image display medium having the front and rear surfaces in the directions different from the predetermined directions. This results in easy use and high operation efficiency.

In any one of the foregoing image forming apparatuses, the first image forming portion for forming the image on the normal image display medium may be of an indirect recording type or a direct recording type.

As a typical example, the image forming portion of the indirect recording type may be of an electrophotographic type configured to form the image by forming an electrostatic latent image corresponding to the image to be formed on an electrostatic latent image carrier, developing the electrostatic latent image into a toner image and transferring the toner image onto the normal image display medium for fixing the same.

The image forming portion of the direct recording type may be of an ink-jet type configured to form the image by ejecting ink onto the image display medium in accordance with the image to be formed, may be of a sublimation transfer type configured to form the image by thermally transferring ink from a transfer film carrying the sublimation ink onto the image display medium in accordance with the image to be formed, or may be of a thermal transfer type configured to form the image by thermally transferring thermal ink applied over transfer film onto the image display medium in accordance with the image to be formed.

The normal image display medium may be a normal paper sheet, an overhead projector sheet or the like as already described, and an appropriate image display medium can be used from among them in accordance with the method of forming the image on the normal image display medium by the first image forming portion.

The second image forming portion may be configured:

- to display the image on the reversible image display medium of the electric field drive type by an electric field corresponding to the image to be formed, or
- to display the image on the reversible image display medium of the magnetic drive type by a magnetic field corresponding to the image to be formed.

The reversible image display mediums of the electric field drive type and the magnetic drive type will be described later. The image forming portion for the reversible image display medium will also be described later.

When using the reversible image display medium of the electric field drive type containing magnetic developer particles, the second image forming portion may be provided with a device for magnetically stirring dry developer particles for forming the image on the reversible image display medium by an electric field.

In each of the foregoing types of the image forming apparatuses described above, the reversible image display medium of the electric field drive type, which can be used depending on the structure of the image forming portion, may be an image display medium of a dry chargeable particle containing type, an electrophoresis type, a twist ball type or the like. These will now be described.

<Image Display Medium of Dry Chargeable Particle Containing Type>

A reversible image display medium includes dry developer particles contained in developer containing cell(s), which is(are) formed between two substrates (at least one having light transparency) opposed to each other with a predetermined gap therebetween. The dry developer contains two kinds of frictionally chargeable dry developer particles having different chargeable polarities and having different optical reflection densities (in other words, providing "different degrees of contrast" or "different colors")

According to the image display medium, an electric field corresponding to the image to be displayed is applied while at least two kinds of dry developer particles are frictionally charged to different polarities, respectively, and thereby the developer particles charged to the respective polarities move in the opposite directions depending on the direction of the electric field within the medium so that an image having contrast is displayed.

The medium of dry chargeable particle containing type may also be as follows:

This reversible image display medium also includes dry developer contained in developer containing cell(s), which is(are) formed between two substrates (at least one having light transparency) opposed to each other with a predetermined gap therebetween. The dry developer contains two kinds of frictionally chargeable dry developer particles having different chargeable polarities and having different optical reflection densities (in other words, providing "different degrees of contrast"0 or "different colors"). At least one kind of the developer particles are magnetic particles.

On this image display medium, the image can be displayed similarly to the foregoing image display medium of the dry chargeable particle containing type. Since at least one kind of the developer particles forming the dry developer are magnetic particles, the developer (developer particles) can be stirred with a magnetic field such as an oscillating magnetic field. This stirring of the developer promotes the movement of the developer particles in the operations of initialization of the medium, erasing (a kind of initialization) of the last image prior to the image formation (image display) and displaying the image in the electric field (electrostatic field) for image display. These can improve the image display.

When using the reversible image display medium of the dry chargeable particle containing type employing the foregoing magnetic particles, the image forming portion for forming the image thereon may be provided with a device for magnetically stirring the dry developer particles when forming the image by the electric field on the reversible image display medium.

The developer particles contained in the cell(s) may have a particle diameter in a range from about 1 $\mu$m to about 100 $\mu$m. The developer particles may be fine particles having such a structure that various kinds of coloring agent, charge control agent and others are dispersed in the binder resin. A third component (particles) such as a fluidity improving agent may be added and mixed.

<Image Display Medium of Electrophoresis Type>

In this medium, a closed space is formed between two substrates opposed to each other with a spacer therebetween, and is filled with display liquid formed of particles having electrophoretic mobility and a dispersion medium having a color different from that of the particles and containing the particles in a dispersed fashion. The image is displayed in the color of the particles or the dispersion medium by applying the electric field corresponding to the image to be displayed and thereby moving the particles in the display liquid.

The display liquid is generally formed of dispersion medium containing isoparaffin or the like, particles of, e.g., titanium dioxide, dye for providing contrast in color with respect to the particles, a dispersion agent such as a surface active agent and additives such as a charge applying agent.

<Image Display Medium of Twist Ball Type>

A typical example is a medium known as gyricon-base electronic paper display. This medium usually has a sheet-like form, and is disclosed in U.S. Pat. Nos. 4,126,854 and 4,143,103, although not restricted thereto. In the medium of twist ball type, two-color spherical members each having an outer surface formed of halves, which are different in color (e.g., white on one of the semi-spherical surfaces, and another color (e.g., black) on the other), are surrounded by liquid, wax or the like, and the spherical members thus surrounded fill cavities in an insulating property holding medium. By applying an external electric field corresponding to the image, the spherical members rotate within the cavities in accordance with their electrical anisotropy so that the image is displayed. The medium may be configured such that the image can be displayed by heating it to a temperature higher than the melting point of wax surrounding the spherical members and by applying an external electric field, and the image can be fixed by cooling it to a temperature not exceeding the wax melting point.

<Reversible Image Display Medium of Magnetic Drive Type>

In the image forming apparatuses, the following reversible image display mediums of the magnetic drive type can be used depending on the structure of the image forming portion.

(a) An image display medium, in which dispersion liquid containing magnetic particles dispersed therein is held in cell(s) formed between two substrates opposed to each other with a predetermined gap therebetween, and the magnetic particles have an optical reflection density different from that of the dispersion liquid.

(b) An image display medium, in which a coating layer of micro-capsules filled with dispersion liquid containing magnetic particles dispersed therein is formed on one side of a substrate, and the magnetic particles in the micro-capsules have an optical reflection density different from that of the dispersion liquid.

Each of these reversible image display mediums allows image display (image writing), image erasing and rewriting of a written image by selecting the electric field or magnetic field, and thereby allows reuse. Accordingly, it is not necessary to abandon the medium which was once used for image display.

All the developer particles in the medium of the dry chargeable particle containing type, the particles or the like having the electrophoretic mobility and arranged in the electrophoretic medium, the spherical particles or the like in the medium of the twist ball type, and the magnetic particles or the like in the medium of the magnetic drive type are confined in the medium, and thus are not consumed. Further, external supply of the developer is not required. Therefore, it is possible to reduce significantly the use of consumable materials such as image display mediums (paper sheets), developer and ink required for image display in the prior art.

Further, each of the reversible image display mediums described above does not require operations such as heating and fixing of toner images, ejecting of ink and thermal transferring of an image from a transfer film in contrast to the conventional image formation on normal paper sheets or the like. This allows significant reduction in image forming energies (particularly, electric power), and allows fast image output.

Owing to the above, the running cost of the image forming apparatus can be low.

Accordingly, it is possible to satisfy current demands for reduction in environmental loads.

Further, each of the foregoing reversible image display mediums can be configured to allow image display with good contrast and high resolution.

Particularly, in the medium of the dry chargeable particle containing type, settling and cohesion of the developer particles are effectively suppressed because no liquid is present between the particles. Therefore, reduction in contrast can be suppressed, and the image display can be performed with stable contrast for a long term. Also, the resolution can be high. Since the image display is performed by applying a voltage to form the electric field while at least two kinds of the developer particles contained in the cell(s) are frictionally charged to have opposite polarities, the particles can move easily, and therefore the drive voltage for the image display can be low.

The image forming apparatuses can employ the following image forming portions for the reversible image display mediums of the electric field drive type and the magnetic field drive type.

<Image Forming Portion for Reversible Image Display Medium of Electric Field Drive Type>

On the reversible image display medium of the electric field drive type, the image can be formed by applying the electric field (electrostatic field), which corresponds to the image to be formed, on the medium. Accordingly, the image forming portion for forming such an electric field (electrostatic field) can be configured to utilize an electrostatic latent image or to utilize a write electrode.

Image Forming Portion Utilizing Electrostatic Latent Image

This image forming portion is configured such that an electrostatic latent image corresponding to the image to be displayed is formed on one (e.g., the substrate on the image observation side) of the two substrates of the medium, or an externally formed electrostatic latent image is brought closer to the medium so that the electrostatic field is formed based on the electrostatic latent image.

The formation of the electrostatic field described above may be performed simultaneously with or after formation of the electrostatic latent image. The electrostatic field may be formed by applying a predetermined potential for formation of the electrostatic field on the substrate opposite to the substrate, on which the electrostatic latent image is to be formed or brought closer. Setting of the predetermined potential can be performed, e.g., by applying a bias to an opposite electrode, which is formed on in advance or is in contact with the opposite substrate, or by grounding the opposite electrode.

The electrostatic latent image may be formed directly on the medium surface (substrate surface), e.g., by a device for directly forming electrostatic latent image, or may be formed by transferring an external electrostatic latent image formed outside the medium by an external electrostatic latent image forming device on the medium surface (substrate surface). The external electrostatic latent image may be brought closer to the medium surface.

The direct electrostatic latent image forming device may be of various discharging types, which are configured to place electrostatic latent image charges by effecting discharging on the medium surface in accordance with the image to be displayed, and also may be of various charge supplying types, which are configured to place electrostatic latent image charges by injecting charges into the medium surface in accordance with the image to be displayed. As examples of the former, a device of an ion-flow type and a device of a multi-stylus type can be employed. The device of the multi-stylus type has an electrostatic record head, in which recording electrodes are arranged in a predetermined direction (e.g., in a main scanning direction for scanning the substrate with the device). As an example of the latter device, a device of a multi-stylus type can be employed, which has an electrostatic recording head, in which recording electrodes are arranged in a predetermined direction (e.g., in a main scanning direction for scanning the substrate with the device), and neighboring control electrodes neighbor to the recording electrodes.

The external electrostatic latent image forming device may be of such a type that an electrostatic latent image corresponding to the image to be displayed is formed on an electrostatic latent image carrier, and the electrostatic latent image on the electrostatic latent image carrier is transferred onto or brought closer to the surface of the medium substrate. More specifically, the electrostatic latent image corresponding to the image to be formed is formed, e.g., on a photoconductive member such as a photosensitive member, and the electrostatic latent image on the photoconductive member is transferred onto or brought closer to the surface of the medium substrate. Alternatively, the electrostatic latent image corresponding to the image to be formed may be formed on a dielectric member, and the electrostatic latent image on the dielectric member may be transferred onto or brought closer to the surface of the medium substrate.

The above external electrostatic latent image forming devices, and particularly the device of forming the electrostatic latent image on the photoconductive member such as a photosensitive member can achieve such an advantage that the photoconductive member and others can be formed of common parts if the image forming portion for the normal image display medium is of the electrophotographic type and employs the photoconductive member such as a photosensitive member.

Image Forming Portion Utilizing Write Electrode

The image forming portion has an image write electrode arranged in contact with or close to the substrate of the image display medium, and applies a bias corresponding to the image to be displayed to the electrode.

For example, the image forming portion may have individual electrodes for respective pixels arranged in contact with or close to one (e.g., the substrate on the image observation side) of the substrates of the image display medium, and opposite electrodes arranged in contact with or close to the other substrate, and may be configured to apply a bias corresponding to the image to be displayed to each of the individual electrodes.

<Image Forming Portion for Reversible Image Display Medium of Magnetic Drive Type>

This image forming portion may have a magnetic head for image writing.

In either of the case where the image forming portion forms the image on the reversible image display medium of the electric field drive type and the case where it forms the image on the reversible image display medium of the magnetic drive type, an image erasing device may be employed for initializing the medium, or performing, as a kind of initialization, erasing of the last displayed image before the image display. A developer stirring device may be employed for initializing the medium, erasing the last displayed image before the image display, or improving the flowability of the developer particles (particularly, improving the flowability of the developer particles in the medium in the case of the dry chargeable particle containing type) for image display. Both the image erasing device and the developer stirring device may be employed.

The image erasing device may be, e.g., an erase electric field forming device for forming an electric field moving the developer particles forming the developer in the image display medium, a stirring device for applying a stirring force to the developer or a device including both of these devices. Application of the stirring force can be performed, e.g., by forming an alternating electric field with respect to the developer, forming an oscillating magnetic field, emitting ultrasonic waves, applying mechanical vibrations or a combination of two or more of them.

The erase electric field forming device may be a device for forming the electric field such that one of the two kinds of developer particles of the same optical reflection density (in other words, the same degree of contrast or the same color) are collected toward one of the substrates, and the other kind of developer particles of the same optical reflection density are collected toward the other substrate. According to this device, initialization of the medium as well as the image erasing can be performed, and further movement of the developer particles is required only in the image portion when forming a new image so that the image display can be performed smoothly and reliably with a high quality.

The erase electric field forming device may include a pair of electrodes or dielectric members arranged on the opposite sides of the reversible image display medium as well as a power supply device for applying a bias voltage thereto.

In addition to the above, the erase electric field forming device may be an electric field forming device of the discharging type for forming an electric field by performing discharging to the image display medium, or an electric field forming device of a charge injecting type for forming the electric field by injecting charges into the image display medium. A corona charging device, an electric field forming device of an ion-flow type and an electric field forming device of a multi-stylus type having a head, in which electrodes are arranged in a predetermined direction, are examples of the former. An electric field forming device of a multi-stylus type having a head, in which electrodes are arranged in a predetermined direction, and neighboring control electrodes are arranged adjacently to the above electrodes, is an example of the latter.

The stirring device may have the following structure.

(1) Device of Forming Alternating Electric Field for Reversible Image Display Medium This device can be utilized in the case where at least one kind of developer particles has an insulating property.

(2) Device of Forming Oscillating Magnetic Field for Reversible Image Display Medium This device can be utilized in the case where at least one kind of the developer particles contain magnetic members.

(3) Device of Emitting Ultrasonic Waves to Reversible Image Display Medium (4) Device of Applying Mechanical Vibrations to Reversible Image Display Medium (5) Device formed of a combination of two or more of the above devices.

Among them, the alternating electric field forming device and the oscillating magnetic field forming device are especially effective.

In the image forming apparatus, the first image forming portion for the normal image display medium and the second image forming portion for the reversible image display medium may be independent of each other, or may be partially common to each other. However, the heads for writing the image on the image display medium may be preferably independent of each other for each control of the heads.

Although the reversible image display mediums, the image forming portions and others have been described, the image forming apparatus may have the following structure as a typical example.

The first image forming portion for forming the image on the normal image display medium is of an electrophotographic type, and is configured to form an electrostatic latent image corresponding to the image to be formed on the electrostatic latent image carrier, develop the electrostatic latent image by the developing device into a toner image, transfer the toner image by the transferring device onto the normal image display medium and fix the toner image by the fixing device.

The second image forming portion for forming the image on the reversible image display medium is configured to form the image on the reversible image display medium of the electric field drive type.

According to the above image forming apparatus, the first and second image forming portions can easily employ many common parts. In this image forming apparatus, the second image forming portion may employ a write head (e.g., ion-flow head) not using an electrostatic latent image carrier, but may be configured such that an electrostatic latent image corresponding to the image to be formed on the electrostatic latent image carrier is formed, the electrostatic latent image is brought closer to or into contact with the surface of the reversible image display medium of the electric field drive type, or is transferred onto the same, and the image formation is performed by forming an electric field corresponding to the image to be displayed on the reversible image display medium based on the electrostatic latent image.

The image forming apparatus may be provided with a switching device for changing, when necessary, the setting of image forming element(s) in the image forming portions for the cases that the state for image formation by the first image forming portion is to be changed to the image formation by the second image forming portion, and vice versa. The switching device may be typically provided in the case where the first and second image forming portions commonly use one or more image forming element(s).

The following examples may be employed for switching the image forming element setting, although depending on the structures of the first and second image forming portions.

For example, the first image forming portion may be an image forming portion of the electrophotographic type, and the following change in setting may be employed for changing the image formation by the first image forming portion to the image formation on the reversible image display medium (e.g., reversible image display medium of the electric field type) by the second image forming portion.

(1) A developing element is controlled.

For example, non-developing setting is achieved by:

moving a developing roller to an escape position, moving a developing device itself to an escape position, stopping driving of the developing roller, stopping driving of the whole developing device, controlling the developing bias, or moving the developer to an escape position (stopping supply of the developer).

From a viewpoint of the type of the developing device, the following many be employed.

In the case of the one-component developing device of a contact type, the developing roller or the developing device may be moved to an escape position.

In the case of the one-component developing device of a non-contact type, the developing roller or the developing device may be moved to an escape position, or the developing roller may be stopped, or the developing bias may be controlled.

In the case of the two-component developing device of a contact type, the developing roller or the developing device may be moved to an escape position, positions of magnetic poles of a magnet member within the developing roller may be changed, or transportation or supply of the developer is stopped.

In the case of the two-component developing device of a non-contact type, the developing roller or the developing device may be moved to an escape position, positions of magnetic poles of a magnet member within the developing roller may be changed, transportation or supply of the developer is stopped, or a developing bias is controlled.

In the case of the one-component developing device of the contact type, rotation of the developing roller may-be stopped by stopping the driving of whole the developing device. Since the developing bias is relatively low in voltage, the control can be performed only by moving the developing roller to the escape position, in which case the control and stop of the developing bias are not essential.

In the case of the one-component developing device of the non-contact type, rotation of the developing roller may be stopped by stopping the driving of whole the developing device. In this developing device, since a high-voltage bias causing flight of the toner without contact is usually applied, the developing bias must be controlled to lower to a level, which does no cause the flight of the toner, or application thereof must be stopped.

In the case of the two-component developing device of the contact type, since the development is performed by the contact of the two-component developer with the photosensitive member, the movement of the developing roller or developing device to the escape position is effective. Usually, the two-component developer formed of toner and magnetic carriers is used, and the developer on the developing roller takes the form of magnetic spikes standing on the magnetic poles of the magnetic member of the developing roller, and the spikes lie down in the portions between the magnetic poles. Generally, in the case of the two-component developer, the magnetic pole (developing magnetic pole) is arranged in the position opposed to the photosensitive member, and the magnetic brush is raised and thereby brought into contact with the photosensitive member for performing the development. Accordingly, by shifting the positions of the magnetic poles so that the portion between the poles may be opposed to the photosensitive member, the magnetic brush lies and is in the non-contact state. In practice, it is effective to rotate the magnetic pole member (e.g., magnetic pole roller) in the developing roller so that the portion between the developing pole and the neighboring magnetic pole may be opposed to the position nearest to the photosensitive member.

Such a manner may also be employed that driving of a transporting member for transporting the developer to the developing roller is stopped, and the developing roller is rotated for a certain time to remove completely the developer from the developing roller.

The two-component developing device of the non-contact type may employ the same structure and manner as those of the two-component developing device of the contact type. In this developing device, however, a high-voltage bias causing flight of the toner without contact is applied so that the control must be performed to lower the developing bias to a level not causing flight of the toner, or stop of the bias application is required.

(2) Control of Charging Element

A surface potential of the photosensitive member may be controlled, e.g., depending on the kind of the reversible image display medium.

(3) Control of Exposing Element

For example, the intensity of the image exposure on the photosensitive member is controlled. Particularly, in the case where the charging element is controlled, the potential on the exposed portion may not be lowered sufficiently due to insufficient amount of exposure. In this case, therefore, the exposing intensity (e.g., an intensity of semiconductor laser for exposure) is increased.

(4) Control of Transfer Element

For example, the transfer bias is controlled. In the case of using the reversible image display medium of the dry chargeable particle containing type containing the foregoing magnetic particles, an oscillating magnetic field may be applied.

For the latter, a magnet roller arranged within the transfer roller is rotated, or a magnetic sheet, in which different magnetic poles parallel to each other are opposed to the medium transportation path, is arranged downstream from the transfer roller.

(6) Control of Cleaner Element

For example, the cleaning member is moved away from the photosensitive member.

(7) Control of Fixing Element

For example, a transportation path not extending through the fixing device is used independently of the transportation path of the normal image display medium, the fixing roller pair is separated, the fixing temperature of the fixing device is lowered (e.g., a heater is turned off), or a fixing pressure of the fixing device is lowered (e.g., to 1.5 kg/cm$^2$ or lower, and more preferably, to about 0.5–1 kg/cm$^2$).

(8) Change of Medium Discharge Tray

Particularly, in the case where the transportation path not extending through the fixing device is employed independently of the transportation path of the normal image display medium, the discharge tray for the normal image display medium may be arranged independently of the discharge tray for the reversible image display medium, whereby it is possible to reduce the possibilities such errors that these two kinds of mediums are mixed, and therefore that the medium types are erroneously detected when using the reversible image display mediums again.

(9) An image writing head for the reversible image display medium is operated.

(10) An image erasing device for the reversible image display medium is operated.

For example, a device for applying an image initializing electric field to the reversible image display medium is operated, or a device for applying an image initializing electric field and a magnetic field to the reversible image display medium is operated.

(11) Two or more of the above are arbitrarily combined.

Then, examples of the image forming apparatus as well as examples of the reversible image display medium will be described with reference to the drawings.

First, some examples of the reversible image display medium will be described.

<Reversible Image Display Medium of Dry Chargeable Particle Containing Type>

Figure 1B:
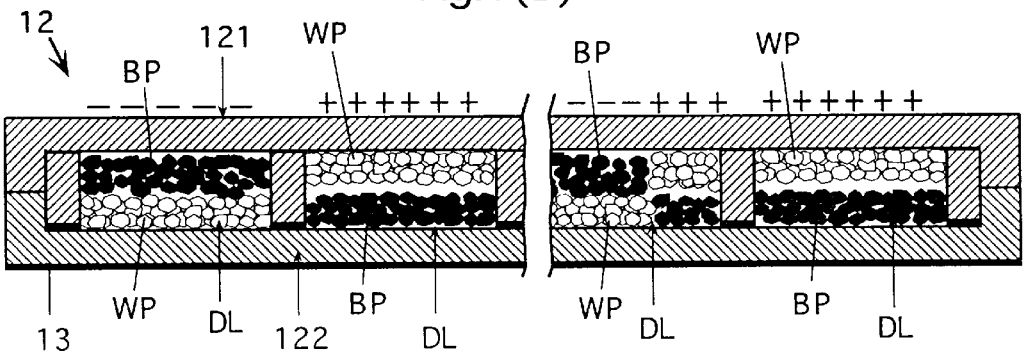
Figure 2:
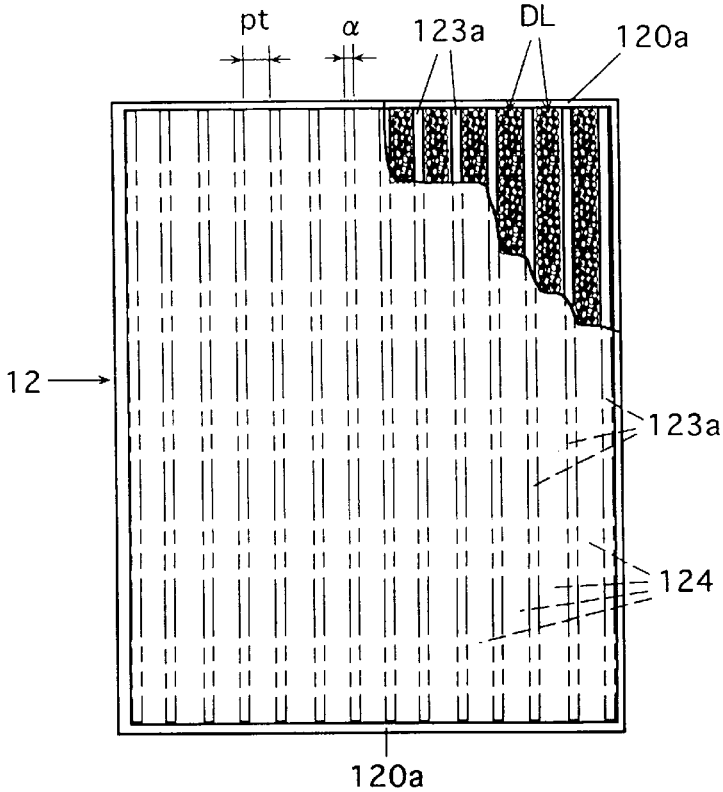
FIG. 2 is a plan showing the image display medium shown in FIG. 1(A) with a certain part cut away.

FIGS. 1(A), 1(B) and 2 show an example of a reversible image display medium of the dry chargeable particle containing type. FIG. 1(A) is a cross section of a reversible image display medium 12 before image display, and FIG. 1(B) is a cross section showing an example during the image display. FIG. 2 is a plan showing the medium 12 with a certain part cut away.

The image display medium 12 shown in these figures has a rectangular configuration, and includes first and second substrates 121 and 122 as well as a partition 123 located between these substrates. The first substrate 121 and the partition 123 are integral with each other, and are formed by thermal molding of transparent polyethylene terephthalate (PET). The second substrate 122 is also made of transparent PET, and has an outer surface coated with a vapor-deposited aluminum layer 13.

The partition 123 is formed of a plurality of longitudinal wall portions 123*a*, which are parallel to the longer side of the medium 12, and a developer accommodating cell 124 is formed by the neighboring wall portions 123*a*. Each cell 124 accommodates developer DL containing white and black developer particles WP and BP, which are mutually and frictionally charged.

The medium 12 is provided at its periphery with a thermally sealed portion 120 formed between the substrates 121 and 122. The seal portion 120 has portions 120*a*, which continue to the opposite ends of the longitudinal wall portions 123*a* and closes the opposite ends of the cells. These portions 120*a* also serve as partitions defining the cells 124.

Each cell is sealed so that developer DL does not leak from the cell.

The partition 123 (wall portions 123*a*) serves also as a spacer keeping a predetermined gap between the substrates 121 and 122.

The substrate 121 has an average thickness of 25 $\mu$m, and the substrate 122 likewise has a thickness of 25 $\mu$m. Each wall portion 123*a* has a width a of 20 $\mu$m and a height h of 100 $\mu$m. and is spaced from the neighboring wall portion by a distance pt of 200 $\mu$m. The developer DL is arranged within each cell 124 to fill 90% of its height before bonding the substrates together, and then a thin layer of photo-setting adhesive 123*b* is applied over top surfaces of the longitudinal walls 123*a* on the substrate 121. The substrate 122 is closely attached thereto, and ultraviolet light is emitted for curing the adhesive. Further, the peripheries of the substrates are thermally sealed.

The developer particles and the developer in the cell are specifically as follows.

White Developer Particles WP

Thermoplastic polyester resin (softening point=121° C., glass transition point=67° C.) in an amount of 100 parts by-weight, titanium oxide (manufactured by Ishihara Sangyo Co., Ltd., CR-50) in an amount of 40 parts by weight, and salicylic acid-zinc complex (minus-charge-controlling agent Bontron E-84, manufactured by Orient Chemical Co., Ltd.,) in an amount of 5 parts by weight were fully mixed by a Henschel mixer. The mixture thus prepared was kneaded by a 2-shaft extruder/kneader, and thereafter was cooled. Thereafter, the mixture was roughly pulverized, and then was finely pulverized by a jet mill. The resulting powder was classified with wind to produce white fine-grained powder having a volume average particle diameter of 10.1 $\mu$m. Thereafter, 0.3 parts by weight of hydrophobic silica particles (Nihon Aerosil Co., Ltd.: Aerosil R-972) is added to the above powder, and the mixing and kneading are performed by a Henschel mixer to produce the white developer particles WP.

Black Developer Particles BP

Styrene-n-butyl-methacrylate resin (softening point=132° C., glass transition point=65° C.) in an amount of 100 weight parts, carbon black (Lion Oil & Fat Co., LTD., Kechenblack EC) in an amount of 4 parts by weight, silica (Nihon Aerosil Co., Ltd.: #200) in an amount of 1.5 parts by weight and magnetite-containing magnetic powder (manufactured by Titan Kogyo Co., LTD., RB-BL) in an amount of 500 parts by weight were fully mixed by a Henschel mixer, and then were kneaded by a kneader and then cooled.

Thereafter, the mixture was roughly pulverized by a feather mill, and then was finely pulverized by a jet mill. The resulting powder was classified with wind to produce black particles BP having a volume average particle diameter of 25 $\mu$m.

Developer DL

The white particles WP and the black particles BP were put into a polyethylene bottle at a rate of 12 grams of the white particles and 88 grams of the black particles. The bottle was rotated by a ball mill pedestal to knead and mix the contents for 30 minutes so that the developer DL was obtained. The white particles were charged negatively, and the black particles were charged positively. The developer thus prepared was used.

The above medium 12 used in the embodiments will be referred to as "medium TP1" hereinafter.

<Reversible Image Display Medium of Electrophoresis Type>

Figure 3:
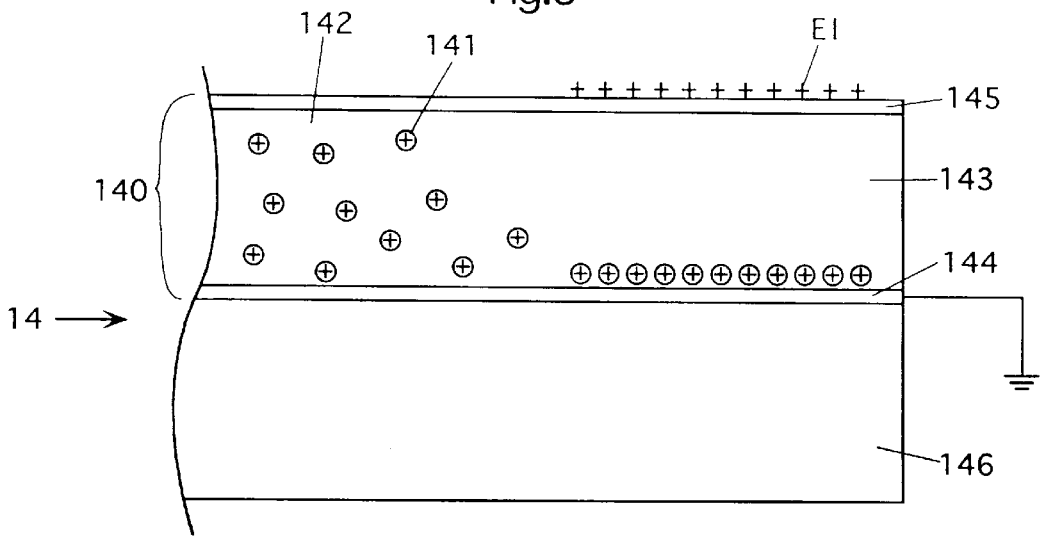
FIG. 3 shows an example of a structure of an image display medium of an electrophoresis type.

FIG. 3 shows an example of a structure of a reversible image display medium 14 of an electrophoresis type.

The medium 14 shown in FIG. 3 includes an electric field coloring layer 140 carried on a ransparent carrier substrate 146. The electric field coloring layer 140 is formed of developer liquid 143, which includes charged and colored particles 141 dispersed in insulating liquid 142, and is sealingly held between a transparent conductive layer 144 and an insulating layer 145. The insulating liquid 142 is a mixture of high-purity petroleum (e.g., Isoper manufactured by Exxon Chemical Co., LTD.) as well as an ionic surface active agent and dyes. The organic particles 141 are mixed in the liquid 142 to complete the developer 143. The ionic surface active agent is adhered onto the organic colored particles 141 containing the pigment so that the particles are charged electrochemically stably. The charged and colored particles 141 are dispersed in the liquid 142 to exhibit an electrophoretic mobility.

When an electric field is not applied to the medium 14, or an electric field opposite to the predetermined electric field is applied to the medium 14, the dyes in the insulating liquid 142 can be externally viewed. When the electrostatic latent image is written, the charged and colored particles 141 move toward the transparent conductive layer 144 so that the colored particles can be externally viewed.

The image is displayed on the medium 14 by forming the electrostatic field corresponding to the image to be displayed with respect to the charged developer particles (charged and colored particles in this example) 14 dispersed in the insulating liquid 142.

Although the example of the structure has been described, the reversible image display medium of the electrophoresis type used in the embodiments is the medium TP2, which is the image display medium 12 shown in FIGS. 1 and 2 in which the developer DL is replaced with the developer 143. The developer 143 includes the charged and colored particles 141 dispersed in the insulating liquid 142, and fills each cell.

Filling each cell with the developer liquid 143 is performed in such a manner that the first and second substrates are bonded together except for a liquid inlet, and the developer liquid 143 is supplied through the inlet into each cell while preventing mixing of air bubbles, and then the heat seal is effected on the inlet.

The developer liquid in each cell of the medium TP2 is specifically as follows:

Black dye (manufactured by BASF AG, Sudan Black X60) in an amount 1 gram was mixed and sufficiently dissolved in 100 ml of isoparaffin hydrocarbon (Isoper G, Exxon Chemical Co., Ltd.) to obtain colored liquid.

To the liquid were added 10 grams of titanium dioxide particles (Ishihara Sangyo Co., Ltd., CR-50) and 70 grams of IP Solvent 1620 solution (manufactured by Idemitsu Petrochemical Co., LTD.) containing 0.5 wt % of Sulfol Ba-30N (Matsumura Oil Research Corp., barium sulfonate). The mixture was subjected to wet grinding treatment in 1/8 GL vessel equipped with a water jacket at cooling temperature of 20° C. and disc revolution of 2000 rpm for 15 hours with use of a sand grinder (Igarashi Kikai Seizo Co., Ltd.) and glass beads of 1 mm diameter as media (150 cc).

The resulting liquid developer having a high concentration (100 parts by weight) was diluted with an addition of 900 parts by weight of IP Solvent 1620, and was subjected to dispersion treatment at 10000 rpm for 5 minutes with use of T.K. Autohomomixer M-type (Tokushu Kika Kogyo Co., Ltd.) to obtain developing liquid used as the developer liquid 143.

The image display medium of the electrophoresis type of this specific example, which may be used in the embodiments, will be referred to as "medium TP2" hereinafter.

<Reversible Image Display Medium of Twist Ball Type>

Figure 4:
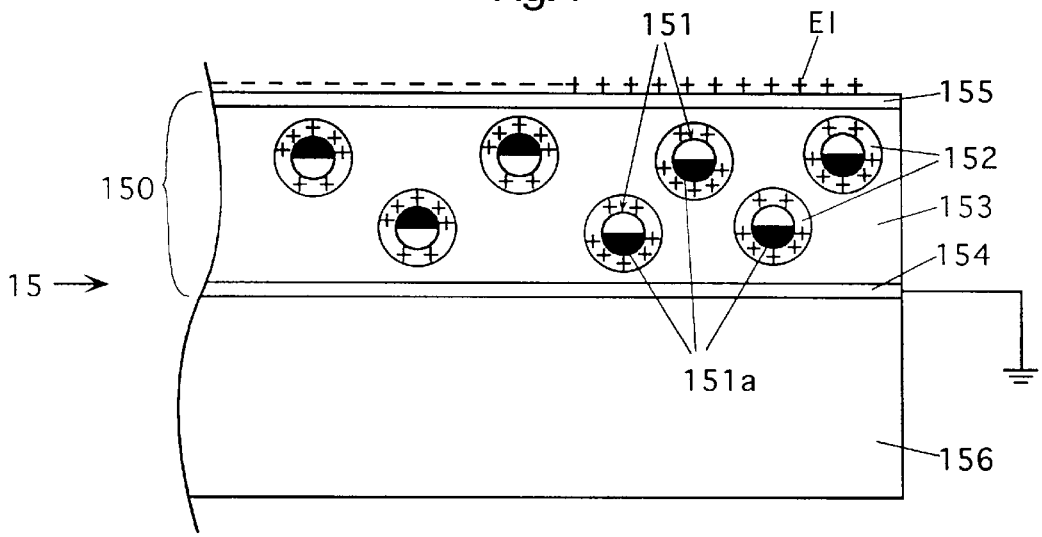
FIG. 4 shows an example of a structure of an image display medium of a twist ball type.

FIG. 4 shows an example of a structure of a reversible image display medium 15 of the twist ball type.

The medium 15 shown in FIG. 4 has an electric field coloring layer 150 carried on a transparent carrier substrate 156. The electric field coloring layer 150 includes one-side colored balls 151 each having a colored portion 151*a* on one side. The balls 151 are surrounded by insulating liquid 152, and are buried together with the liquid 152 in an insulation holding medium material 153. A transparent conductive layer 154 and an insulating layer 155 are formed on the opposite sides of the medium material 153, respectively.

The one-side colored ball 151 is prepared, e.g., in such a manner that white balls of glass primarily made of $TiO_2$ are uniformly arranged on an appropriate table, and chrome or the like is vapor-deposited thereto. The ball 151 may have a size from 30 μm to 100 μm. If it is equal to or smaller than 10 μm, the resolution of the image is further improved.

The one-side colored balls 151 are dispersed in the insulation holding medium material 153 such as elastomer, and the medium material 153 is swelled by immersing it in a solution prepared by dissolving an ionic surface active agent in organic solvent such as toluene. Thereby, the insulating liquid 152 is kept around the one-side colored ball 151. In this manner, the one-side colored ball 151 is surrounded by the insulating liquid layer 152, and is rotatably buried together with the liquid in the insulation holding medium material 153.

The one-side colored ball 151 has one and the other halves, which are different in properties, and therefore are different in amount of absorbable ions. By applying the electric field to the medium 15, the direction of the colored and uncolored surfaces of the one-side colored particle 151 changes depending on the direction of the electric field. Accordingly, the image is displayed by selectively and externally exhibiting the colored and uncolored surfaces of the one-side colored ball 151.

Although an example of the structure has been described, the reversible image display medium of the twist ball type used in the embodiments is manufactured through the following steps. The reversible image display medium of the twist ball type, which may be used in the embodiments and is manufactured through the following steps, will be referred to as "medium TP3" hereinafter.

The medium TP3 employs two-color balls of 17 μm in particle diameter. One of hemispherical halves of its surface is coated with poly (trifluoroethyl methacrylate) and exhibits a white color. The other is blue. The resin used in this example for forming the ball is a polyester resin. A white pigment is titanium ioxide, and a blue pigment is copper phthalocyanine.

First Step: Preparation of Fully White Balls

Fifty grams of sulfonated polyester resin, copolymer of propylene-diethylene-terephthalate and propylene-diethylene-5-sulfoisophthalate were dispersed in 250 grams of water at 60° C. The polyester emulsion thus prepared was then cooled to a room temperature of about 25° C., and 10 grams of aqueous titanium dioxide dispersion (solid rate 50%), which was available from Sun Chemicals Company, was added to the emulsion thus cooled. Aqueous solution of 1 wt. % magnesium chloride (50 ml) was slowly added to the mixture thus prepared, and was uniformly mixed at about 1000 rpm. Thereafter, the mixture was moved into a kettle of one liter. The mixture thus prepared was stirred at 200 rpm and was heated to 55° C. for one night (about 18 hours). In this manner, 50 grams of white mono-color balls, which had a ball diameter 17 μm measured by a Coulter counter and a geometric size distribution of 1.13, were obtained.

Second Step

In the second step, 0.25 grams of ammonium cerium nitrate and 1 milliliter of 1N nitric acid solution were added to 10 grams of white mono-color balls in 100 grams of surface polymerization water. The mixture thus prepared was stirred for 3 hours. Thereafter, the white balls were filtered off, and then were suspended again in 100 milliliters of water. Then, 0.25 grams of potassium persulfate, 0.25 grams of sodium hyposulfite and 0.5 grams of trifluoroethyl acrylate were added thereto. The mixture thus prepared was stirred at a room temperature (about 25° C.) for 3 hours, and the surface grafted mono-color balls thus prepared were filtered off, were rinsed with water and were suspended again in about 1 liter of water.

Third Step: Thermal Vapor-Deposition Coating Using Copper Phthalocyanine of Balls on Glass Using the liquid in which the mono-color chargeable white balls were suspended, a coating layer smaller than about 500 nanometers in thickness (about 400 nanometers in this example) was formed on a glass slide substrate by the Langmuir projet technique. This coating layer was dried in air for about 18 hours. Onto this dry white balls, copper phthalocyanine pigment was vapor-deposited in a vacuum atmosphere of about 0.0001 mmHg–about 0.1 mmHg.

In this manner, the two-color balls of white and blue were obtained. In the two-color ball, the rate of the blue portion was substantially equal to that of the white portion. The phthalocyanine layer of 0.3 μm in thickness hardly affected the diameter of the ball, and the two-color balls thus obtained had the unchanged diameter of about 17 μm. In this medium, the white side of the ball processed with fluoroacrylate and the side coated in blue with the copper phthalocyanine were charged to have different polarities, respectively.

Fourth Step: Manufacturing of Image Display Medium

Fifty grams of the two-color balls thus prepared through the above steps were mixed with 50 grams of Sylgard (registered trademark) 185 silicone elastomer kit, which was available from Dow Corning Corp.

A measuring bar such as 8-path wet film coating device, which was available from P. Gardner Company, and had a gap of about 20 μm to about 500 μm, was used to spread the foregoing mixture over the glass plate surface to form a sheet. The sheet thus formed was heated at a temperature from about 80° C. to about 100° C. for about 3 hours to about 24 hours and thus the SYLGARD elastomer sheet was cross-linked.

Then, the sheet was immersed in appropriate oil such as Isoper or silicone oil of about 50—about 500 milliliters within a container so that the sheet was plasticized, and oil filling holes were formed in the sheet.

Further, the sheet was removed from the oil container, and was sealingly held between Mylar substrates of about 15 μm in thickness. One of the Mylar substrates (the substrate on the rear side) was provided in advance with a conductive layer (e.g., coated with vapor-deposited layer of aluminum).

In this manner, the reversible image display medium (TP3) of the twist ball type was obtained.

<Reversible Image Display Medium of Magnetic Drive Type>

Figure 5:
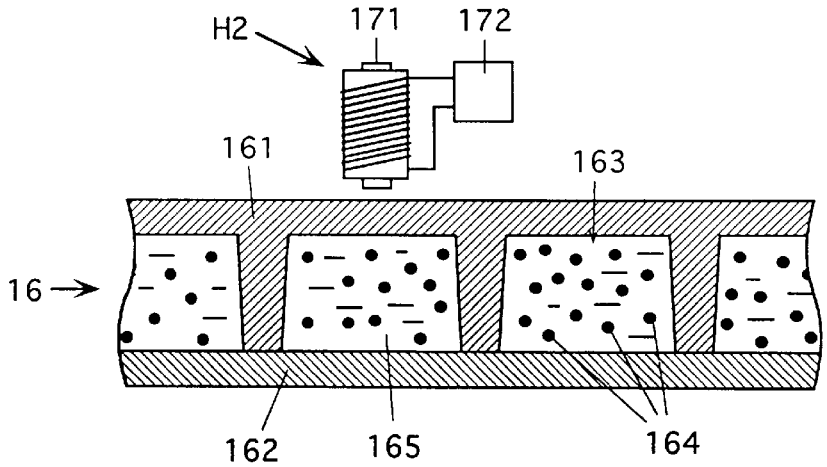
FIG. 5 shows an example of a structure of an image display medium of a magnetic drive type.

FIG. 5 shows by way of example a structure of a reversible image display medium 16 of the magnetic drive type.

The medium 16 shown in FIG. 5 includes light absorbing black magnetic particles 164 and plastic dispersion 165, which contains a dispersion medium, and also contains, if desired, a thickner and a coloring agent. These particles 164 and the dispersion 165 are confined in each of small chambers 163 of the multi-cell structure sheet 160, which are formed by partitioning a space between two substrates 161 and 162. At least one of the two substrates 161 and 162 is transparent.

Instead of the medium of the above structure, the image display medium may have such a structure that the light absorbing black magnetic particles 164 and the plastic dispersion 165 similar to the above are confined in many micro-capsules, and a coating layer of these many micro-capsules is formed on one side of the transparent substrate.

According to these image display mediums, as shown in FIG. 5, a magnetic head H2 is used on the substrate surface of the substrate 161 on the front side (image observation side) to form predetermined magnetic fields for the respective pixels in accordance with the image to be formed. Thereby, magnetic particles 164 are attracted and moved by the magnetic force so that the image is displayed owing to contrast and difference in color between the plastic dispersion 165 and the magnetic particles 164.

The writing magnetic head H2 may have such a structure that includes a group of electromagnets 171, which are arranged for magnetically attracting the magnetic particles 164 within chambers 163 (or micro-capsules in the medium of the micro-capsule type) of the medium 16, toward the front substrate 161, and also includes a DC power source 172 for supplying a DC current to each electromagnet 171.

A coloring agent of the plastic dispersion 165 may be a white pigment or other pigments or dyes. The coloring agent may be added in amount of 10% or less, and preferably 3% or less to the plastic dispersion so that the contrast between the plastic dispersion liquid 165 and the magnetic particles 164 can be increased for clear image display.

The liquid absorbing black magnetic particles 164 are preferably made of magnetic material such as magnetite, ferrite or the like as well as a coloring agent such as carbon black and binder resin, which are kneaded and pulverized into particles having a particle diameter of about 5 μm—about 100 μm.

The light absorbing black magnetic particles 164 are added to the plastic dispersion 165 in amount of 5%–30% by weight, and more preferably, of 10%–20% by weight.

The dispersion medium forming the plastic dispersion 165 may be preferably isoparaffin solvent such as Isoper (manufactured by Exxon Chemical Co., Ltd.), a silicone oil or the like.

The reversible image display medium of the magnetic drive type used in the embodiments may be formed through the following steps. The reversible image display medium of the magnetic drive type, which may be used in the embodiments and is manufactured through the following steps, will be referred to as "medium TP4" hereinafter.

First Step: Manufacturing of plastic dispersion

In this step, 2.5 parts by weight of Bisamide KH (methylene-bis-12-hydroxy-stearic acid amide manufactured by Nippon Kasei Kabushiki Kaisha) was added to 80.8 parts by weight of Isoper M (isoparaffin solvent manufactured by Exxon Chemical Co., Ltd.), and was dissolved by heating them. After cooling the mixture, the dispersion liquid of Bisamide KH was obtained.

This dispersion (82.5 parts by weight) and 1 part by weight of Tipaque CR-50 (titanium dioxide manufactured by Ishihara Sangyo Co., Ltd.) were mixed by the T.K. homomixer (wet dispersing device manufactured by Tokushu Kika Kogyo Co., Ltd.) to produce 83.5 parts by weight of white dispersion.

Thermoplastic polyester resin (softening point=121° C., glass transition point=67° C.) in an amount of 100 parts by weight, carbon black (Lion Oil & Fat Co., LTD., Kechen-black EC) in an amount of 4 parts by weight, silica (Nihon Aerosil Co., Ltd.: #200) in an amount of 1.5 parts by weight and magnetite-containing magnetic powder (manufactured by Titan Kogyo Corp., RB-BL) in an amount of 500 parts by weight were fully mixed by a Henschel mixer, and then were kneaded by a kneader and then cooled.

Thereafter, the mixture was roughly pulverized by a feather mill, and then was finely pulverized by a jet mill. The resulting powder was classified with wind to produce black particles having a volume average particle diameter of 25 μm.

Then, this black magnetic particles were mixed with the white dispersion liquid at a rate of 16.5 parts by weight and 83.5 parts by weight to produce the plastic dispersion of 100 parts by weight.

Second Step: Manufacturing of Medium of Magnetic Drive Type

First, a polyvinyl chloride sheet of about 100 μm in thickness was used as the transparent substrate on the front side (image observation side). This step also used a multi-cell plate. This plate was about 25 μm in thickness, was made of polyvinyl chloride and had a honey-comb structure having substantially hexagonal cells, each of which had a side of about 2 mm and a height of about 300 μm. The multi-cell plate was adhered to the polyvinyl chloride sheet with an ethylene-vinyl acetate type adhesive to provide multi-cell (multi-chamber) structure. Then, each cell (each small chamber) of the multi-cell structure was filled with the plastic dispersion. A transparent polyvinyl chloride sheet of about 100 μm was used as the substrate on the rear side, and was bonded to the multi-cell plate with an epoxy adhesive so that each cell was sealed, and the medium of the magnetic drive type TP4 is manufactured.

Several examples of the image forming apparatus will now be described. In the following description:

the normal image display medium such as a normal paper sheet may be referred to as "medium PP", and the reversible image display medium may be referred to as "medium TP".

The reversible image display mediums of the electric field drive type and the magnetic drive type used in the following examples are the same as those already described.

The reversible image display medium of the dry chargeable particle containing type may be referred to as "medium TP1".

The reversible image display medium of the electrophoresis type may be referred to as "medium TP2".

The reversible image display medium of the twist ball type may be referred to as "medium TP3".

The reversible image display medium of the magnetic drive type may be referred to as "medium TP4".

The image formation mode for the normal image display medium such as normal paper may be referred to as a "PP mode", and the image formation mode for the reversible image display medium may be referred to as a "TP mode".

Figure 6:
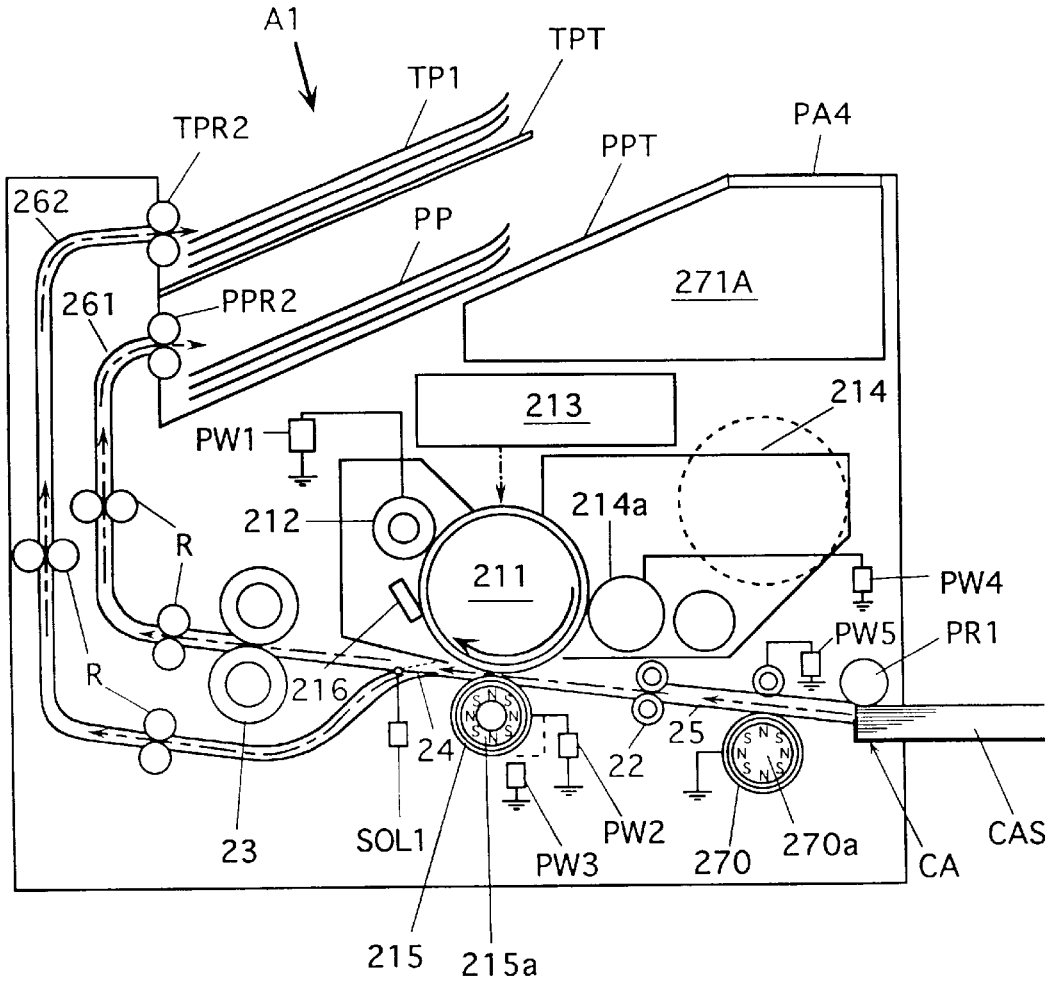
FIG. 6 shows a schematic structure of an example of the image forming apparatus.

<Image Forming Apparatus A1 in FIG. 6>

An image forming apparatus A1 in FIG. 6 has a drum-type photosensitive member 211, and also includes a charger (charging roller in this example) 212, an image exposing device 213, a developing device 214, a transfer device (transfer roller in this example) 215 and a cleaner (cleaning blade in this example) 216.

The developing device 214 is of a one-component developing device of a contact type, has a eveloping roller 214*a*, and accommodates positively chargeable toner. The transfer roller 215 is internally provided with a magnet roller 215*a* to be driven to rotate.

The photosensitive member 211 is driven to rotate clockwise in the figure by a drive device (not shown). The charging roller 212, developing roller 214*a*, transfer roller 215 and magnet roller 215*a* are driven to rotate in predetermined directions, respectively.

A power source PW1 can applies a voltage to the charging roller 212 for charging the photosensitive member. The transfer roller 215 can be selectively connected to power sources PW2 and PW3 in accordance with an instruction sent from a controller 271A, which will be described later. The transfer roller 215 can receive from the power source PW2 a transfer voltage for transferring the toner image on the photosensitive member to the medium PP, and can also receive from the power source PW3 a bias voltage for forming an image on the medium TP. The developing roller 214*a* is supplied with a developing bias from a power source PW4.

The apparatus A1 further includes a timing roller pair 22 located upstream to a nip between the photosensitive member 211 and the transfer roller 215, and further includes an eraser roller pair 270 located upstream to the roller pair 22 as well as one cassette attaching portion CA, which is located upstream to the roller pair 270 for removably attaching a cassette CAS accommodating the image display mediums. The cassette CAS is opposed to a feed roller PR1 for feeding or pulling out the image display medium one by one.

The cassette attaching portion CS is opposed to the medium type detecting device, which will be described later.

The image display medium pulled out from the cassette CAS moves through a medium transportation path 25, and can reach the timing roller pair 22.

The eraser roller pair 270, which is driven to rotate for medium TP, is opposed to the path 25. One of the rollers of the eraser roller pair 270 (upper roller in this example) can be supplied with a bias for image erasing from a power source PW5. The other roller (lower roller in this example) is grounded. At least one of the rollers of the roller pair 270 (lower roller in this example) is internally provided with a magnet roller 270*a* to be driven to rotate.

The apparatus A1 further includes a switching member (claw) 24, which is located downstream to the nip between the photosensitive member 211 and the transfer roller 215, and is driven by a solenoid SOL1 for switching the medium transporting path.

From the claw 24, a transportation path 261 for medium PP extends through the fixing roller pair 23 and a discharge roller pair PPR2 to a discharge tray PPT, and another transportation path 262 for medium TP also extends through the discharge roller pair TPR2 to the discharge tray TPT without passing through the fixing device 23. The transportation paths 261 and 262 are provided at appropriate positions with medium guide roller pairs R.

Above the image exposing device 213, a controller 271A for controlling the operation of the whole apparatus is arranged, and is connected to a control panel PA4.

Figure 7A:
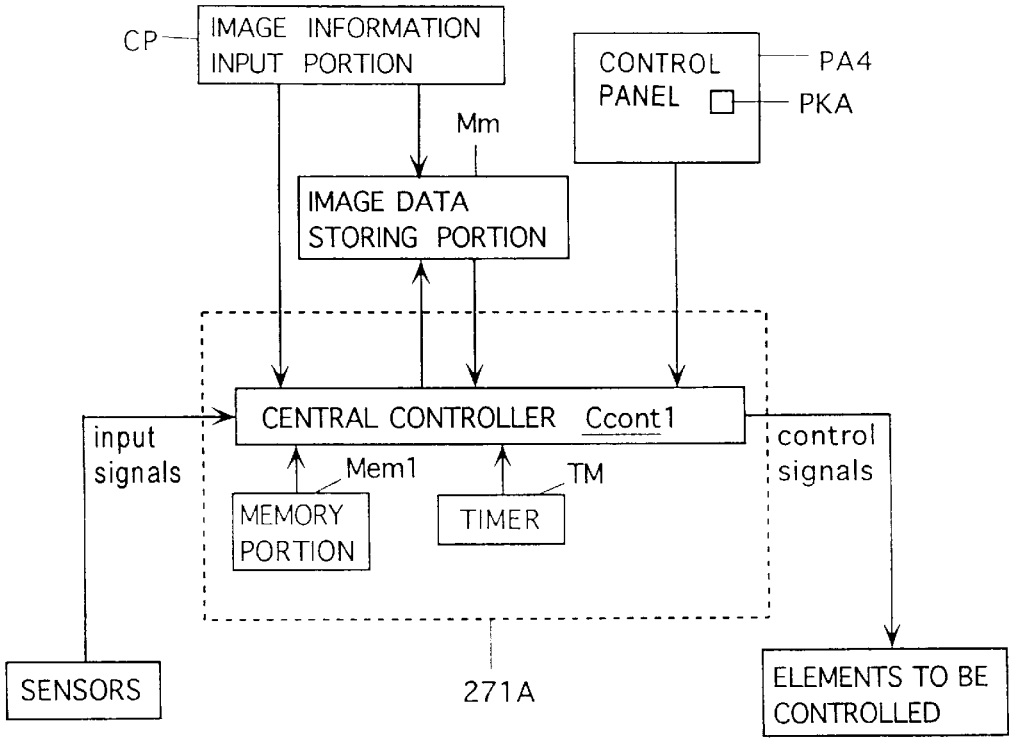
FIG. 7(A) is a block diagram schematically showing a control circuit of the apparatus shown in FIG. 6.

FIG. 7(A) is a block diagram schematically showing a control circuit of the apparatus A1.

As shown in FIG. 7(A), a controller 271A in the apparatus A1 includes a central controller Ccont1, and also includes a memory portion Mem1, which is connected to the central controller, and stores programs for apparatus operation control and various setting data required for executing the programs, and an internal timer TM for determining timing for operations of various elements, and others.

Figure 24A:
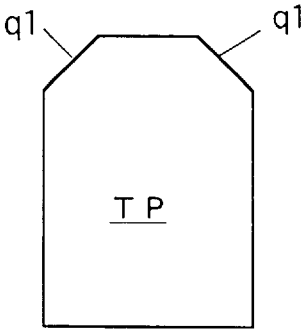
FIG. 24(A)–FIG. 24(C) show an example of a medium type detecting device.
Figure 24B:
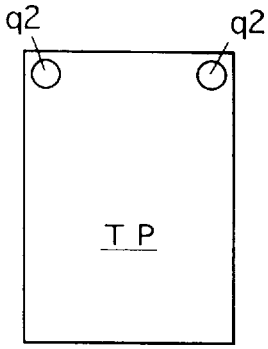
Figure 24C:
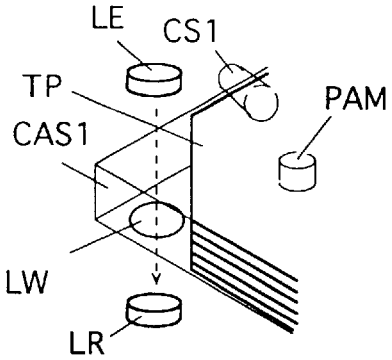

The central controller Ccont1 receives information through input ports (not shown) from a fore-regist sensor, a temperature detecting sensor in the fixing roller pair 23, a medium presence detecting sensor PAM (see FIGS. 24(A)–24(C)) for the medium supply cassette and other various sensors or the like. The central controller Ccont1 is connected to an image data storing portion Mm, the control panel PA4 and other various elements to be controlled.

The image data storing portion Mm is provided for temporarily storing the image data sent from an external image information input portion CP such as a computer or a facsimile machine.

The various elements to be controlled may be:

the rotary drive portion of the photosensitive member 211, the rotary drive portion of the charging roller 212 and the power source PW1 connected thereto, the image exposing device 213, the drive portion of the developing device 214 and a developing bias power source PW4, the drive portion of the transfer roller 215 and the power source PW2 connected thereto, the magnet roller 215*a*, the drive portion of the medium feed roller PR1, the drive portion of the eraser roller pair 270 and a power source PW5, the drive solenoid SOL1 for the switching claw 24, the drive portions of the discharge rollers PPR2 and TPR2, and portions relating to the above.

The control panel PA4 is provided with a key PKA for instructing start of the image formation as well as others.

The personal computer, facsimile machine and others as well as devices connected to various communication network have image information input portions CP, which can send the image output command to the central controller Ccont1, and can transfer the image data to the image data storing portion Mm for temporary storage.

The image data stored in the image data storing portion Mm disappears when a predetermined time elapses, or when it is read out for the image formation on the predetermined image display medium(s) PP and/or TP.

In this image forming apparatus A1, the image output instruction is initially sent from the image information input portion CP to the central controller Ccont1.

In response to this image output command, the image data storing portion Mm temporarily stores the image data transferred from the image information input portion CP.

The central controller Ccont1 has a function of forming a converted image data for the medium TP from the data stored in the image data storing portion Mm. In this case, the central controller Ccont1 forms, e.g., the converted image data of 300 dpi from the image data of 600 dpi stored in the storing portion Mm. With this converted image data, the image can be formed on the medium TP. The image formation on the medium PP can be performed with the image data itself, which is stored in the image data storing portion Mm.

The image data storing portion Mm has a capacity capable of storing the image data of multiple pages. The storing and erasing of the image information for each page are performed independently of the other pages, but may be performed in batches of the print job. Similarly, the image output on the mediums PP is performed page by page, but may be performed in batches of print job.

The apparatus forms the image data for the TP mode by reducing the resolution from the original value. However, the image data conversion for the TP mode is not restricted to this.

For example, if the image data sent from the image information input portion CP has a resolution of 1200 dpi, and the solid portion thereof has an image density of 100%, the PP mode may be executed by forming image in accordance with the image data, and the TP mode may be executed to form the image on the medium TP in accordance with converted data, which is prepared by conversion and has a resolution of 300 dpi and a solid portion of the image density of 70%.

If the color image data is sent from the image information input portion CP, this may be converted into monochrome image data, and further, if necessary, the tone level may be significantly reduced for forming the image on the medium TP.

The image data storing portion is not essential. On either of the mediums PP and TP, the image formation may be effected by the controller based on the transferred image data. In the structure provided with the image data storing portion, the image information on either of the mediums PP and TP may be performed in accordance with the image data, which is temporarily stored in the image data storing portion (without converting the image data even if the image is to be formed on the medium TP). In any one of the above cases, such a structure may be employed that the image data storing portion is employed for temporarily storing the image data transferred thereto, and the image can be formed on either the mediums PP and TP based on the stored image data, whereby it is not necessary to transfer the image data upon every change in medium type. This achieves easy and convenient use.

In this example, the image forming elements are set to the standard state when the apparatus is in the initial state after the power-on, and thereby are set to the state for using the PP mode as a standard mode (from another viewpoint, the mode selected by the operator), and thereby forming the image on the medium PP.

The switching from the standard state setting to the non-standard state setting is performed in accordance with the instruction of the controller 271A when the medium type detecting device (to be described later) detects the image display medium not corresponding to the standard mode.

The image forming apparatus A1 includes, as the medium type detecting device, one of devices shown in FIGS. 24(A)–27(B). The image display medium corresponding to the standard mode (or the mode selected and designated by the operator) may be either the medium PP or TP. Likewise, the image display medium corresponding to the non-standard mode may be either the medium TP or PP. In the following description of the medium type detecting device, the medium PP is used as the medium corresponding to the standard mode (or the medium selected and designated by the operator), and the medium TP is used as the medium corresponding to the non-standard mode.

The medium type detecting device shown in FIGS. 24(A)–24(C) includes a cassette CAS1, which is provided at a comer of its bottom with a light transmission window LW, and can accommodate either of the mediums PP and the mediums TP as well as a light emitting element LE and a light receiving element LR, which are located above and below the light transmitting window LW when the cassette is attached to the image forming apparatus body.

This cassette can accommodate the mediums TP, each of which has cut corners q1 as shown in FIG. 24(A), or is provided at its corners with through holes q2 as shown in 24(B). Thereby, the cut corner q1 or the through hole q2 of the medium is opposed to the light emitting and receiving elements, and the light receiving element LR detects the light emitted from the light emitting element LE so that it is possible to determine that the accommodated medium is the medium TP.

When the cassette CAS1 attached to the apparatus body accommodates the mediums PP, each of which has neither a cut corner nor a through hole, the light receiving element LR cannot detect the light emitted from the light emitting element LE so that the medium PP can be detected.

A cassette sensor CS1 for detecting presence of the cassette is arranged in the cassette attaching portion of the image forming apparatus body, and a sensor PAM for detecting the presence of the image display medium in the attached cassette is also arranged in the cassette attaching portion. This structure is also employed in the structure employing the medium type detecting device, which will be described later.

The medium type detecting device shown in FIGS. 25(A)–25(D) includes the light emitting and receiving elements LE and LR, or further includes the light emitting and receiving elements LE' and LR'. When the cassette CAS2 capable of accommodating either the mediums PP or the mediums TP is attached to the image forming apparatus body, the light emitting and receiving elements LE and LR, or the further light emitting and receiving elements LE' and LR' are opposed to the mediums accommodated in the cassette.

Figure 25A:
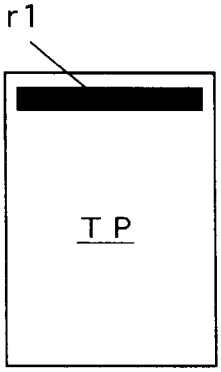
FIGS. 25(A)–25(D) show another example of the medium type detecting device.
Figure 25B:
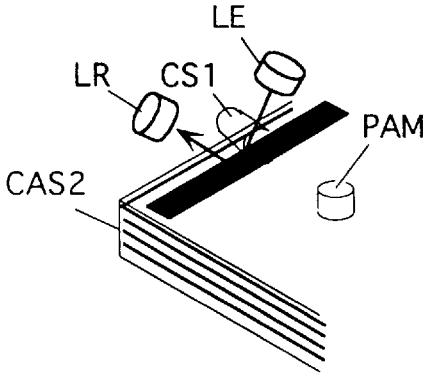
Figure 25C:
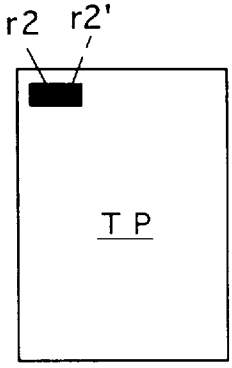

The cassette attached to the apparatus body may accommodate the medium TP provided at its end with a light reflection surface r1 as shown in FIG. 25(A), or may accommodate the medium TP provided on the front side of its end with a light reflection surface r2 indicating the front side as shown in FIG. 25(C). In this state, the light emitted from the light emitting element LE is reflected by the reflection surface r1 or r2, and is received by the light receiving element LR. Thereby, the mediums TP are detected. In the cases shown in FIGS. 25(C) and 25(D), the fact that the front side of the medium TP can be detected.

Figure 25D:
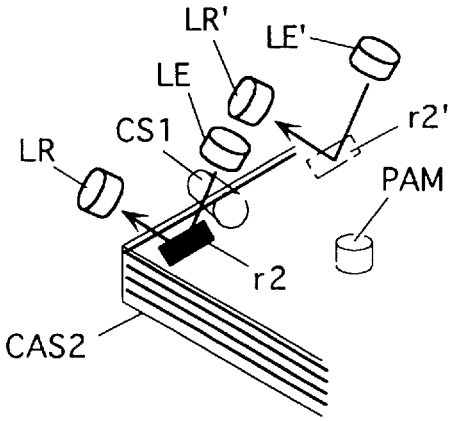

In the case shown in FIGS. 25(C) and 25(D), when the medium TP is located upside down within the cassette, a light reflection surface r2' on the rear surface of the medium TP is detected by the light emitting and receiving elements LE' and LR' so that the medium TP is detected, and the fact that the rear surface is faced upward can be detected.

When the cassette accommodating the medium, which is not provided with any one of the reflection surfaces r1, r2 and r2', attached to the apparatus body, the light receiving elements LR and LR' cannot detect the light coming from the light emitting elements LE and LE', or can detect only an excessively small amount of light so that the medium PP can be detected.

The medium type detecting device described above can detect both the medium PP and the medium TP, which are accommodated in the same cassette CAS2 in a mixed fashion.

Instead of the light reflection surfaces r1, r2 and r2', the mediums PP and TP may be configured to have different electrostatic capacitances, surface resistance values, magnetic intensities or the like, which can be detected for determining the mediums PP and TP.

Figure 26A:
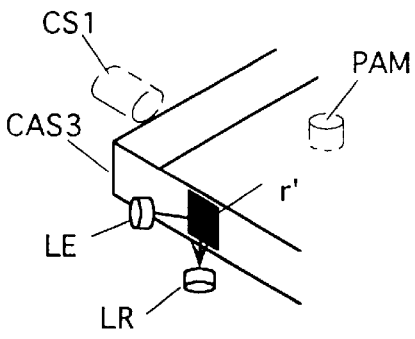
FIGS. 26(A) and 26(B) show still another example of the medium type detecting device.
Figure 26B:
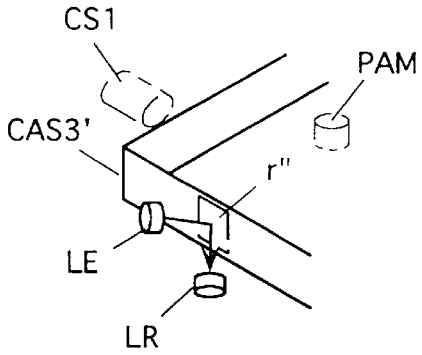

A medium type detecting device shown in FIGS. 26(A) and 26(B) includes a cassette CAS3 provided for accommodating the medium TP and having a high reflection density surface r' on its side surface as shown in FIG. 26(A), a cassette CAS3' provided for accommodating the medium PP and having a low reflection density surface r" on its surface as shown in FIG. 26(B), a cassette sensor CS1 for detecting the fact that the cassette is attached to the apparatus body, and the light emitting and receiving elements LE and LR opposed to the reflection surface r' or r" of the attached cassette.

When the cassette CAS3 is attached, the cassette sensor CS1 detects it, and the light emitting and receiving elements LE and LR detect the high reflection density surface r' so that the medium TP is detected.

When the cassette CAS3' is attached, the cassette sensor CS1 detects it, and the light emitting and receiving elements LE and LR detect the low reflection density surface r" so that the medium PP is detected.

The reflection surface r' may be a low reflection density surface, and the reflection surface r" may be a high reflection density surface.

Figure 27A:
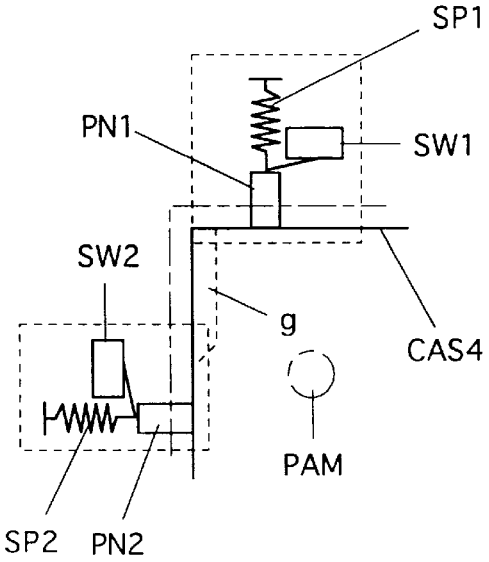
FIGS. 27(A) and 27(B) show further another example of the medium type detecting device.
Figure 27B:
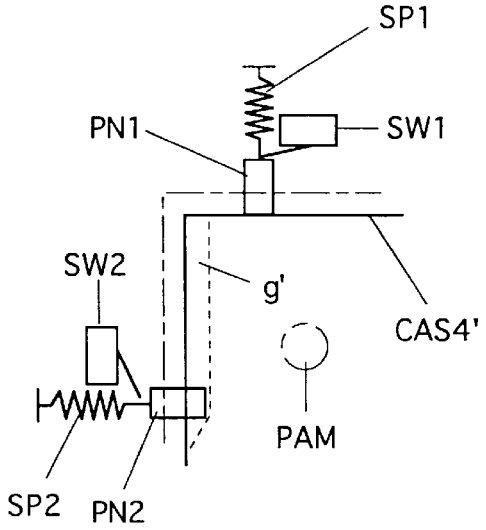

A medium type detecting device shown in FIGS. 27(A) and 27(B) includes two sets of sensors, which are arranged on the cassette attaching portions of the image forming apparatus body, and more specifically includes:

a sensor formed of a pin PN1, which can be pushed by a front end surface of the cassette while it is being attached, and thereby is retreated against a spring SP1, and a switch SW1 activated by the retreating pin, and a sensor formed of a pin PN2 which is fitted to a groove g arranged on the side surface of the cassette while it is being attached, is pushed back against a spring SP2 to activate the switch SW2 by the side portion of the cassette not provided with the groove g if the groove g is short because it is formed in the cassette CAS4 accommodating the medium TP, and does not move backward from the position fitted into a long groove g' arranged in the cassette CAS4' for accommodating the medium PP.

When both the switches SW1 and SW2 are activated, it is determined that the mediums TP are to be handled. When only the switch SW1 is activated, it is determined that the mediums PP are to be handled.

The switching setting of the image forming element(s) will now be described.

In this image forming apparatus, the switching setting of the element(s) is performed as follows. In the following description, the PP mode for image formation is handled as the standard mode (or, from another viewpoint, the mode selected by the operator), and the TP mode of image formation is handled as the non-standard mode. If the TP mode for image formation is handled as the standard mode, and the PP mode for the image formation is handled as the non-standard mode, the standard mode described below is deemed as the non-standard mode, and the non-standard mode described below is deemed as the standard mode.

<Eraser Roller Pair 270>

Standard mode: Bias application by the power source PW5 stops, and rotation of the magnet roller 270*a* stops.

Non-standard mode: The power source PW5 applies the bias, and the magnet roller 270*a* rotates.

<Developing Device 214>

Standard mode: The developing device is located in the developing position, and is driven. The power source PW4 applies the developing bias.

Non-standard mode: The developing device is in the escape position, and stops. The developing bias is not applied.

<Transfer Roller 215>

Standard mode: The power source PW2 applies the transfer bias, and the magnet roller 215*a* stops rotation.

Non-standard mode: The power source PW3 applies the bias, and the magnet roller 215*a* rotates.

<Cleaning Blade 216>

Standard mode: The blade is in contact with the photosensitive member 211.

Non-standard mode: The blade 216 is spaced from the photosensitive member 211 (so that the wearing of the photosensitive member can be suppressed).

<Switching Claw 24>

Standard mode: The claw is located to send the medium PP to the fixing device 23.

Non-standard mode: The claw 24 is located so that the medium TP detours the fixing device 23.

<Fixing Device 23>

Standard mode: The fixing device 23 is driven.

Non-standard mode: The fixing device 23 stops.

<Discharge Roller Pairs PPR2 and TPR2>

Standard mode: The discharge roller pair PPR2 is driven.

Non-standard mode: The discharge roller pair TPR2 is driven.

Figure 28A:
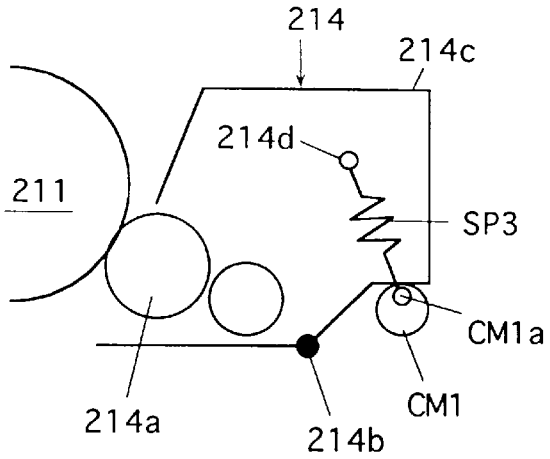
FIGS. 28(A) and 28(B) show an example of a drive mechanism for switching a developing device between a developing state and a non-developing state.
Figure 28B:
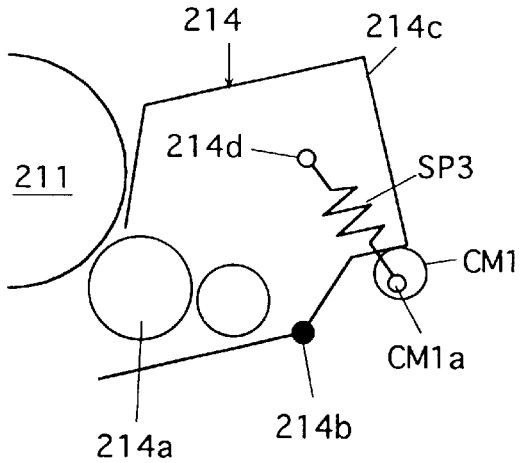

The escape of the developing device 214 from the developing position is performed by a developing device drive mechanism including a cam mechanism as shown in FIGS. 28(A) and 28(B). In this drive mechanism, a developing device casing 214*c* is rotatably supported on a support shaft 214*b*, an eccentric cam CM1 is in contact with the rear bottom of the casing 214*c*, and an extensible spring SP3 is arranged between the shaft 214*b* on the casing and an eccentric cam shaft CM1*a*. A drive motor (not shown) rotates the eccentric cam CM1 against the spring SP3 so that the whole developing device can be rotated from the developing position shown in FIG. 28(A) to the escape position shown in FIG. 28(B).

Although not shown, the developing device 214 may be linearly movable toward and away from the photosensitive member 211, and a drive mechanism including a cam mechanism may be configured to locate the developing device in the developing position and the escape position. Instead of the drive mechanism including the cam mechanism, a drive mechanism including a solenoid or another drive mechanism may be employed.

Figure 29A:
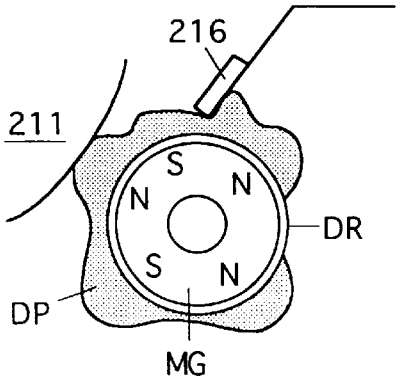
FIGS. 29(A) and 29(B) show an example of switching a two-component developing device between the developing state and the non-developing state.
Figure 29B:
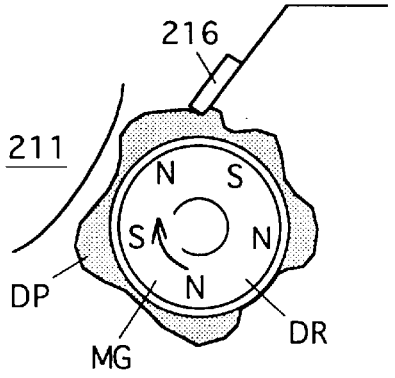

The setting of the developing device can be switched between the standard state setting and the non-standard state setting in various manners depending on the type of the developing device and others, as already described. For example, in the case of the two-component developing device of the contact type, the setting can be switched between a developing device operating setting and a non-developing setting. In the operating setting (developing setting), one of the magnetic poles (N-type pole in an examples shown in FIG. 29(A)) of the magnetic roller MG in the developing roller DR is directed toward the developing region as shown in FIG. 29(A), and the magnetic spike of the developer DP stands and is in contact with the photosensitive member 211 in the developing region. In the non-developing setting, the magnet roller MG is slightly rotated to locate the portion between the N- and S-type poles in a position opposed to the developing region, and thereby the magnetic spike is laid down and is spaced from the photosensitive member 211 in the developing region as shown in FIG. 29(B).

Figure 30A:
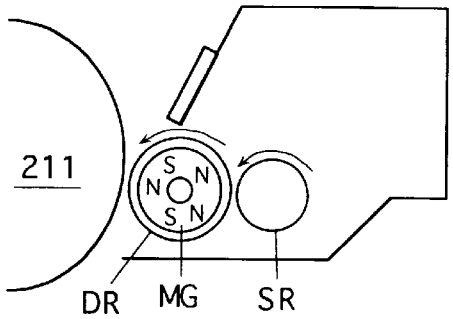
FIGS. 30(A) and 30(B) show another example of switching the two-component developing device between the developing state and the non-developing state.
Figure 30B:
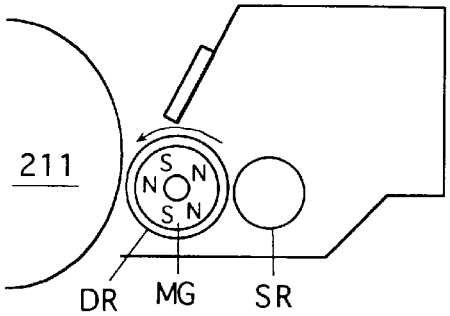

As shown in FIG. 30(A), the setting may be switched between the developing device operation setting, in which the rotating developer supply roller SR can supply the developer to the developing roller DR for supplying the developer to the developing region as shown in FIG. 30(A), and the non-developing setting, in which only the developing roller DR is rotated to remove the developer DP from the developing roller after stopping the supply roller SR, and then the developing roller is stopped as shown in FIG. 30(B).

Figure 31A:
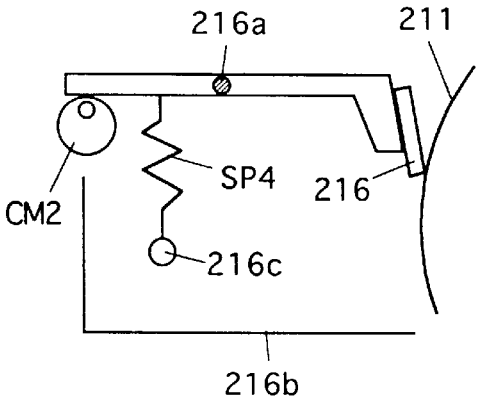
FIGS. 31(A) and 31(B) show an example of a drive mechanism for switching a cleaning blade between a cleaning state and a non-cleaning state.
Figure 31B:
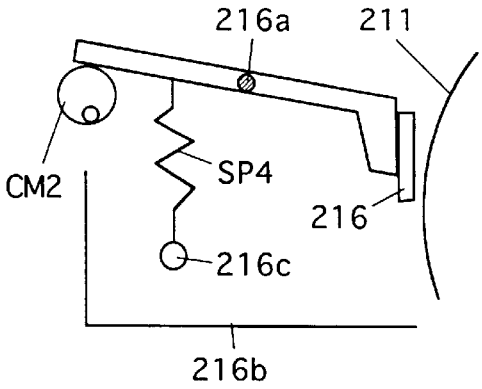

The escape of the cleaning blade 216 from the photosensitive member 211 is performed by a blade drive mechanism including a cam mechanism, as shown in FIGS. 31(A) and 31(B). In this drive mechanism, the blade 216 is supported by a support shaft 216*a* for rotation with respect to a blade casing 216*b*, an eccentric cam CM2 is in contact with a rear end of the blade 216, and an extensible spring SP4 is arranged between the support shaft 216*a* and a shaft 216*c* on the casing. A drive motor (not shown) rotates the eccentric cam CM2 against the spring SP4, whereby the blade 216 can be rotated from the photosensitive member contact position shown in FIG. 31(A) to the escape position shown in FIG. 31(B).

Instead of the drive mechanism including the cam mechanism, a drive mechanism including a solenoid or another drive mechanism may be employed.

The position change of the switching claw 24 is performed by the solenoid SOLL.

In the image forming apparatus A1 described above, the PP mode for image formation is set as the standard mode.

Each image element is set to the standard state for forming the image on the medium PP under the control of the controller 271A.

Figure 7B:
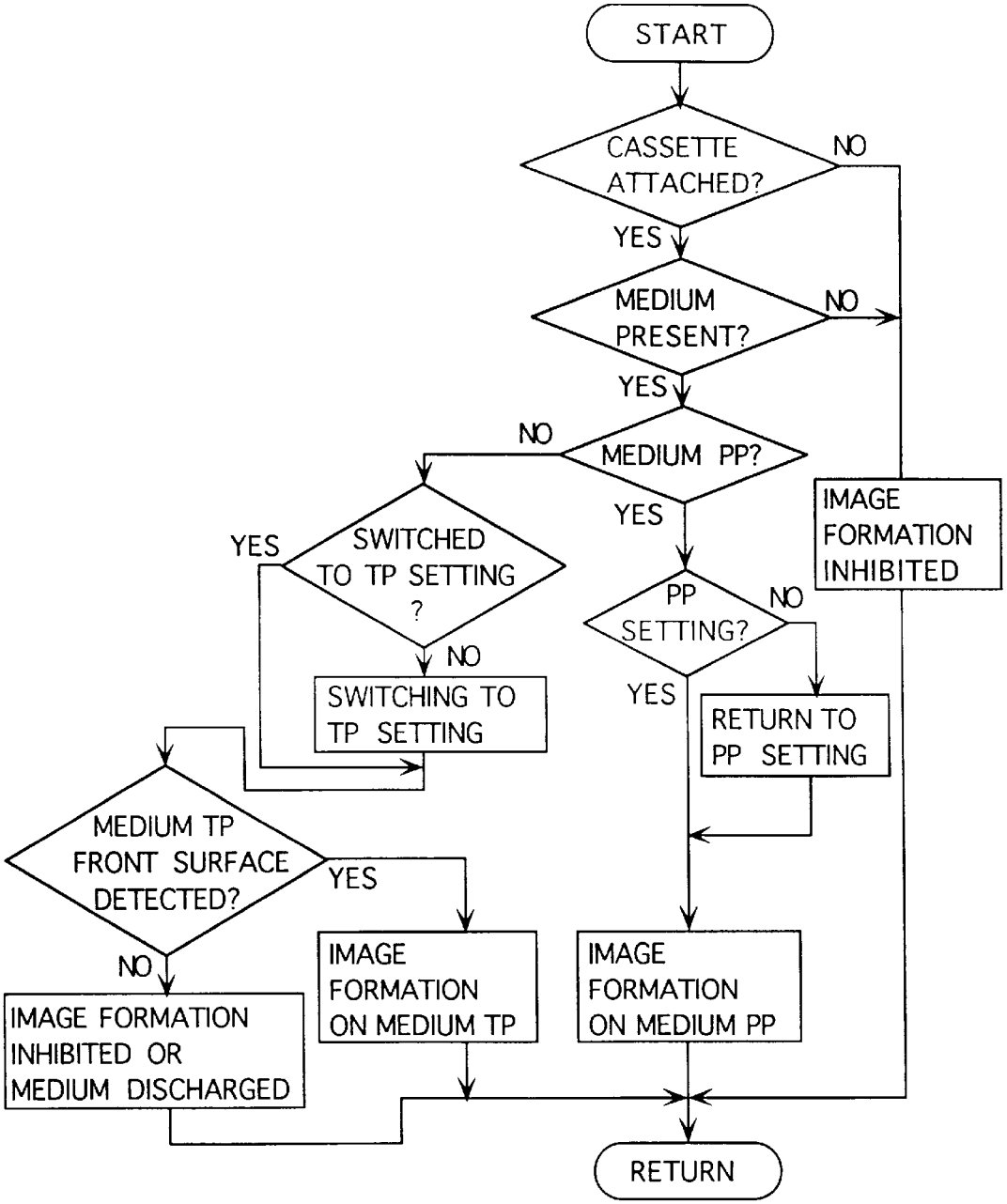
FIG. 7(B) is a flowchart showing operations of a controller shown in FIG. 7(A)

FIG. 7(B) is a flow chart schematically showing a portion of the control of the controller 271A.

Referring to FIG. 7(A), the image formation starts when the print start instruction key PKA is depressed (or in accordance with the print start instruction sent from the image information input portion CP in the on-line state or the like). If the cassette CAS is attached to the cassette attaching portion CA, and the medium PP is present in the cassette, the medium type detecting device detects the medium PP so that the standard state setting of the image forming elements is maintained. The cassette CAS1 or CAS2, which can accommodate either the mediums PP or TP as already described in connection with the medium type detecting device, is used as the cassette CAS for accommodating the medium PP, or the CAS3' or CAS4' dedicated to the medium PP is used as the cassette CAS.

After the confirmation of the standard state setting (PP setting), or after the return to the PP setting from the non-standard state setting (TP setting), which was caused due to the mixing medium TP in the last image formation, the medium supply roller PR1 opposed to the cassette CAS, the timing roller pair 22, the photosensitive member 211, the charging roller 212 connected to the power source PW1, the image exposing device 213, the developing roller 214*a*, the transfer roller 215 connected to the power source PW2, the fixing roller pair 23 and the discharge roller pair PPR2 operate in accordance with predetermined timing under the control of the controller 271A so that the image is formed on the medium PP in the PP mode, and the medium PP is discharged onto the tray PPT. Thereafter, the processing returns to the main routine of the control operation. In this PP mode, the switching claw 24 is located to guide the medium PP to the medium transportation path 261. These form the image forming portion for the medium PP.

When the cassette CAS1 or CAS2 is used in the PP mode, the medium TP may be mixed therein. In this case, the medium type detecting device detects it. Thereby, the image forming elements are switched from the PP setting to the TP setting, and the image is formed on the medium TP, if the front surface thereof is faced upward correctly. If it is upside down, the image formation is inhibited (or the medium is discharged without the image formation).

When the cassette CAS1 or CAS2 accommodating the medium TP as already described in connection with the medium type detecting device is attached to the cassette attaching portion CA as the cassette CAS, or the cassette CAS3 or CAS4 accommodating the medium TP is attached to the cassette attaching portion CA, the medium type detecting device detects the medium TP so that the standard state setting (PP setting) of the image forming elements is changed to the non-standard state setting (TP setting) under the control of the controller 271A.

In this state, when the print start instruction key PKA on the control panel PA4 is depressed (or the image information input portion CP sends the print start instruction in the on-line state or the like), and if the medium formation is to be effected on the medium TP, and the medium TP is faced correctly, the medium supply roller PR1 opposed to the cassette CAS, the eraser roller pair 270 connected to the power source PW5, the magnet roller 270*a*, the timing roller pair 22, the photosensitive member 211, the charging roller 212 connected to the power source PW1, the image exposing device 213, the transfer roller 215 receiving the image writing bias voltage from the power source PW3, and the discharging roller pair TPR2 operate in accordance with predetermined timing under the control of the controller 271A so that the image is formed on the medium TP in the TP mode, and the medium TP is discharged onto the tray TPT. Thereafter, the processing returns to the main routine of the control operation. In this TP mode, the switching claw 24 is located to guide the medium TP to the bypass 262. These form the image forming portion for the medium TP. When the medium TP is upside down, the image formation on the medium TP is inhibited (or, the medium TP is discharged without the image formation).

When the medium PP is mixed in the mediums TP, the medium PP is detected, and the PP setting is restored so that the image is formed on the medium PP.

When the cassette is not attached, or when the medium is not present in the attached cassette, the image output is inhibited. When the cassette is removed, the standard state (PP setting) can be selected.

Figure 8A:
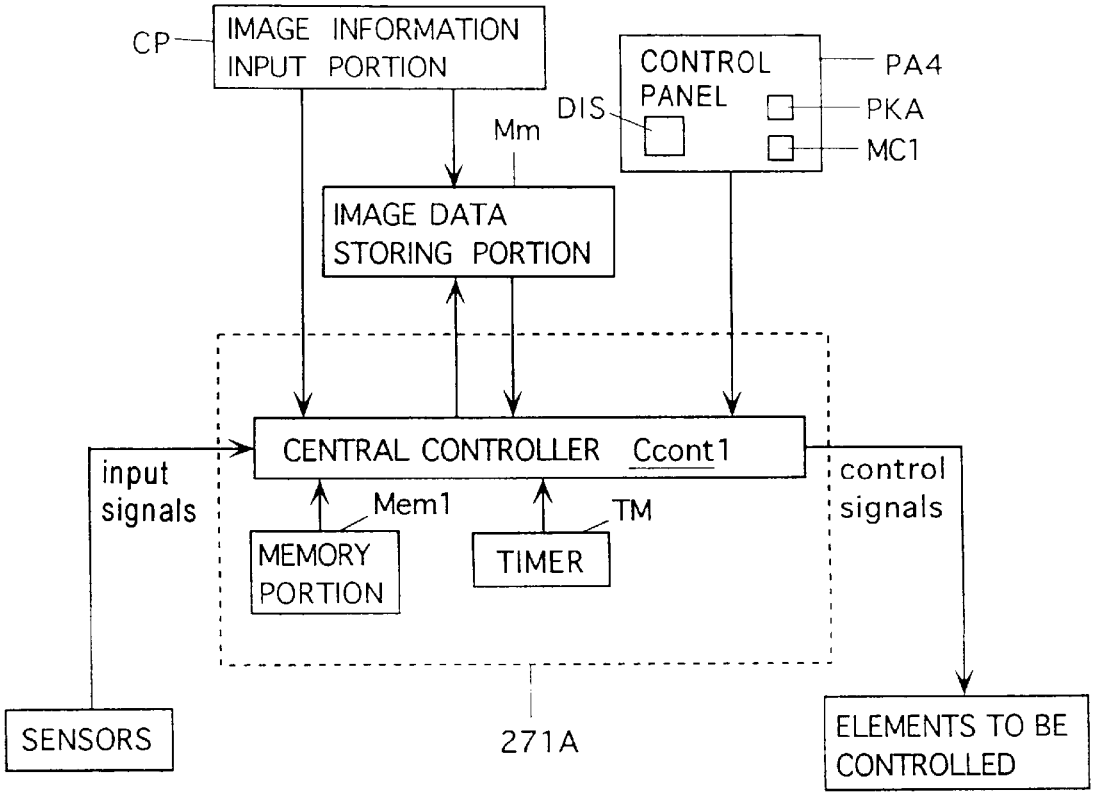
FIG. 8(A) is a block diagram schematically showing another example of the controller in the apparatus shown in FIG. 6.
Figure 8B:
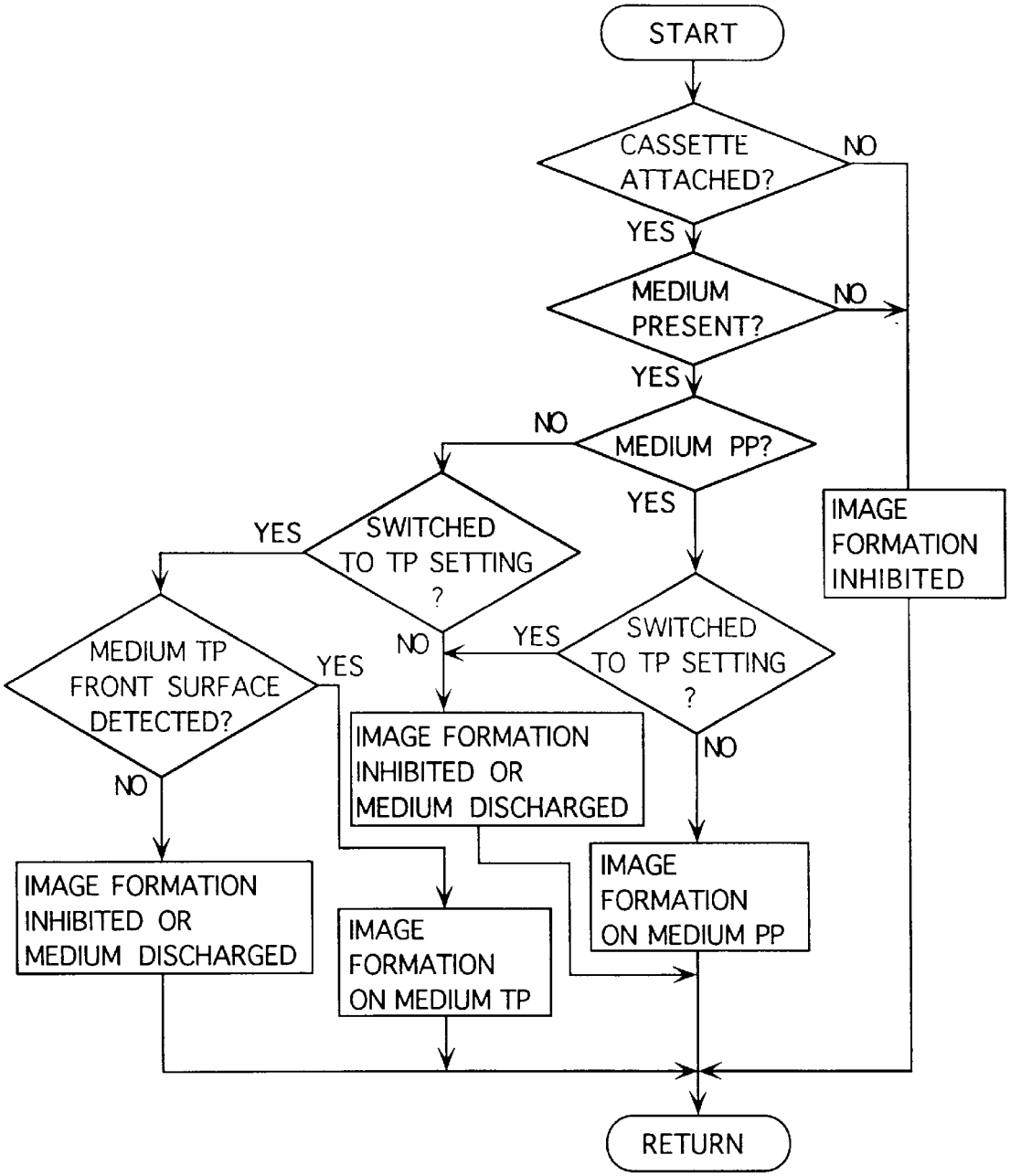
FIG. 8(B) is a flowchart showing operations of the controller shown in FIG. 8(A)

The control panel PA4 may be provided with an instruction portion MC1, by which an operator can instruct the switching from the PP setting to the TP setting, as well as a display portion DIS as shown in FIG. 8(A). The controller Ccont1 may operate as shown in FIG. 8(B).

In this case, if the medium to be used for the image formation is the medium PP, and no instruction is applied via the instructing portion MC1, the image is formed on the medium PP. If the switching instruction is applied via the instructing portion MC1 in spite of the fact that the medium to be subjected to the image formation is the medium PP, the image formation is inhibited (or the medium PP is discharged without the image formation), and the display portion DIS displays an alarm to the effect.

When the medium to be used for the image formation is the medium TP, and an instruction is applied via the instructing portion MC1, the image is formed on the medium TP if faced correctly. When the medium to be used for the image formation is the medium TP, but there is no switching instruction from the instructing portion MC1, the image formation is inhibited (or the medium TP is discharged without the image formation), and the display portion DIS displays to the effect.

Figure 9A:
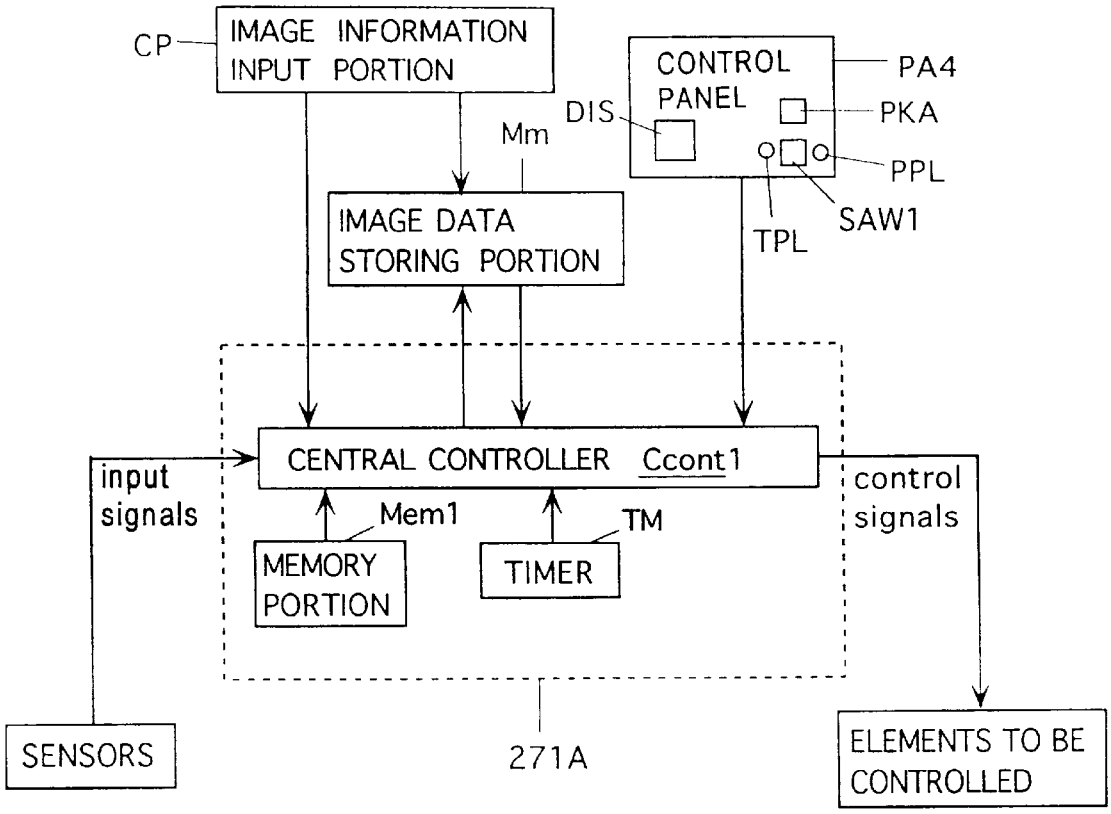
FIG. 9(A) is a block diagram schematically showing still another example of the controller in the apparatus shown in FIG. 6.
Figure 9B:
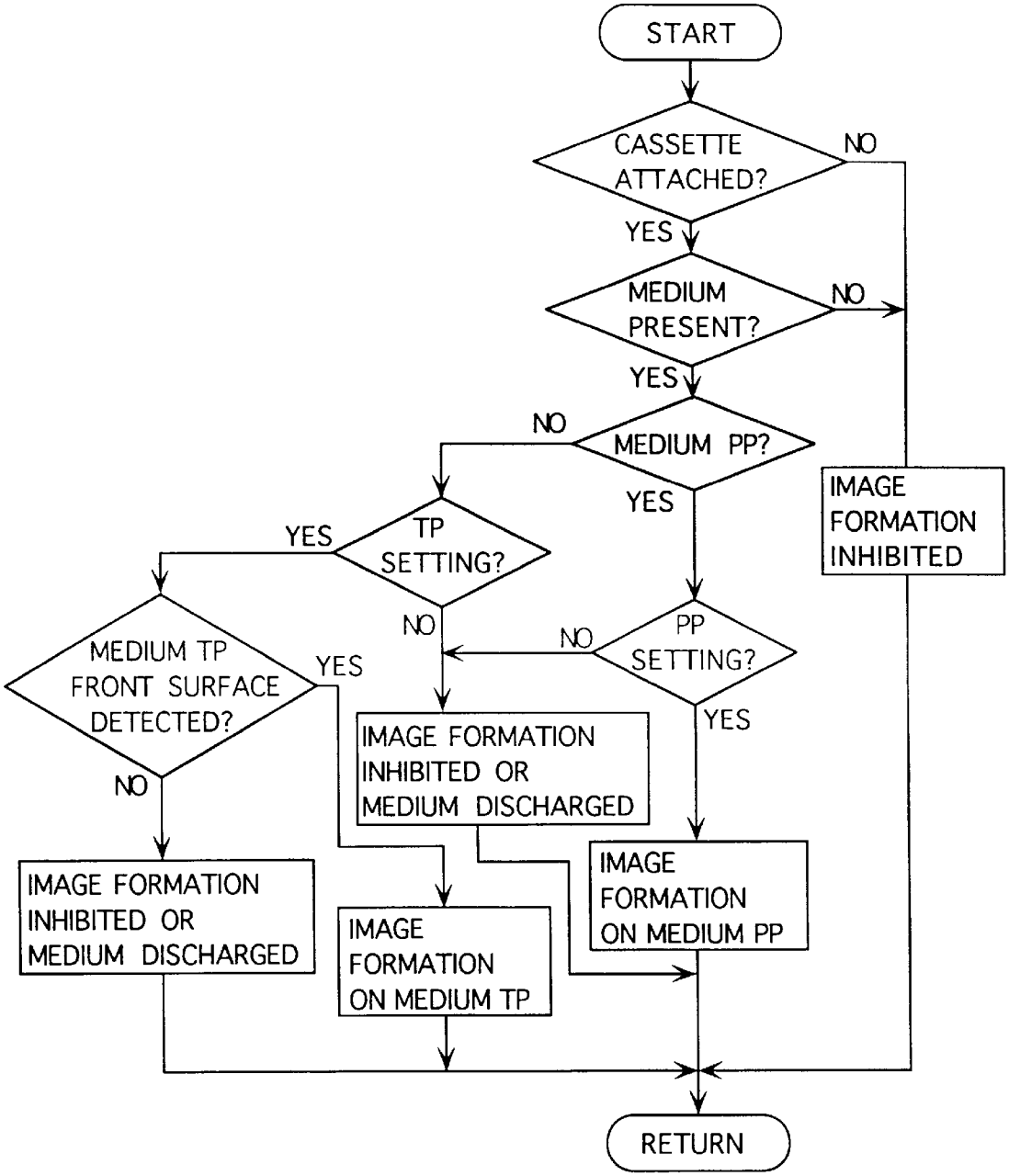
FIG. 9(B) is a flowchart showing operations of the controller shown in FIG. 9(A)

The control panel PA4 may be provided with a switch SWA1, by which an operator can freely designate the PP setting or TP setting as the standard mode, and may also be provided with the display portion DIS as shown in FIG. 9(A), and the control portion 271A may perform the control shown in FIG. 9(B). When the switch SWA1 is depressed, a lamp or the like (e.g., lamp PPL) is turned on, and the PP setting is selected. When the switch SWA1 is depressed one more time, a lamp TPL is turned on, and the TP setting is selected. In this manner, the image forming element setting can be successively switched upon every depressing of the switch.

In this example, if the operator has selected the PP setting as the standard setting, and the medium to be used for the image formation is the medium PP, the image is formed on the medium PP. If the medium to be used for the image formation is the medium TP, the image formation is inhibited (or the medium TP is discharged without the image formation), and the display portion DIS displays an alarm to the effect.

When the operator has selected the TP setting as the standard setting, and the medium to be used for the image formation is the medium TP, the image is formed on the medium TP if the medium TP is faced correctly. If the medium to be used for the image formation is the medium TP but is upside down, or if it is the medium PP, the image formation is inhibited (or the medium TP or PP is discharged without the image formation), and the display portion DIS displays an alarm to the effect.

Figure 10:
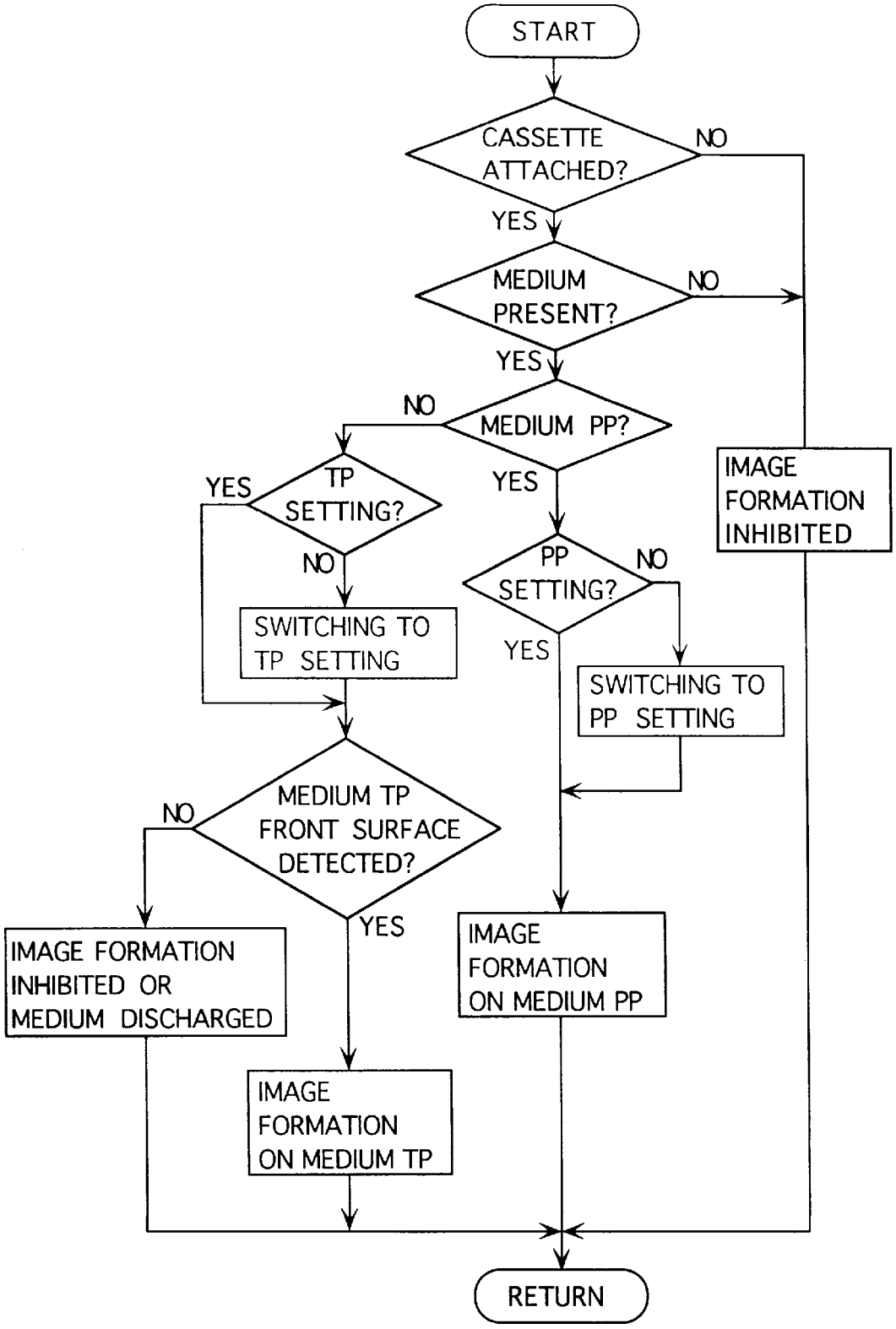
FIG. 10 is a flowchart showing further another example of the control operation of the apparatus shown in FIG. 6.

Instead of the control shown in FIG. 9(B), the controller 271A may perform the control shown in FIG. 10.

According to this control, even when the PP setting is already selected as the standard setting by the operator, the image is formed on the medium TP if the medium to be used for the image formation is the medium TP, and is faced correctly. Even when the TP setting is already selected as the standard setting by the operator, the image is formed on the medium if the medium to be used for the image formation is the medium PP.

Figure 11:
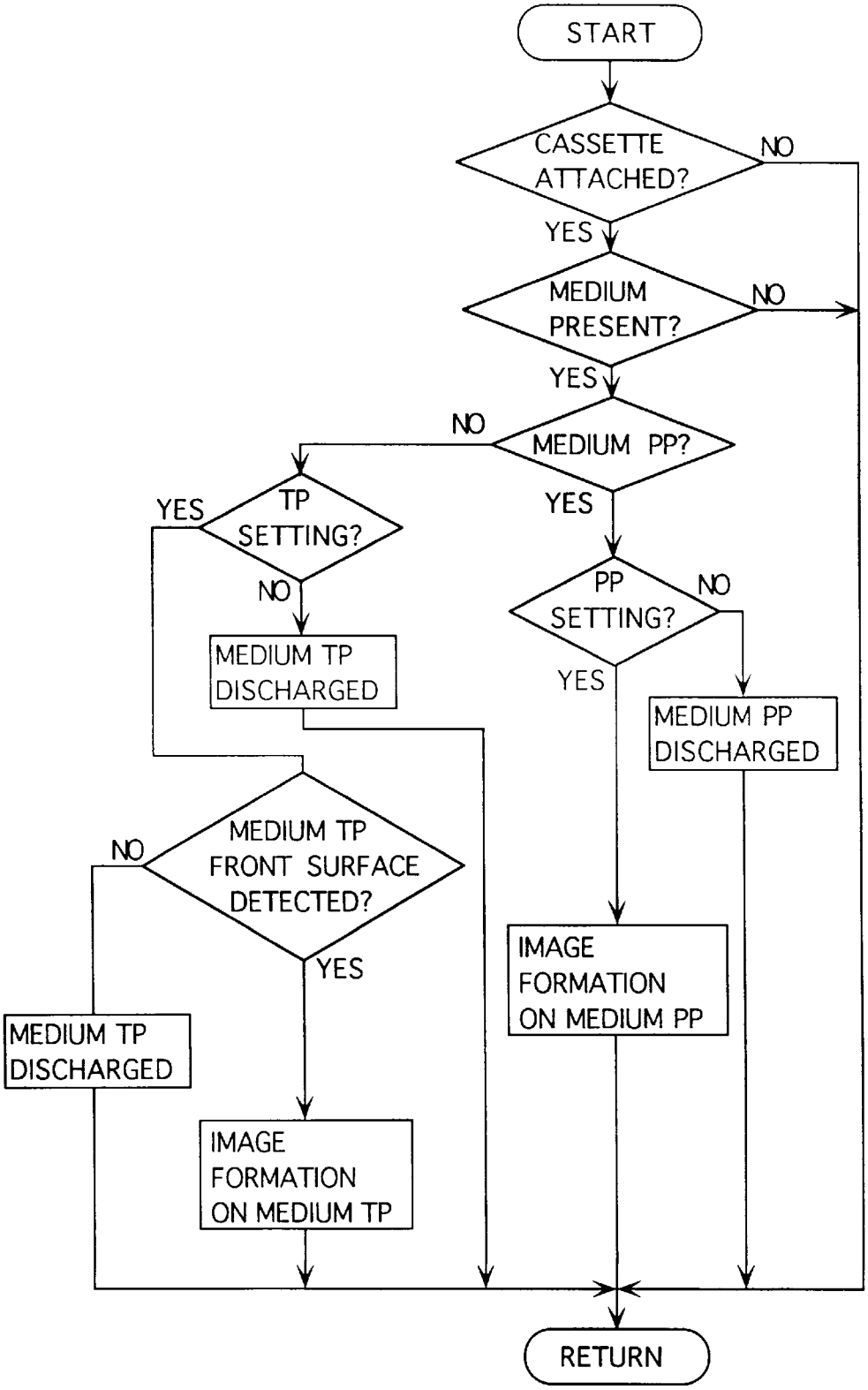
FIG. 11 is a flowchart showing further another example of the control operation of the apparatus shown in FIG. 6.

Instead of the control shown FIG. 9(B), the controller 271A may perform the control shown in FIG. 11.

This control is performed as follows. When the PP setting is already selected as the standard setting by the operator, and the medium to be used for the image formation is the medium TP, the image is not formed on the medium TP, and the medium TP is discharged. When the medium PP is supplied thereafter, the image is formed on the medium PP. When the TP setting is already selected as the standard setting by the operator, and the medium to be used for the image formation is the medium PP, the image is not formed on the medium PP, and the medium PP is discharged. When the medium TP is supplied thereafter, the image is formed on the medium TP if faced correctly. If it is upside down, the medium TP is discharged without image formation. When the medium TP, which is correctly faced, is supplied thereafter, the image is formed thereon.

Description will now be given in greater detail on the image formation by the image forming apparatus already described, and particularly on the image formation in the PP mode using the normal paper sheets and the image formation in the TP mode using the mediums TP1.

PP mode (electrophotographic image formation on normal paper sheet)

The medium PP (normal paper sheet) accommodated in the cassette CAS is pulled out from the cassette by the feed roller PR1, and is transported to the timing roller pair 22 so that it comes into contact with the nip portion thereof. In this operation, a fore-regist sensor (not shown) detects the leading end of the medium PP to determine the timing for transferring of the toner image on the photosensitive member with respect to the medium PP.

The surface of the photosensitive member 211 is charged by the charging roller 212 to +500 V, and the image exposing device 213 performs the image exposure on the charged region so that an electrostatic latent image corresponding to the intended image is formed. The surface potential on the exposed portion is reduced to about 0 V, and the portion other than the above is kept at +500 V.

This electrostatic latent image reaches the developing device 214, and the developing roller 214*a* thereof is supplied with the developing bias of +400 V from the power source PW4.

Accordingly, the electrostatic latent image on the photosensitive member 211 is developed into a visible image with the toner by the electric field formed between the electrostatic latent image and the developing roller 214*a*. Thus, only the exposed portion is developed with the toner.

Then, the transfer roller 215 transfers the toner image formed on the photosensitive member onto the medium PP, which is sent in synchronization with the toner image on the photosensitive member by the timing roller pair 22. In this operation, the transfer roller 215 is supplied with a bias of −1000 V so that the positively chargeable toner is electrostatically transferred onto the medium PP from the photosensitive member.

Thereafter, the photosensitive member 211 is cleaned up by the cleaning blade 216 to remove the untransferred residual toner on the photosensitive member, and then the surface potential thereof is initialized by the charging roller 212 for the next image forming operation.

The toner image transferred on the medium PP is fixed onto the medium by the pressure and heat, which are applied to the toner image when passing through the fixing roller pair 23, and then the medium PP is discharged onto the tray PPT.

TP Mode (using medium TP1)

The medium TP1 accommodated in the cassette CAS is pulled out from the cassette CAS by the feed roller PR1, and is transported to the timing roller pair 22 through the eraser roller pair 270 so that it comes into contact with the nip portion of the roller pair 22. In this operation, the fore-regist sensor (not shown) detects the leading end of the medium TP1 to determine the timing for writing the image onto the medium TP1.

The eraser roller pair 270 carrying the bias voltage of +250 V supplied from the power source PW5 moves the white developer particles in the medium TP1 toward one of the substrates, and also moves the black developer particles toward the other substrate so that the medium TP1 is initialized (and the image, if already formed, is erased). Further, the rotating magnet roller 270*a* applies an oscillating magnetic field to the developer containing the magnetic particles contained in the medium TP1 for stirring it so that the flowability of the developer particles is improved to achieve easy initialization of the medium TP1.

The eraser roller pair 270 may be arranged on either upstream to or downstream from the timing roller pair 22. One roller pair may be configured to serve both the eraser roller pair and the timing roller pair.

The surface of the photosensitive member 211 is charged by the charging roller 212 to +500 V, and the image exposing device 213 performs the image exposure on the charged region so that an electrostatic latent image corresponding to the intended image is formed.

Then, the electrostatic latent image is opposed to the medium TP1 sent from the timing roller pair 22, and the transfer roller (serving as the opposite electrode in this case) 215 bearing the bias for image writing and supplied from the power source PW3 forms the contrast image corresponding to the electrostatic latent image on the photosensitive member in the medium TP1. In this operation, a peripheral speed ratio θ equal to 1 is set between the peripheral speed of the photosensitive member and the peripheral speed of the transfer roller (opposite electrode roller), and the transfer roller bears the bias of +250 V. Thereby, the image is formed by the Coulomb force acting between the electrostatic field formed in the region, where the photosensitive member and the transfer roller (opposite electrode roller) are opposed to each other, and the frictionally charged particles contained in the medium TP1. For the above image formation, the magnet roller 215*a* arranged within the transfer roller 215 is driven to rotate for magnetically stirring the developer particles within the medium TP1 so that the flowability of the particles is improved during the image formation.

In the above image formation, the surface potential on the photosensitive member may be further raised, e.g., to +1000 V, and the bias applied to the transfer roller may be raised to, e.g., +500 V, whereby the electric field driving the developer particles within the medium TP1 becomes double, and fast image display can be performed. In this case, it is preferable to increase the exposure intensity in accordance with increase in surface potential of the photosensitive member so that the latent image can be formed reliably.

The medium TP1 on which the image is formed in the above manner is discharged onto the tray TPT through the path 262.

The trays PPT and TPT may be formed of the same tray.

The image forming apparatus A1 may be provided with a charge eraser, which erases the residual charges on the photosensitive member 212 after the transfer of the toner image onto the medium PP or writing of the image on the medium TP and before the charging by the charging roller 212. This is true also with respect to the image forming apparatuses, which will be described later.

Figure 12:
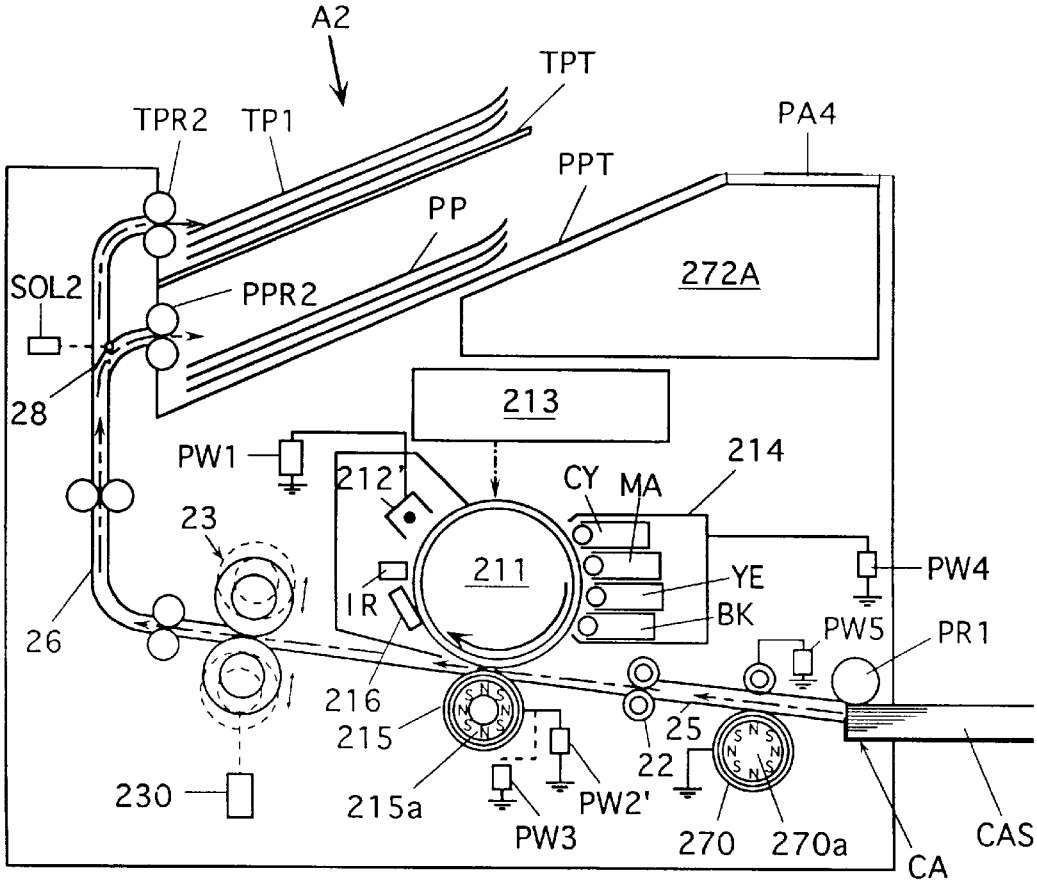
FIG. 12 shows a schematic structure of another example of the image forming apparatus.

<Image Forming Apparatus A2 in FIG. 12>

An image forming apparatus A2 differs from the image forming apparatus A1 shown in FIG. 6 in that a corona charging device 212' is employed instead of the charging roller 212, and the upper and lower rollers of the fixing roller pair 23 can be moved away from each other.

For the image formation in the PP mode, a controller 272A for controlling the whole operation of the apparatus A2 sends an instruction for the fixing roller pair 23 so that a drive mechanism 230 including a cam mechanism sets the upper and lower rollers to the state for fixing the image onto the medium PP. For the image formation in the TP mode, the drive mechanism 230 controlled by the controller 272A reduces the mutual pressure (nip pressure) between the upper and lower rollers. In the TP mode, a heater 231H (see FIG. 32(A)) is turned off.

Figure 32A:
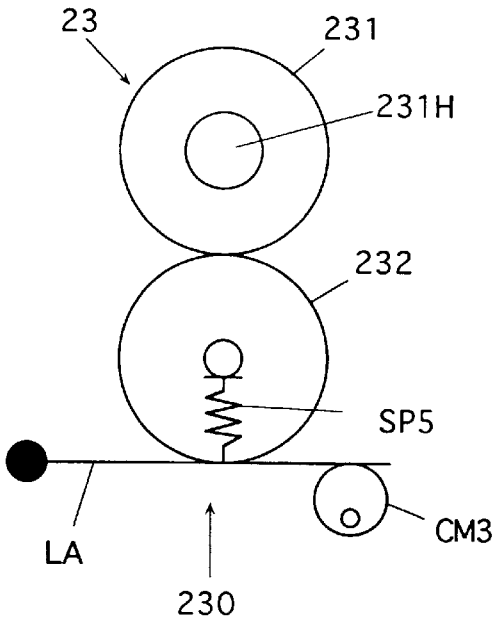
FIGS. 32(A) and 32(B) show an example of a drive mechanism for switching a fixing roller pair between a regular fixing state and a non-fixing state.
Figure 32B:
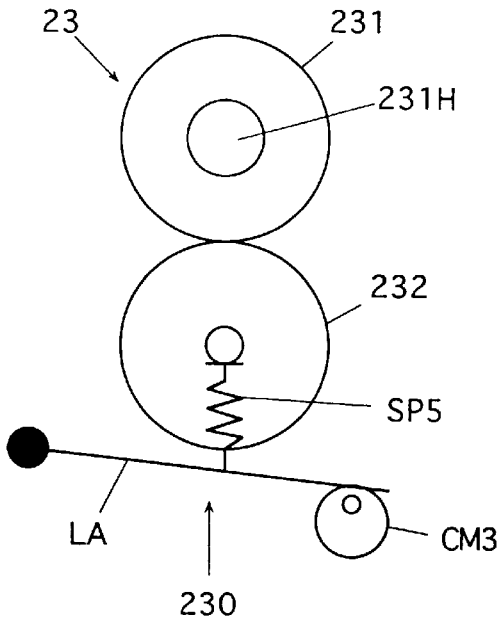

In the drive mechanism 230, as shown in FIGS. 32(A) and 32(B), an upper fixing roller 231 internally provided with the heater 231H is located in a fixed position, a lower pressure roller 232 is vertically movable, and a shaft portion of the lower roller 232 is supported by an arm member LA via a compressible spring 232. The arm member LA is swingable around its one end, and has a free end in contact with an eccentric cam CM3.

The eccentric cam CM3 rotates to raise the swing arm member LA against the spring SP5 so that a regular nip pressure can be achieved in the PP mode. By lowering the swing arm member LA, the nip pressure of a low value suitable to the TP mode can be set.

In the medium path 26 downstream from the fixing roller pair 23, a switching member (claw) 28 driven by a solenoid SOL2 is arranged for sending the medium PP toward the tray PPT and sending the medium TP toward the tray TPT. The position of the claw 28 is determined by the solenoid controlled by a controller 272A in accordance with the PP mode and the TP mode.

The developing device 214 in this example is a full-color developing device including cyan, magenta, yellow and black developing devices CY, MA, YE and BK.

An eraser IR opposed to the photosensitive member 211 is located between the cleaning blade 216 and the charging roller 212 for erasing the residual charges on the photosensitive member.

Structures other than the above are the substantially same as those of the image forming apparatus A1. The same portions as those of the apparatus A1 bear the same reference numbers. The controller 272A is connected to a control panel PA4 similar to that in the apparatus A1.

Switching of the setting of the image forming element(s), the image forming processing and others are performed similarly to those in the apparatus A1 under the control in the manner shown in any one of FIGS. 7(A) to 11.

According to the image forming apparatus A2, the PP-mode image formation using the normal paper sheet as well as the TP-mode image formation using the medium TP1 are performed as follows.

PP mode (electrophotographic image formation on the normal paper sheet)>

The upper and lower rollers of the fixing roller pair 23 are set for image fixing, and the claw 28 occupies a position for sending the medium PP toward the tray PPT.

The electrostatic latent image is formed and developed as follows. The charger 212' charges the surface of the photosensitive member 212 to +500 V, and the image exposing device 213 exposes the charged region to form cyan electrostatic latent image. The cyan developer CY bearing a developing bias of +400 V develops this cyan electrostatic latent image with positively chargeable cyan developer so that a cyan toner image is formed.

The photosensitive member 211 carrying the cyan toner image passes through the region of the transfer roller 215 and the cleaning blade 216, of which pressing forces are released for preventing the disturbance in the cyan image, and the residual charges are erased by the eraser IR. Again, the charging device 212' uniformly charges the surface of the member 211 to +500 V.

Then, the magenta, yellow and black toner images are successively formed in an overlapping fashion by operations similar to that for the first cyan image. In this manner, a toner image formed of the four toner images of different colors is formed, and then the transfer roller 215 is pressed against the photosensitive member 211 so that the toner image is transferred with the transfer voltage of about −1500 V onto the medium PP supplied from the timing roller pair 22.

Thereafter, the cleaning blade 216 is brought into contact with the photosensitive member, and the residual developer is removed. The eraser IR erases the residual charges.

The medium PP is processed to fix the transferred toner image thereon by the fixing roller pair 23, and thereby is discharged onto the discharge tray PPT.

Figure 33A:
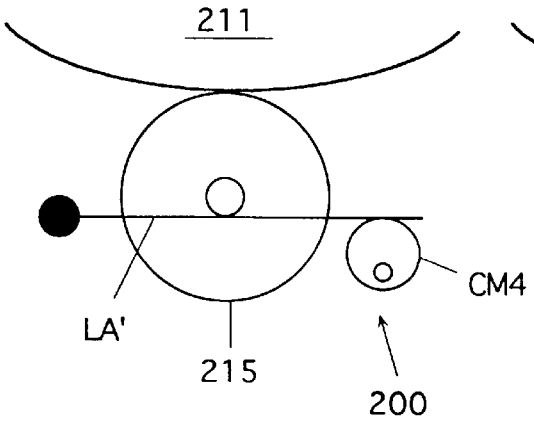
FIGS. 33(A) and 33(B) show an example of a drive mechanism for switching a transfer roller between a regular transfer state and an escape state.
Figure 33B:
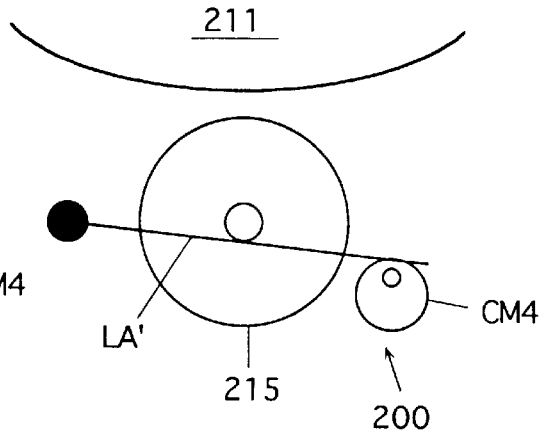

The pressing and spacing of the transfer roller 215 with respect to the photosensitive member are performed by a drive mechanism 200 shown in FIGS. 33(A) and 33(B). More specifically, the swingable arm LA' which is swingable around one end is brought into contact with the lower side of the shaft of the transfer roller 215, and the eccentric cam CM4 is brought into with the lower surface of the free end of the arm LA', and is rotated by an electric motor (not shown). Thereby, the arm LA' is raised to the pressing position (transfer position) with respect to the photosensitive member 211 shown in FIG. 33(A) from the spaced position (non-transfer position) shown in FIG. 33(B), or lowered to the spaced position from the pressing position.

The cleaning blade 216 is moved toward and away from the photosensitive member 211 by a mechanism similar to that shown in FIGS. 31(A) and 31(B).

Manners other than the above are similar to those of the image forming apparatus A1.

TP mode (using medium TP1)

The nip pressure of the fixing roller pair 23 is set to a low value such that the image on the medium TP1 may not be damaged and further the medium TP1 can smoothly move through the fixing roller pair 23. The claw 28 occupies the position for sending the medium TP1 toward the tray TPT.

The image exposure effected by the image exposing device 213 on the photosensitive member 211 is performed in accordance with the converted image data, which is prepared by converting the image data stored in the image data storing portion Mm. In this example, monochrome image data is prepared by converting the color image data stored in the storing portion Mm, and the image exposure is effected on the photosensitive member in accordance with the monochrome image data.

Instead of the conversion to form the monochrome image data, conversion of the color image data may be performed to lower the tone levels from 256 to 4.

Manners other than the above are similar to those in the case of the image forming apparatus A1.

The trays PPT and TPT may be formed of the same tray.

Figure 13:
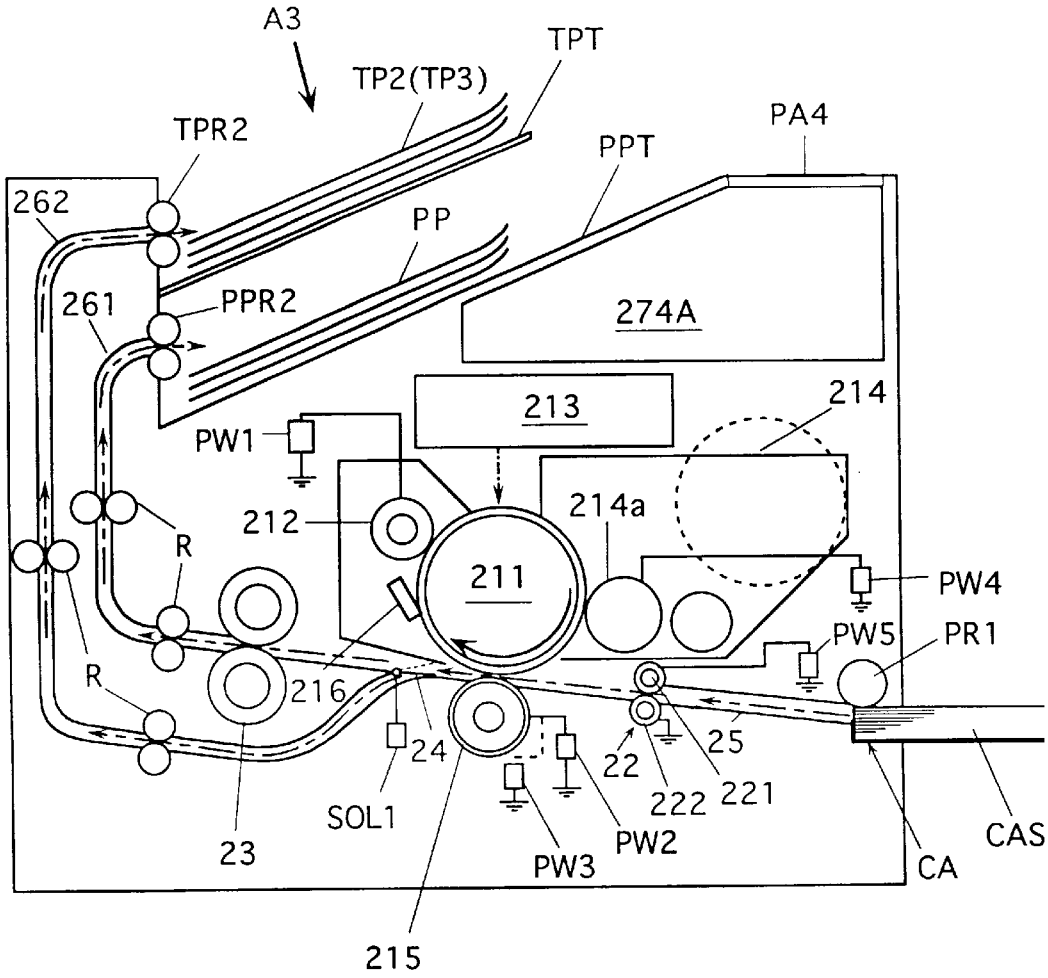
FIG. 13 shows a schematic structure of further another example of the image forming apparatus.

<Image Forming Apparatus A3 in FIG. 13>

An image forming apparatus A3 uses the medium TP2 of the electrophoresis type or the medium TP3 of the twist ball type as the medium TP.

The apparatus A3 differs from the apparatus A1 in FIG. 6 in that the eraser roller pain 270 and the internal magnet roller 270*a* are not arranged, and the internal magnet roller 215*a* is not arranged in the transfer roller 215. The timing roller pair 22 serves also as the eraser roller pair. An upper roller 221 of the timing roller pair 22 can receive a bias from the power source PW5 and a lower roller 222 is grounded in the TP mode.

Structures other than the above are the same as those of the image forming apparatus A1. The same portions as those in the apparatus A1 bear the same reference numbers.

The switching of the setting of the image forming element (s) as well as the image forming processing and others are also performed similarly to the apparatus A1 already described.

A controller 274A controlling the whole operation of the apparatus A3 controls both the image forming operations for the mediums PP and TP. The controller 274A is connected to the control panel PA4 similar to that in the apparatus A1.

The image forming apparatus A3 performs the PP-mode image formation using the normal paper as well as the TP-mode image formation using the mediums TP2 or TP3 in the following manners.

PP mode (electrophotographic image formation using the normal paper sheet)

The operation is the same as that of the image forming apparatus A1.

TP mode (using medium TP2)

In the apparatus A3, the mediums TP2 of the electrophoresis type are accommodated in the cassette CAS. The medium TP2 in the cassette CAS is pulled out by the feed roller PR1 from the cassette, and is transported to the timing roller pair 22 so that it comes into contact with the nip portion thereof. In this operation, the fore-regist sensor (not shown) detects the leading end of the medium TP2 to determine the timing for writing the image onto the medium TP2.

The timing roller pair 22 carrying the bias voltage of +250 V supplied from the power source PW5 moves the white developer particles having the electrophoretic mobility in the medium TP2 toward the substrate on the front side (upper side in the figure) so that the medium TP2 is initialized. The medium TP2 thus initialized exhibits a white appearance.

The eraser roller pair 270 used in the apparatus A1 may be used.

The surface of the photosensitive member 211 is charged by the charging roller 212 to +500 V, and the image exposing device 213 performs the image exposure on the charged region so that an electrostatic latent image corresponding to the intended image is formed.

Then, the electrostatic latent image is opposed to the medium TP2 sent from the timing roller pair 22, and the transfer roller (the opposite electrode in this case) 215 bearing the bias, which is supplied from the power source PW3 for image writing, forms the contrast image corresponding to the electrostatic latent image on the photosensitive member on the medium TP2. The transfer roller bears the bias of +250 V. Thereby, the image is formed by moving the white particles 141 to the rear side by the Coulomb force acting between the electrostatic field formed in the region, where the photosensitive member and the transfer roller (opposite electrode roller) are opposed to each other, and the charged and movable particles contained in the medium TP2.

The medium TP2 on which the image is formed in the above manner is discharged onto the tray TPT through the path 262.

The trays PPT and TPT may be formed of the same tray.

TP mode (using medium TP3)

Under conditions similar to those for the medium TP2, the image can be formed similarly.

When using the medium TP3, the timing roller pair 22 carrying the bias supplied from the power source PW5 initializes the medium so that the two-color spherical members 151, which are dispersed within the medium TP3 and have an electric anisotropy, are positioned to direct simultaneously the semi-spherical surfaces of the same color upward or downward.

During the image formation, the two-color spherical members 151 within the medium TP3 are rotated in the region, where the photosensitive member 211 and the transfer roller (opposite electrode roller) 215 are opposed to each other, by the electrostatic field formed between them so that the image is formed. The portion where the white surfaces are directed outward exhibits a white appearance. The portion where the colored surfaces 151*a* are directed outward exhibits the same color as the colored surface 151*a*.

The medium TP3 on which the image is formed in the above manner is discharged onto the tray TPT through the path 262.

In the image formation on either of the mediums TP2 and TP3, the surface potential on the photosensitive member may be further raised, e.g., to 1000 V, and the bias applied to the transfer roller may be raised to, e.g., +500 V, whereby the electric field driving the developer particles within the medium TP2 or TP3 becomes double, and fast image display can be performed. In this case, it is preferable to increase the exposure intensity in accordance with increase in surface potential of the photosensitive member so that the latent image can be formed reliably.

The trays PPT and TPT may be formed of the same tray.

Figure 14:
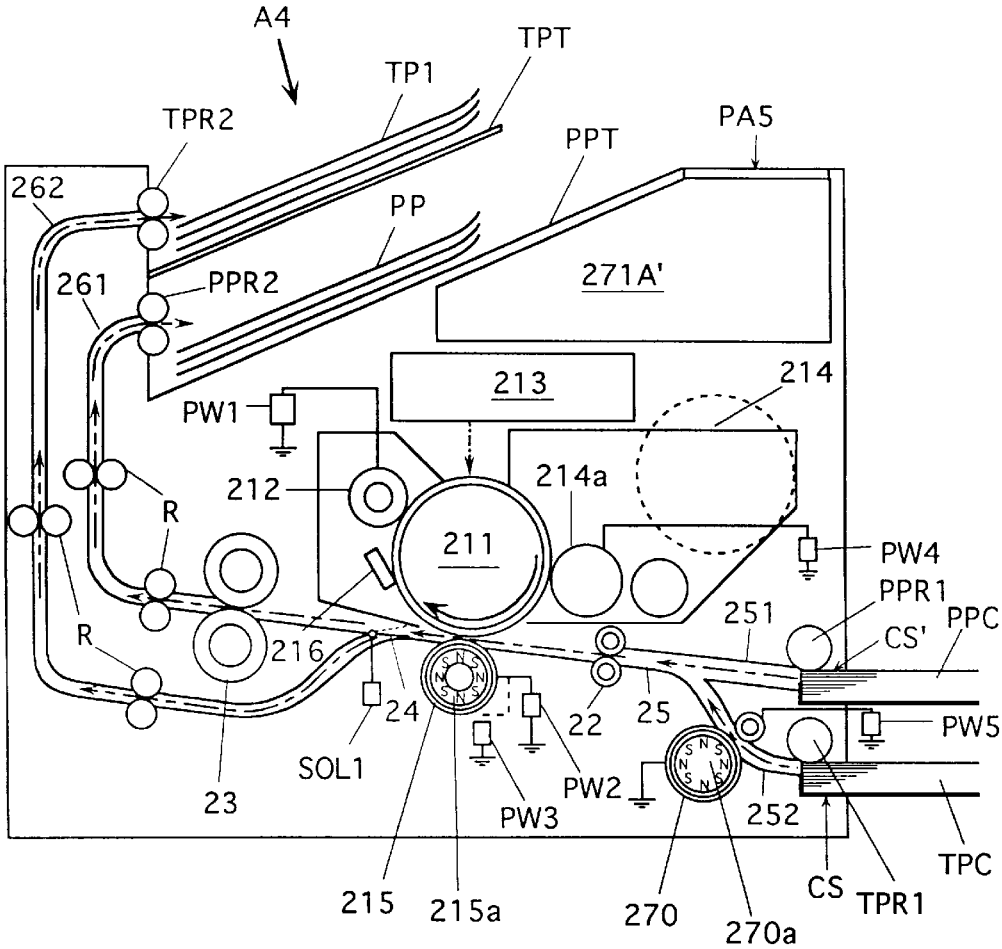
FIG. 14 shows a schematic structure of further another example of the image forming apparatus.

<Image Forming Apparatus A4 in FIG. 14>

An image forming apparatus A4 differs from the image forming apparatus A1 shown in FIG. 6 in that a cassette attaching portion CS' is additionally employed for attaching the cassette PPC accommodating the medium PP. The cassette PPC attached thereto is opposed to a medium feed roller PPR1. The cassette PPC is the same as the cassette CAS1 or CAS2 accommodating the mediums PP, or is the same as the cassette CAS3' or CAS4' dedicated to the medium PP.

The cassette TPC is attached to the lower cassette attaching portion CS, which is opposed to the medium feed roller TPR1. The cassette TPC is the same as the cassette CAS1 or CAS2 accommodating the mediums TP, or is the same as the cassette CAS3 or CAS4 dedicated to the medium TP.

One of the medium type detecting devices already described is provided for each of the cassette attaching portions CS and CS'.

A controller 271A' controlling the whole operation of the apparatus A4 controls both the image forming operations for the mediums PP and TP.

Figure 15:
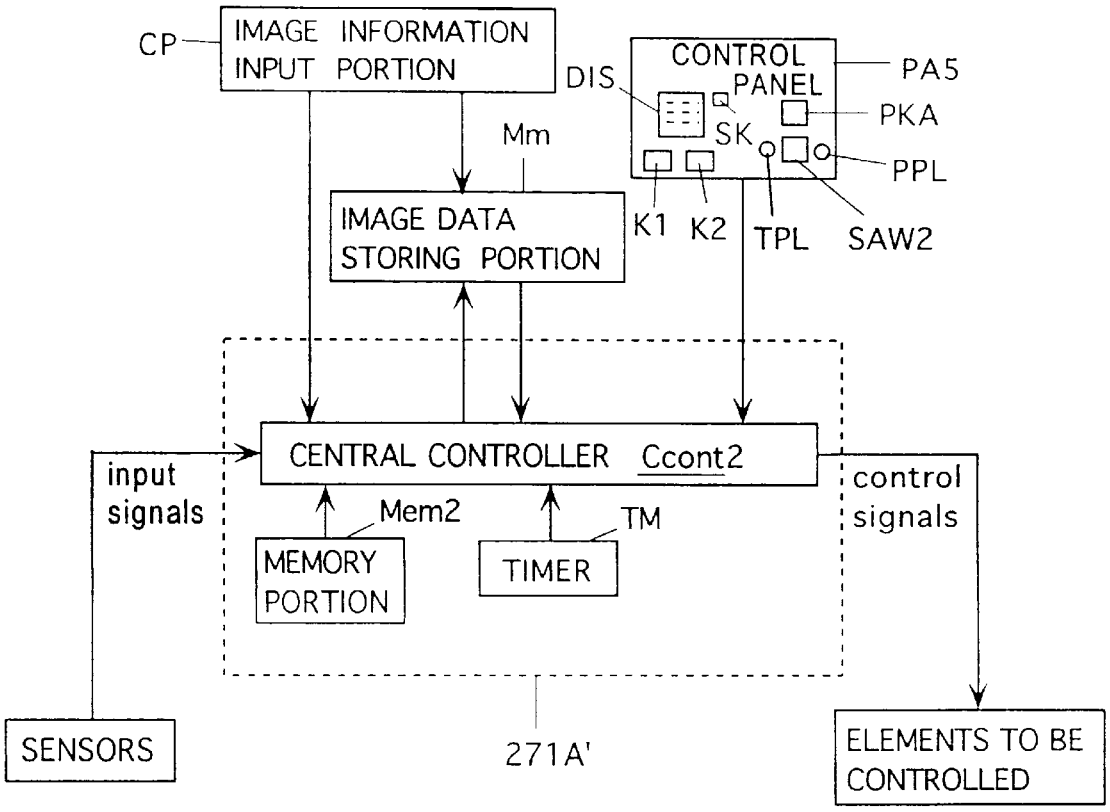
FIG. 15 is a block diagram schematically showing a control circuit of the apparatus shown in FIG. 14.

FIG. 15 is a block diagram schematically showing a control circuit of the apparatus A4.

As shown in FIG. 15, the controller 271A' in the apparatus A4 includes a central controller Ccont2, and also includes a memory portion Mem2, which is connected to the central controller, and stores programs for apparatus operation control and various setting data required for executing the programs, and an internal timer Tm for determining timing for operations of various elements.

The central controller Ccont2 receives information through an input port (not shown) from a fore-regist sensor, a temperature detecting sensor in the fixing roller pair 23, a medium presence detecting sensor PAM (see FIG. 24(C)) for the medium supply cassette and other various sensors or the like. The central controller Ccont2 is connected to an image data storing portion Mm, a control panel PA5 and other various elements to be controlled.

The image data storing portion Mm is provided for temporarily storing the image data sent from an external image information input portion CP such as a computer or a facsimile machine.

The controller 271A' is connected to the control panel PA5, which is provided with the following.

(1) The key PKA for instructing start of the image formation (the same structure as that employed in the apparatus A1).

(2) The switch SWA2 for the standard mode setting, by which an operator can selectively designate the use of the cassette PPC for the medium PP and the cassette TPC for the medium TP, and can also selectively designate, as the standard mode, the PP mode or the TP mode in accordance with the designation of the cassette.

The switch SWA2 has a structure similar to that of the switch SWA1 employed in the apparatus A1.

(3) An image data type designating portion K1 for setting in advance such that, when a predetermined kind of image data input operation is performed via the external image information input portion CP such as a computer outside the image forming apparatus, the setting of the image forming elements can be switched for forming the image on the medium of the type requested or desired by the operator.

(4) A data sender designation portion K2 for setting in advance such that, when an image data is input from a predetermined image data sender, the setting of the image forming elements can be switched for forming the image on the medium of the type requested or desired by the operator.

In other words, the designating portions K1 and K2 are configured to designate the image formation on the mediums of the predetermined type which is designated in advance by the operator for the predetermined kind of image data, or the image data sent from the predetermined sender.

(5) The display portion DIS for displaying that the image display medium to be subjected to the image formation does not correspond to the designated mode, if this is true.

The display portion DIS has a structure similar to that of the display portion DIS employed in the apparatus A1.

The display portion DIS also displays a list of files of data stored in the image data storing portion Mm. The control panel PAS is provided with a cursor key SK, by which the operator selects and designates the file to be printed out among the plurality of files. If the file selecting operation is not performed via this key before the printing, the currently selected file will be printed out.

In this image forming apparatus A4, the image output instruction is initially applied from the image information input portion CP to the central control portion Ccont2.

The image data storing portion Mm temporarily stores the image data transferred from the image information input portion CP in response to this image output command.

The central controller Ccont2 has a function of producing the converted image data for the medium TP from the data stored in the image data storing portion Mm. In this example, the central controller Ccont2 forms, e.g., the converted image data of 300 dpi from the image data of 600 dpi stored in the storing portion Mm. With this converted image data, the image is formed on the medium TP. The image formation on the medium PP is performed with the image data itself, which is stored in the image data storing portion Mm.

The image data storing portion Mm has a capacity capable of storing the image data of multiple pages. The storing and erasing of the image information for each page are performed independently of the other pages, but may be performed in batches of the print job. Similarly, the image output on the mediums PP is performed page by page, but may be performed in batches of print job.

The apparatus converts the image data for the TP mode by reducing the resolution from the original value. However, the image data conversion for the TP mode is not restricted to this.

In this image forming apparatus, the image data storing portion is not essential, similarly to the foregoing cases. On either of the mediums PP and TP, the image formation may be effected by the controller based on the transferred image data. In the structure provided with the image data storing portion, the image information on either of the mediums PP and TP may be performed in accordance with the image data, which is temporarily stored in the image data storing portion (without converting the image data even if the image is to be formed on the medium TP). In any one of the above cases, such a structure may be employed that the image data storing portion is employed for temporarily storing the image data transferred thereto, and the image can be formed on either the mediums PP and TP based on the stored image data, whereby it is not necessary to transfer the image data upon every change in medium type, resulting in easy and convenient use.

In this image forming apparatus A4, the switching setting of the image forming elements is performed in accordance with an instruction by the controller 271A' in any one of such cases that:

(1) the operator sets the switch SWA2 to the mode opposite to the standard mode (i.e., the PP mode or the TP mode determined by the operator), (2) the image information input portion CP operates to input the image data of the predetermined type designated by the image data type designating portion K1, and the element setting is not yet achieved to allow image formation of the image data on the intended image display medium, and (3) the image data is transferred from the sender designated by the sender designating portion K2, and the element setting is not yet achieved to allow image formation of the image data on the intended image display medium.

When the PP mode is designated by the switch SWA2 as the standard mode, the image forming elements are set to the standard state for image formation on the medium PP in the PP mode under the control of the controller 271A'. In this setting, the medium feed roller PPR1 operates.

In such a case that the operator operates the switch SWA2 to designate the non-standard mode and thus TP mode subsequently to the standard state setting, that the image information input portion operates to input the image data of the predetermined type designated by the image data type designating portion K1, or that the sender designated by the sender designating portion K2 transfers the image data, the image forming elements are set to the non-standard state for image formation on the medium TP in the TP mode under the control of the controller 271A'. In this setting, the medium feed roller TPR1 operates.

Figure 16:
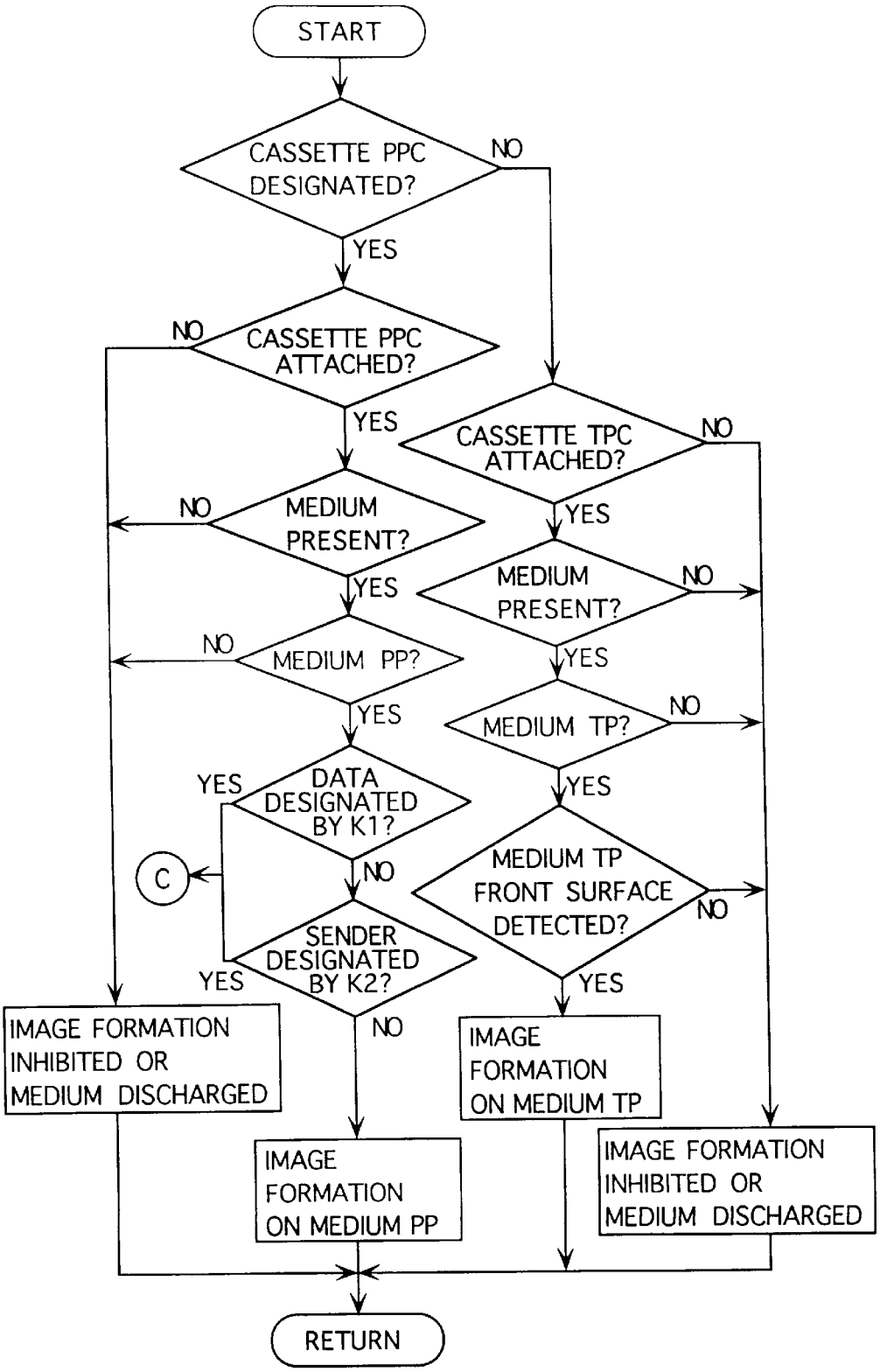
FIG. 16 is a flowchart showing a portion of the operation of the controller in the apparatus shown in FIG. 14.

FIG. 16 is a flowchart schematically showing a part of control of the controller 271A'.

Referring to FIG. 16, when the print start instruction key PKA is depressed (or the image information input portion CP sends the print start instruction in the on-line state or the like) in such a state that the image forming elements are already set by the switch SWA2 to select the PP mode as the standard mode, the medium type detecting device detects the medium PP as long as the medium PP is present within the cassette PPC attached to the cassette attaching portion CS'. Thereby, the standard state setting of the image forming elements is maintained. If not designated by the designating portions K1 and K2, the image is formed on the medium PP. Even when designated by the designating portions K1 and K2, the image is formed on the medium PP if the image data of the designated image data type is not sent, or if the data is not sent from the designated sender.

In the state where the cassette CAS1 or CAS2 is attached to the attaching portion CS', the cassette may accommodate the medium TP or a mixture of the mediums PP and TP. Further, the cassette CAS3 or CAS4 may be attached to the attaching portion CS'. In these cases, the medium type detecting device detects the medium TP. Thereby, the image formation on the medium TP is inhibited (or the medium TP is discharged without the image formation), and the display portion DIS displays to the effect.

Figure 17:
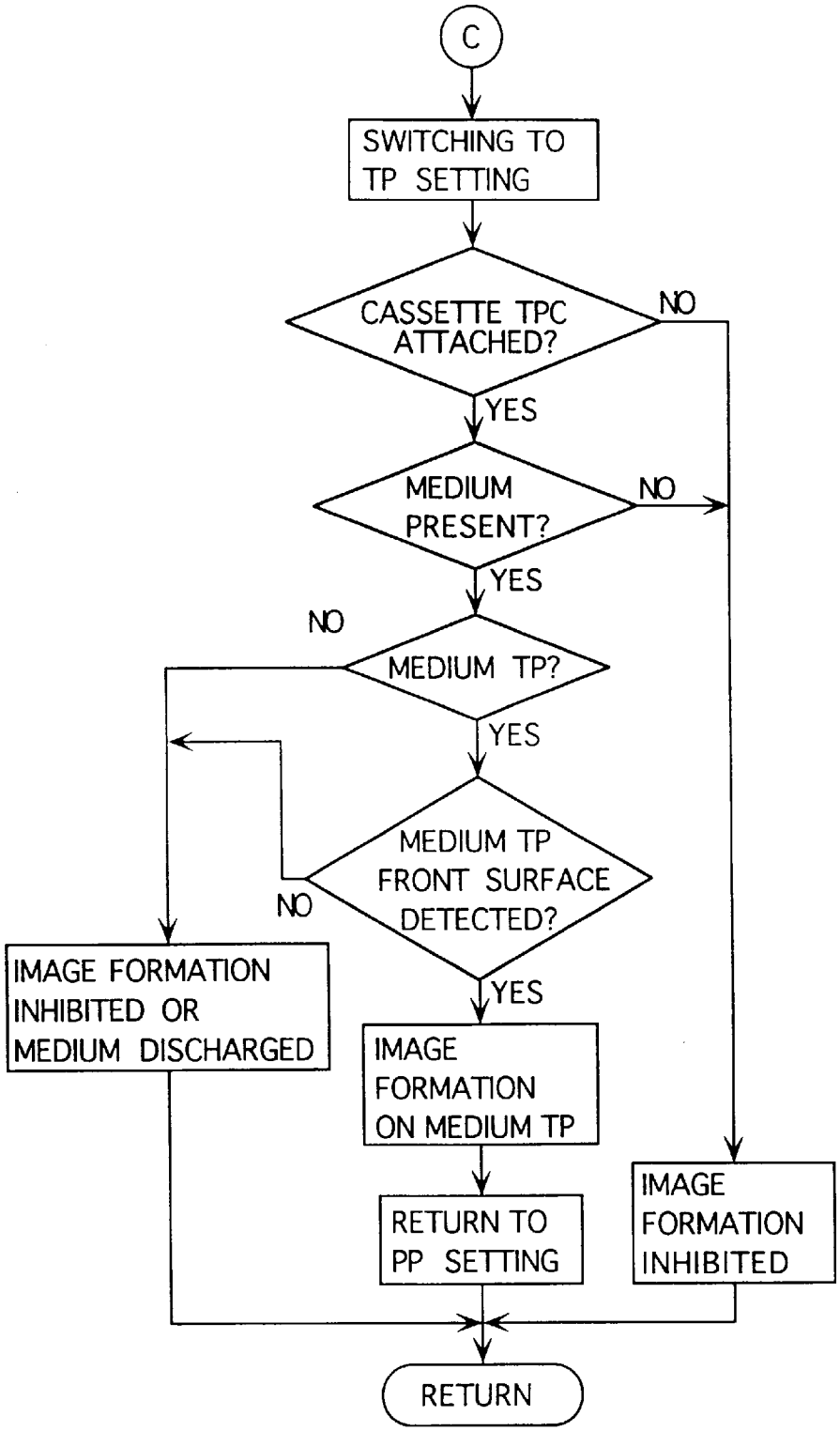
FIG. 17 is a flowchart showing the rest of the operation of the controller in the apparatus shown in FIG. 14.

In the state where the PPC (PP mode) is designated and the medium PP can be supplied, the image data of the type designated by the designating portion K1 may be sent, or the data may be sent from the sender designated by the designating portion K2. In these cases, the image forming elements are switched to the TP setting, and the image is formed on the medium TP, if the cassette TPC accommodating the medium TP, which is faced correctly, is attached as shown in FIG. 17. Thereafter, the image forming elements return to the PP setting. However, if the medium PP is to be supplied, or the medium TP is upside down, the image formation is inhibited (or the medium TP is discharged without image formation. In this case, the image may be formed on the medium PP after returning the setting to the PP setting, and the display portion DIS may display to the effect.

When the mode is switched to the non-standard mode and thus TP mode (or the TP mode is already selected), and the medium TP is present in the cassette TPC attached to the cassette attaching portion CS, the medium type detecting device detects the medium TP, and thereby the image forming elements are maintained in the non-standard state setting. When the key PKA is depressed (or the image information input portion CP sends the print start instruction in the on-line state or the like), the image is formed on the medium TP. However, when the medium TP is upside down, the image formation is inhibited (or the medium TP is discharged without the image formation), and the display portion DIS displays to the effect.

In the case where the cassette CAS1 or CAS2 is used, the medium PP or a mixture of the mediums TP and PP may be present in the cassette. Alternatively, the cassette CAS3' or CAS4' dedicated to the medium PP may be attached to the cassette attaching portion. In these cases, the medium type detecting device detects the medium PP. Thereby, the image formation is inhibited (or the medium PP is discharged without the image formation), and the display portion DIS displays to the effect.

When the cassette is not attached, or the medium is not present in the attached cassette, the image formation is inhibited.

Description will now be given in greater detail on the image formation by the image forming apparatus already described, and particularly on the image formation in the PP mode using the normal paper sheets and the image formation in the TP mode using the mediums TP1.

PP mode (electrophotographic image formation on normal paper sheet)

The medium PP (normal paper sheet) accommodated in the cassette PPC is pulled out from the cassette by the feed roller PPR1, and is transported to the timing roller pair 22 so that it comes into contact with the nip portion thereof. In this operation, a fore-regist sensor (not shown) detects the leading end of the medium PP to determine the timing for transferring of the toner image on the photosensitive member with respect to the medium PP.

The surface of the photosensitive member 211 is charged by the charging roller 212 to +500 V, and the image exposing device 213 performs the image exposure on the charged region so that an electrostatic latent image corresponding to the intended image is formed. The surface potential on the exposed portion is reduced to about 0 V, and the portion other than the above is kept at +500 V.

This electrostatic latent image reaches the developing device 214, and the developing roller 214*a* thereof is supplied with the developing bias of +400 V from the power source PW4.

Accordingly, the electrostatic latent image on the photosensitive member 211 is developed into a visible image with the toner by the electric field formed between the electrostatic latent image and the developing roller 214*a*. Thus, only the exposed portion is developed with the toner.

Then, the transfer roller 215 transfers the toner image formed on the photosensitive member onto the medium PP, which is sent in synchronization with the toner image on the photosensitive member by the timing roller pair 22. In this operation, the transfer roller 215 is supplied with a bias of −1000 V so that the positively charged toner is electrostatically transferred onto the medium PP from the photosensitive member.

Thereafter, the photosensitive member 211 is cleaned up by the cleaning blade 216 to remove the untransferred residual toner on the photosensitive member, and then the surface potential thereof is initialized by the charging roller 212 for the next image forming operation.

The toner image transferred on the medium PP is fixed onto the medium by the pressure and heat, which are applied to the toner image when passing through the fixing roller pair 23, and then is discharged onto the tray PPT.

TP Mode (using medium TP1)

The medium TP1 accommodated in the cassette TPC is pulled out from the cassette TPC by the feed roller TPR1, and is transported to the timing roller pair 22 through the eraser roller pair 270 so that it comes into contact with the nip portion of the roller pair 22. In this operation, the fore-regist sensor (not shown) detects the leading end of the medium TP1 to determine the timing for writing the image onto the medium TP1.

The eraser roller pair 270 carrying the bias voltage of +250 V supplied from the power source PW5 moves the white developer particles in the medium TP1 toward one of the substrates, and also moves the black developer particles toward the other substrate so that the medium TP1 is initialized (and the image, if already formed, is erased). Further, the rotating magnet roller 270*a* applies an oscillating magnetic field to the developer containing the magnetic particles contained in the medium TP1 for stirring it so that the flowability of the developer particles is improved to achieve easy initialization of the medium TP1.

The eraser roller pair 270 may be arranged on either upstream to or downstream from the timing roller pair 22. One roller pair may be configured to serve both the eraser roller pair and the timing roller pair.

The surface of the photosensitive member 211 is charged by the charging roller 212 to +500 V, and the image exposing device 213 performs the image exposure on the charged region so that an electrostatic latent image corresponding to the intended image is formed.

Then, the electrostatic latent image is opposed to the medium TP1 sent from the timing roller pair 22, and the transfer roller (serving as the opposite electrode in this case) 215 bearing the bias for image writing and supplied from the power source PW3 forms the contrast image corresponding to the electrostatic latent image on the photosensitive member on the medium TP1. In this operation, a peripheral speed ratio θ equal to 1 is set between the peripheral speed of the photosensitive member and the peripheral speed of the transfer roller (opposite electrode roller), and the transfer roller bears the bias of +250 V. Thereby, the image is formed by the Coulomb force acting between the electrostatic field formed in the region, where the photosensitive member and the transfer roller (opposite electrode roller) are opposed to each other, and the charged particles contained in the medium TP1. For the above image formation, the magnet roller 215*a* arranged within the transfer roller 215 is driven to rotate for magnetically stirring the developer particles within the medium TP1 so that the flowability of the particles is improved during the image formation.

In the above image formation, the surface potential on the photosensitive member may be further raised, e.g., to +1000 V, and the bias applied to the transfer roller may be raised to, e.g., +500 V, whereby the electric field driving the developer particles within the medium TP1 becomes double, and fast image display can be performed. In this case, it is preferable to increase the exposure intensity in accordance with increase in surface potential of the photosensitive member so that the latent image can be formed reliably.

The medium TP1 on which the image is formed in the above manner is discharged onto the tray TPT through the path 262.

The trays PPT and TPT may be formed of the same tray.

Figure 18:
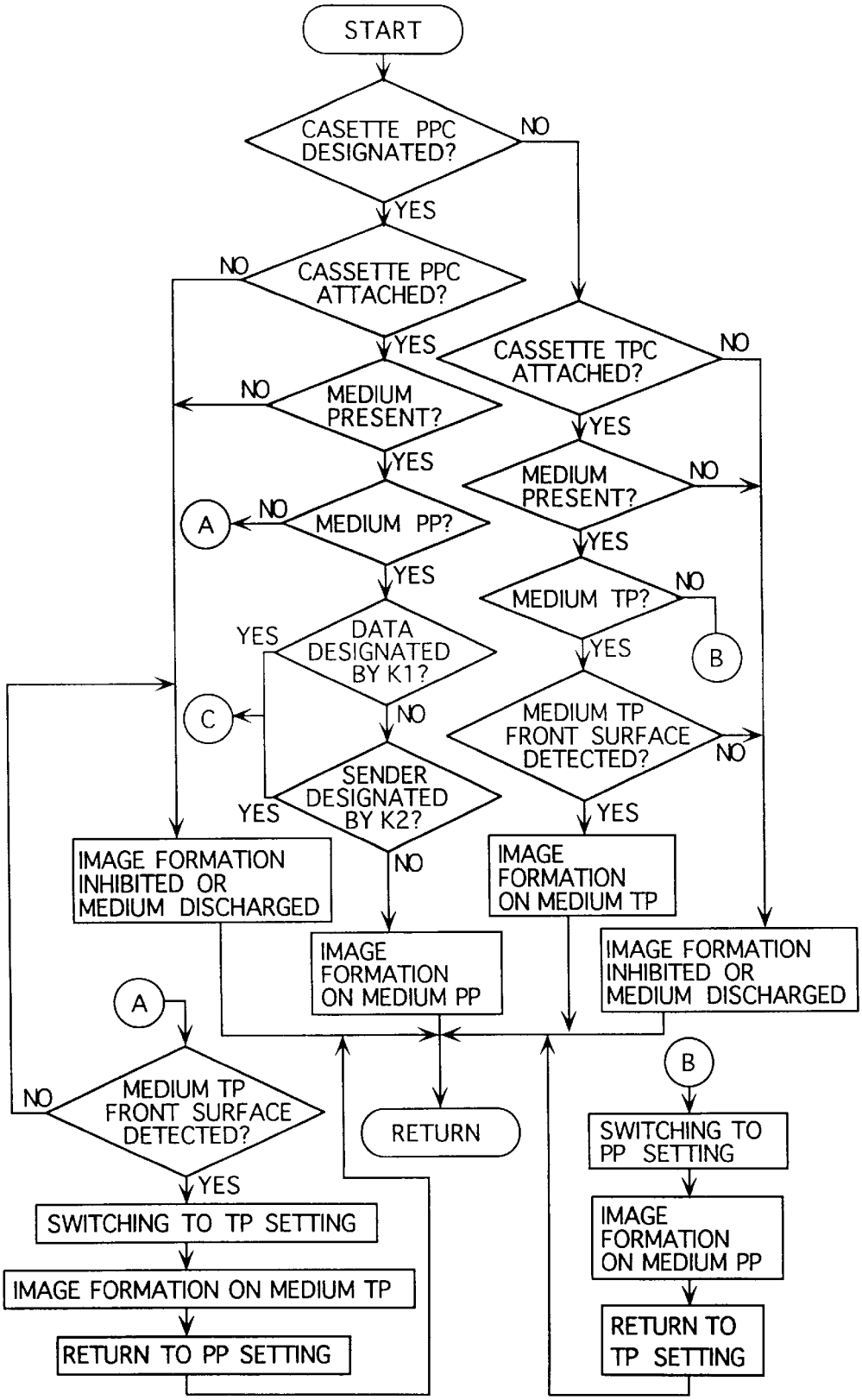
FIG. 18 is a flowchart showing still another example of the control operation of the apparatus shown in FIG. 14.

Instead of the control shown in FIG. 16, the controller 271A' may perform the control shown in FIG. 18.

The control is as follows. In the state where the cassette PPC (PP mode) is selected and designated, the image is formed on the medium PP when the medium PP is to be used for the image formation, and there is no image data transfer relating to the designation by the designating-portions K1 and K2. However, if the medium TP is to be supplied, and is faced correctly, the image forming elements are switched to the TP setting for forming the image on the medium TP, and thereafter the PP setting is restored. If the medium TP is upside down, the image formation is inhibited (or the medium TP is discharged without the image formation), and the display portion DIS displays to the effect.

When the medium PP is to be used for the image formation, and there is image data transfer relating to the designation by the designating portions K1 and K2, the control shown in FIG. 17 is performed.

In the state where the cassette TPC (TP mode) is selected and designated, the image is formed on the medium TP if the medium TP is to be used for the image formation, and is faced correctly. However, if the medium TP is upside down, the image formation is inhibited (or the medium TP is discharged without the image formation), and the display portion DIS displays to the effect. If the medium PP is to be supplied, the image formation elements are switched to the PP setting, and the image is formed on the medium PP. Thereafter, the setting is restored to the TP setting.

In any one of the above cases, if the cassette is not attached, or the medium is not present in the attached cassette, the image formation is inhibited, and the display displays to the effect.

Figure 19:
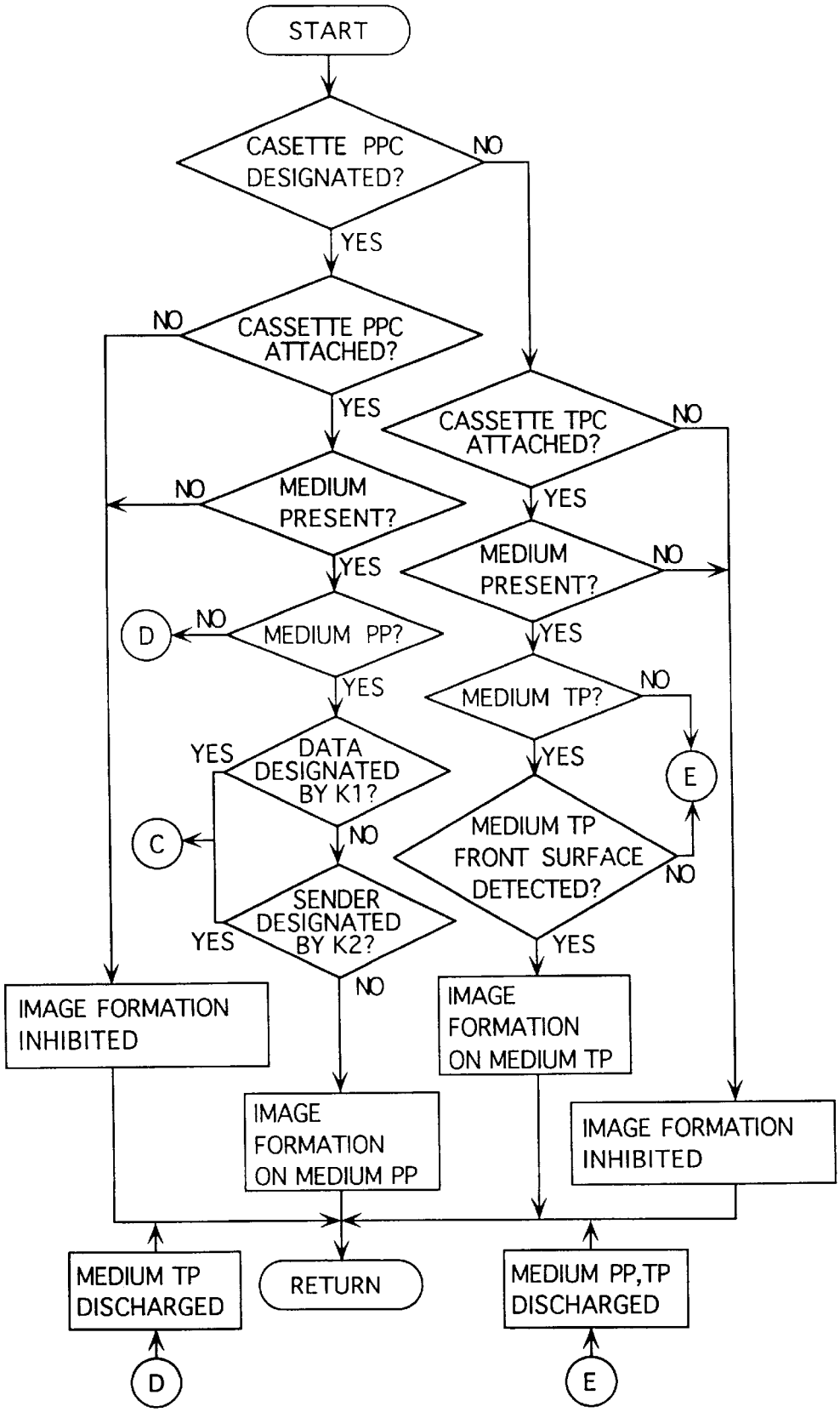
FIG. 19 is a flowchart showing further another example of the control operation of the apparatus shown in FIG. 14.

Instead of the control shown in FIG. 16, the controller 271A' may perform the control shown in FIG. 19.

The control is as follows. In the state where the cassette PPC (PP mode) is selected and designated, the image is formed on the medium PP when the medium PP is used for the image formation, and there is no image data transfer relating to the designation by the designating portions K1 and K2. However, if the medium TP is supplied, the medium TP is discharged without image formation. When the medium PP is supplied thereafter, the image is formed thereon. When the medium PP is used for the image formation, and there is image data transfer relating to the designation by the designating portions K1 and K2, the control shown in FIG. 17 is performed.

In the state where the cassette TPC (TP mode) is selected and designated, the image is formed on the medium TP if the medium TP is used for the image formation, and is faced correctly. If the medium TP is upside down, the medium TP is discharged without image formation. When the medium TP faced correctly is supplied thereafter, the image is formed on the medium TP. If the medium PP is used for image formation, the medium PP is discharged without image formation. When the medium TP faced correctly is supplied thereafter, the image is formed on the medium TP.

When the cassette is not attached, or the medium is not present in the attached cassette, the image formation is inhibited, and the display portion displays to the effect.

Figure 20:
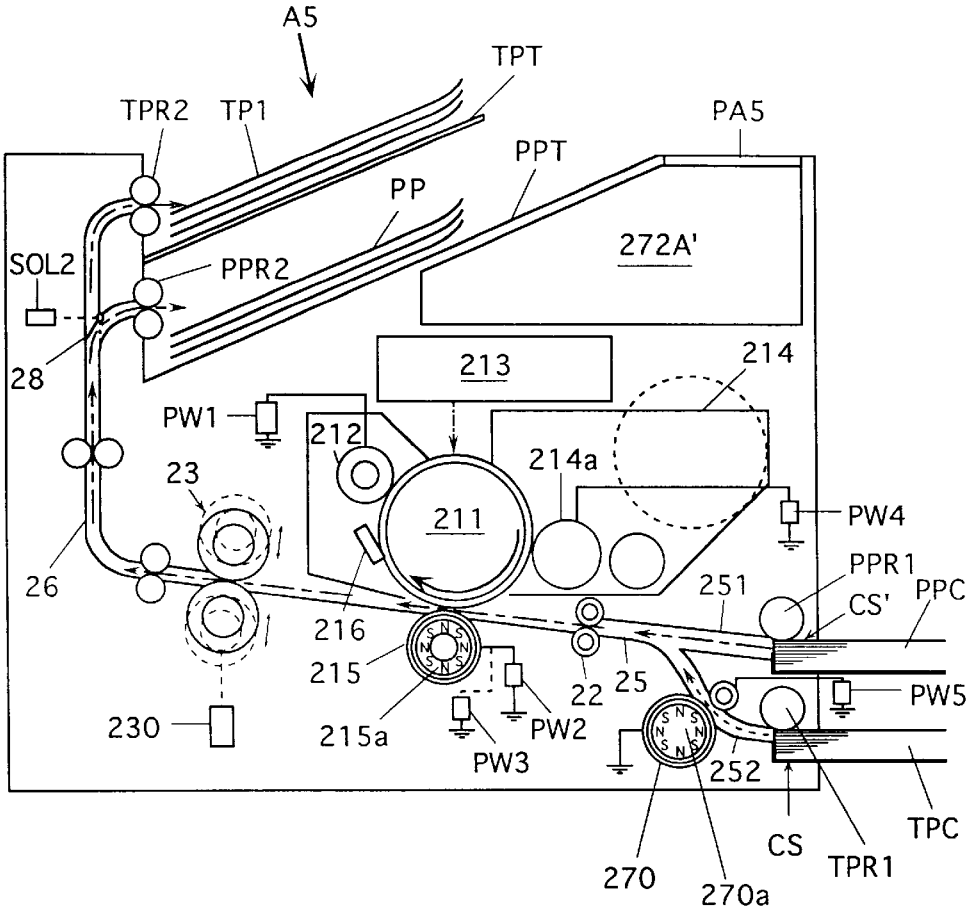
FIG. 20 shows a schematic structure of further another example of the image forming apparatus.

<Image Forming Apparatus A5 in FIG. 20>

An image forming apparatus A5 in FIG. 20 differs from the image forming apparatus A4 shown in FIG. 14 in that the stationary fixing roller pair 23 is replaced with a roller pair, which is the same as the movable fixing roller pair 23 in the apparatus A2 shown in FIG. 12, and the same path and claw as the common and single medium transportation path 26 and the switching claw 28 in the apparatus A2 are employed.

A controller 272A' controlling the whole operation of the apparatus A5 controls the operations of forming the images on the mediums PP and TP.

Structures other than the above are the same as those of the image forming apparatus A4. The same portions as those in the apparatus A4 bear the same reference numbers. The controller 272A' is connected to a control panel PA5 similar to that in the apparatus A4.

Switching of the setting of the image forming elements, the image forming processing and others are performed similarly to the apparatus A4.

The image forming apparatus A5 performs the PP-mode image formation using the normal paper sheet as well as the TP-mode image formation using the medium TP1 in the following manners.

PP mode (electrophotographic image formation on the normal paper sheet)

The upper and lower rollers of the fixing roller pair 23 are set for image fixing, and the claw 28 occupies a position for sending the medium PP toward the tray PPT. Manners other than the above are similar to those in the case of the image forming apparatus A4.

TP mode (using medium TP1)

The nip pressure of the fixing roller pair 23 is set such that the image on the medium TP1 may not be damaged and further the medium TP1 can smoothly move through the fixing roller pair 23. The claw 28 occupies the position for sending the medium TP1 toward the tray TPT. Manners other than the above are similar to those in the case of the image forming apparatus A4.

The trays PPT and TPT may be formed of the same tray.

Figure 21:
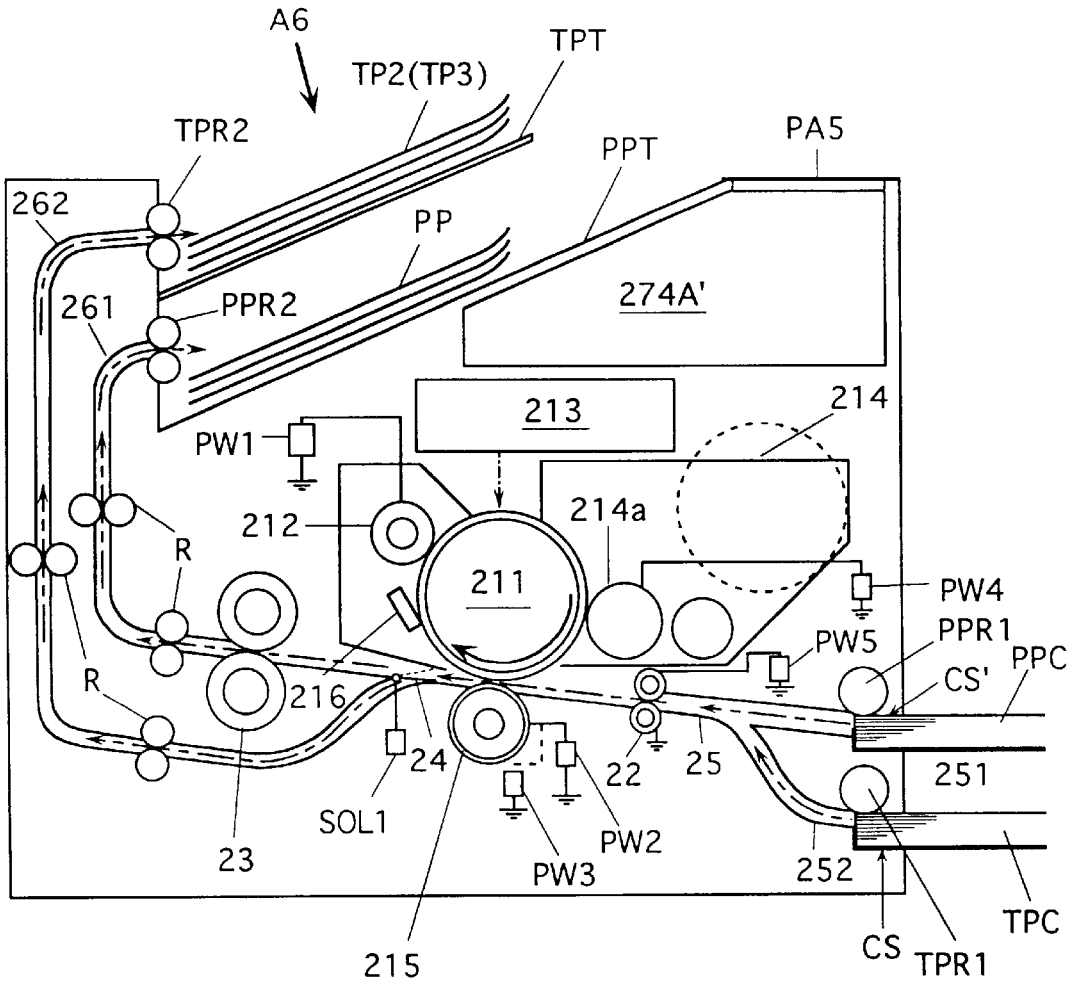
FIG. 21 shows a schematic structure of further another example of the image forming apparatus.

<Image Forming Apparatus A6 in FIG. 21>

An image forming apparatus A6 forms the image on the medium PP in the PP mode, and forms the image on the medium TP2 or TP3 in the TP mode.

The apparatus A6 differs from the apparatus A4 in FIG. 14 in that the eraser roller pair 270 and the internal magnet roller 270*a* are not arranged, and the internal magnet roller 215*a* is not arranged in the transfer roller 215. The timing roller pair 22 serves also as the eraser roller pair. An upper roller of the timing roller pair 22 can receive a bias from the power source PW5, and a lower roller is grounded.

A controller 274A' controlling the whole operation of the apparatus A6 controls the operations of forming the images on the mediums PP and TP. The controller 274A' is connected to a control panel PA5 similar to that in the apparatus A4.

Structures other than the above are the same as those of the image forming apparatus A4. The same portions as those in the apparatus A4 bear the same reference numbers.

Switching of the setting of the image forming elements, the image forming processing and others are performed similarly to the apparatus A4.

The image forming apparatus A6 performs the PP-mode image formation using the normal paper sheet as well as the TP-mode image formation using the mediums TP2 or TP3 in the following manners.

PP mode (electrophotographic image formation on the normal paper sheet)

This is performed in the same manner as the image forming apparatus A4.

TP mode (using TP2 or TP3)

For the image formation in the TP mode, the cassette TPC accommodates the medium TP2 or TP3, and the medium feed roller TPR1 are used. Except for these, the image formation is performed in the same manner as that for forming the image on the medium TP2 or TP3 in the image forming apparatus A3 shown in FIG. 13.

Figure 22:
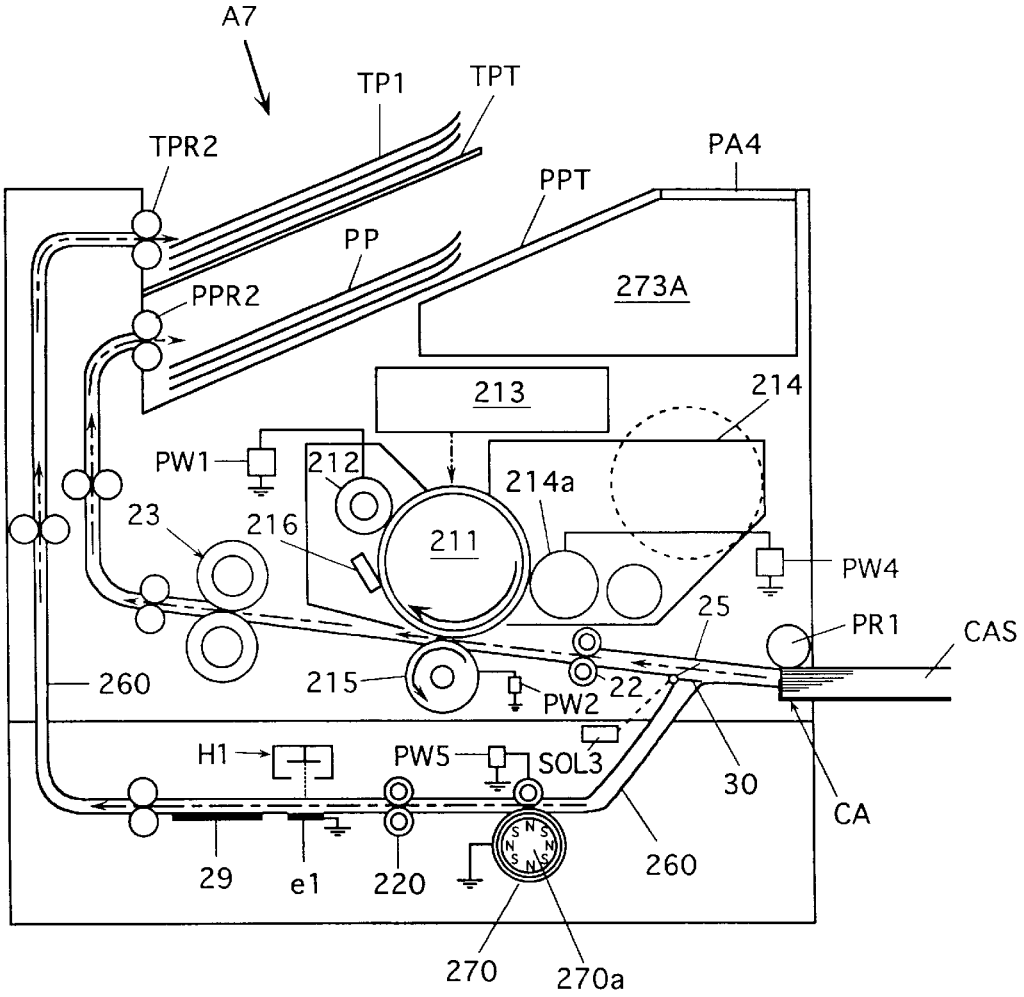
FIG. 22 shows a schematic structure of further another example of the image forming apparatus.

<Image Forming Apparatus A7 shown in FIG. 22>

An image forming apparatus A7 differs from the image forming apparatus A4 shown in FIG. 14 in that the image forming portion for the medium TP is replaced with an image forming portion using an ion-flow head H1, and the cassette attaching portion CA is only one in number similarly to the apparatus A1 (see FIG. 6). The cassette CAS is attached to the cassette attaching portion CA.

The image forming portion for the medium PP is the substantially same as the electrophotographic image forming portion in the apparatus A4 except for the following portion. Thus, in the PP-mode image forming portion of the apparatus A7, a transportation path having a transportation path switching member(claw) 30, which is driven by a solenoid SOL3, is formed within the medium transportation path 25 extending from the cassette (e.g., cassette CAS) to the timing roller pair 22, and the medium transporting path extending to the fixing roller pair 23 is formed of the single path by removing the switching claw 24. Structures other than the above are the same as those of the image forming apparatus A4. The same portions as those in the apparatus A4 bear the same reference numbers. A controller 273A controlling the whole operation of the apparatus A7 controls the operations of forming the image on the medium PP.

The TP-mode image forming portion is the image forming portion for the medium TP, and includes:

- the eraser roller pair 270 internally provided with the magnet roller 270*a,*
- a timing roller pair 220,
- the ion-flow head H1 and the opposite electrode e1 for image writing,
- the magnet sheet 29 opposed to the medium path 260 and having a magnetic pole pattern provided with a plurality of magnetic poles directed perpendicular to the medium transporting direction, and
- the medium transportation path 260 extending from the switching claw 30 through the above portions to the medium discharging roller pair TPR2, wherein these are arranged in the above order.

Among the above portions, the same portions as those in the apparatus A4 bear the same reference numbers.

The controller 273A also controls the operations of forming the image on the medium TP.

Figure 23A:
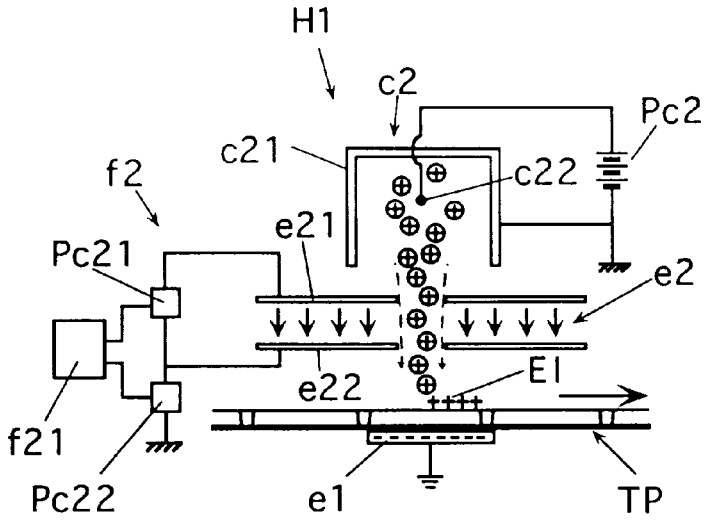
FIGS. 23(A) and 23(B) show, on an enlarged scale, an ion-flow head shown in FIG. 22, FIG. 23 (A) shows an ion-flow state.
Figure 23B:
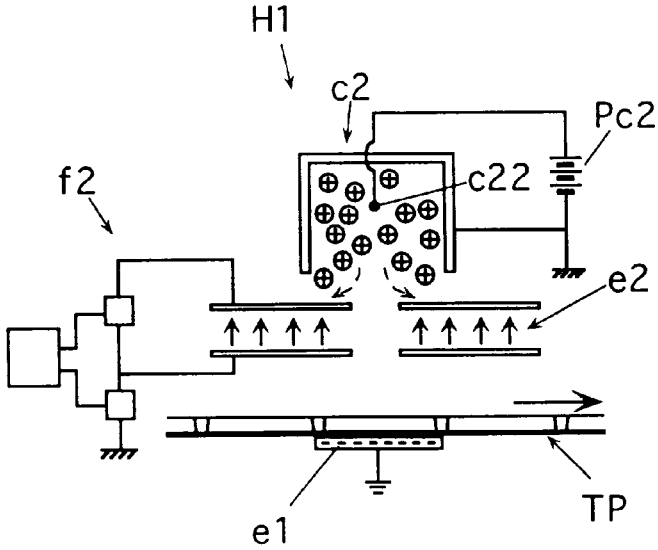

The controller 273A is connected to the control panel PA4 similar to that in the apparatus A1. As shown in FIGS. 23(A) and 23(B), the ion-flow head Hi includes a corona ion generating portion c2 for generating corona ions, a write electrode e2 for leading the corona ions thus generated to the surface of the medium TP, and a write electrode control circuit f2 for applying to the write electrode e2 a voltage for leading the positive or negative corona ions to pixel corresponding portions on the surface of the medium TP in accordance with the image to be displayed.

The corona ion generating portion c2 includes a corona wire c22 stretched in a shield casing c21, and can generate corona ions by applying a voltage (e.g., a positive or negative voltage of about 4 kV–10 kV) from a high voltage power source Pc2. The corona wire c22 may be formed of a gold-plated tungsten wire of, e.g., 60 $\mu$m–120 $\mu$m in diameter.

The write electrode e2 is located near a portion of the shield casing c21 opposed to the medium TP, and is formed of upper and lower electrodes e21 and e22. Corona ions can flow through central apertures in these electrodes e21 and e22.

The electrode control circuit f2 includes a control power source Pc21, a bias power source Pc22 and a controller f21, which can apply to the electrodes e21 and e22 the ion-leading voltage depending on the polarity of the ions to be lead toward the medium TP.

In accordance with the instruction of the controller f21, the positive and negative voltages are applied to the upper and lower electrodes e21 and e22, respectively, so that the positive corona ions can be lead to the medium (FIG. 23(A)). When the negative and positive voltages are applied to the upper and lower electrodes e21 and e22, respectively, the positive corona ions can be confined (FIG. 23(B)).

The opposite electrode (ground electrode in this example) e1 is opposed to the write electrode e2.

As described above, the medium TP of the electric field drive type is moved relatively to the head H1. Also, depending on the images to be displayed and in accordance with the instruction from the controller f21, the positive corona ions are selectively led to the pixel corresponding portions on the surface of the medium TP, and particularly are led for the predetermined pixel corresponding portions corresponding to the image to be displayed as shown in FIG. 23(A), and outflow of the ions for the other pixels are prevented as shown in FIG. 23(B).

In the above manners, the image is written.

The discharging wire c22 may be replaced with a solid discharging element.

The setting of the image forming elements in the image forming apparatus A7 can be switched in accordance with the detection of the medium type by the medium type detecting device, which is provided at the cassette attaching portion CA, or can be switched by the selector switch SWA1 provided on the control panel PA4 (see FIG.9(A)), similarly to the device A1. In the standard mode, the electrophotographic image forming portion including the upper photosensitive member 211 is set to the standard state for forming the image on the medium PP. In the non-standard mode, the image forming portion including the lower ion-flow head H1 is set to the state for forming the image on the medium TP.

Switching of the setting of the image forming elements, the image forming processing and others are performed similarly to the apparatus A1.

The image forming apparatus A7 performs the PP-mode image formation using the normal paper sheet as well as the TP-mode image formation using the medium TP1 in the following manners.

PP mode (electrophotographic image formation on the normal paper sheet)

The operation is performed similarly to the image forming apparatus A4.

TP mode (using medium TP1)

In the image recording on the medium TP1, the medium TP1 accommodated in the cassette CAS is pulled out by the feed roller PR1, and is transported to the timing roller pair 220 through the eraser roller pair 270 as a result of switching of the medium transportation path by the switching claw 30 so that it comes into contact with the nip portion of the roller pair 220. In this operation, a fore-regist sensor (not shown) detects the leading end of the medium TP1 to determine the timing for writing the image on the medium TP1.

The eraser roller pair 270 carrying the bias voltage of +250 V supplied from the power source PW5 initializes the medium TP1. Further, the rotating magnet roller 270*a* applies an oscillating magnetic field to the developer containing the magnetic particles contained in the medium TP1 for stirring it so that the flowability of the developer particles is improved to achieve easy initialization of the medium TP1.

The eraser roller pair 270 may be arranged on either upstream to or downstream from the timing roller pair 220. One roller pair may be configured to serve both the eraser roller pair and the timing roller pair.

The medium TP1 sent from the timing roller pair 220 moves toward the ion-flow head H1.

The head H1 forms an electrostatic latent image corresponding to the image to be formed on the medium TP1 transported to the head H1.

When the medium TP1 carrying the electrostatic latent image thus formed passes over the magnet sheet 29, the developer particles are stirred by the oscillating magnetic field, and are moved by the coulomb force based on the electrostatic latent image. Thereby, the contrast image corresponding to the electrostatic latent image is formed.

In this operation, an arbitrary bias may be applied to the conductive layer on the rear side of the medium TP1. The bias thus applied may be of a value intermediate the surface potentials on the image portion and non-image portion.

The medium TP1 on which the image is formed in the above manner is discharged onto the tray TPT by the discharge roller TRR2.

The trays PPT and TPT in the apparatus A7 may be formed of the same tray.

Instead of the image forming portion for the medium TP using the ion-flow head H1, the apparatus A7 may employ the image forming portion for the medium TP4 using the magnetic head H2 shown in FIG. 5.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. An image forming apparatus comprising:

a first image forming portion for forming an image on a normal image display medium;

a second image forming portion for forming an image on a reversible image display medium; and a medium type detecting device for detecting whether an image display medium to be subjected to the image formation is the normal image display medium or the reversible image display medium, wherein said first or second image forming portion corresponding to the image display medium of the type detected by said medium type detecting device is allowed to perform the image formation when said medium type detecting device detects the image display medium of the same type as that selected by an operator, and the image formation on the image display medium of the type detected by said medium type detecting device is inhibited when the detected type is different from the selected type.

2. The image forming apparatus according to claim 1, wherein the image display medium of the type detected by said medium type detecting device is discharged without image formation when the detected type is different from the selected type.

3. The image forming apparatus according to claim 2, wherein after the image display medium of the type different from that selected by the operator is discharged, the image formation on the image display medium of the type selected by the operator is allowed when said medium type detecting device detects the image display medium of the type selected by the operator.

4. The image forming apparatus according to claim 1, wherein the image display medium to be subjected to image formation is accommodated in a cassette attached to a cassette attaching portion provided in the image forming apparatus, and one or more said medium type detecting devices are provided, and at least one of said medium type detecting devices detects whether the image display medium to be subjected to the image formation is the normal image display medium or the reversible image display medium, based on a medium type display portion provided on the image display medium.

5. The image forming apparatus according to claim 4, wherein two or more said cassette attaching portions are provided, and said medium type detecting device is arranged for each of said cassette attaching portions.

6. The image forming apparatus according to claim 1, wherein the image display medium to be subjected to image formation is accommodated in a cassette attached to a cassette attaching portion provided in the image forming apparatus, and one or more said medium type detecting devices are provided, and at least one of said medium type detecting devices detects whether the image display medium to be subjected to image formation is the normal image display medium or the reversible image display medium, based on a medium type display portion provided on the image display medium.

7. The image forming apparatus according to claim 6, wherein two or more said cassette attaching portions are provided, and said medium type detecting device is arranged for each of said cassette attaching portions.

8. An image forming apparatus comprising:

a first image forming portion for forming an image on a normal image display medium;

a second image forming portion for forming an image on a reversible image display medium; and a medium type detecting device for detecting whether an image display medium to be subjected to the image formation is the normal image display medium or the reversible image display medium, wherein said first or second image forming portion corresponding to the image display medium of the type detected by said medium type detecting device is allowed to perform the image formation when said medium type detecting device detects the image display medium of the same type as that selected by an operator, and said first or second image forming portion corresponding to the image display medium of the type different from that detected by said medium type detecting device is allowed to perform the image formation when the detected type is different from the selected type.

9. The image forming apparatus according to claim 8, wherein the image display medium to be subjected to image formation is accommodated in a cassette attached to a cassette attaching portion provided in the image forming apparatus, and one or more said medium type detecting devices are provided, and at least one of said medium type detecting devices detects whether the image display medium to be subjected to image formation is the normal image display medium or the reversible image display medium, based on a medium type display portion provided on the image display medium.

10. The image forming apparatus according to claim 9, wherein two or more said cassette attaching portions are provided, and said medium type detecting device is arranged for each of said cassette attaching portions.

11. The image forming apparatus according to claim 8, wherein the image display medium to be subjected to image formation is accommodated in a cassette attached to a cassette attaching portion provided in the image forming apparatus, and one or more said medium type detecting devices are provided, and at least one of said medium type detecting devices detects whether the image display medium to be subjected to image formation is the normal image display medium or the reversible image display medium, based on a medium type display portion provided on the image display medium.

12. The image forming apparatus according to claim 11, wherein two or more said cassette attaching portions are provided, and said medium type detecting device is arranged for each of said cassette attaching portions.

13. An image forming apparatus comprising:

a first image forming portion for forming an image on a normal image display medium;

a second image forming portion for forming an image on a reversible image display medium;

a medium type detecting device for detecting whether an image display medium to be subjected to the image formation is the normal image display medium or the reversible image display medium; and a medium surface direction detecting device for detecting whether the front and rear surfaces of the reversible image display medium are faced in predetermined directions, respectively, wherein the image formation by said second image forming portion is allowed when the image display medium detected by said medium type detecting device is the reversible image display medium and said medium surface direction detecting device detects the predetermined directions of the front and rear surfaces of the reversible image display medium, and the image formation by said second image forming portion is inhibited when the front and rear surfaces of the reversible image display medium are not faced in the predetermined directions.

14. The image forming apparatus according to claim 13, wherein said reversible image display medium is discharged without image formation when the front and rear surfaces of the reversible image display medium are not faced in the predetermined directions.

15. The image forming apparatus according to claim 14, wherein after the reversible image display medium having the front and rear surfaces not faced in the predetermined directions is discharged, the image formation on the reversible image display medium having the front and rear surfaces faced in the predetermined directions is allowed when the medium type detecting device and the medium surface direction detecting device detect the reversible image display medium having the front and rear surfaces faced in the predetermined directions.

16. The image forming apparatus according to claim 13, wherein the image formation by said first image forming portion is allowed independently of the directions of the front and rear surfaces of the medium, if said medium type detecting device detects the normal image display medium.

17. The image forming apparatus according to claim 13, wherein the image display medium to be subjected to image formation is accommodated in a cassette attached to a cassette attaching portion provided in the image forming apparatus, and one or more said medium type detecting devices are provided, and at least one of said medium type detecting devices detects whether the image display medium to be subjected to image formation is the normal image display medium or the reversible image display medium, based on a medium type display portion provided on the image display medium.

18. The image forming apparatus according to claim 17, wherein two or more said cassette attaching portions are provided, and said medium type detecting device is arranged for each of said cassette attaching portions.

19. The image forming apparatus according to claim 13, wherein the image display medium to be subjected to image formation is accommodated in a cassette attached to a cassette attaching portion provided in the image forming apparatus, and one or more said medium type detecting devices are provided, and at least one of said medium type detecting devices detects whether the image display medium to be subjected to image formation is the normal image display medium or the reversible image display medium, based on a medium type display portion provided on the image display medium.

20. The image forming apparatus according to claim 19, wherein two or more said cassette attaching portions are provided, and said medium type detecting device is arranged for each of said cassette attaching portions.

* * * * *